US010410460B2

(12) United States Patent
Asada

(10) Patent No.: US 10,410,460 B2
(45) Date of Patent: Sep. 10, 2019

(54) PAPER SHEET HANDLING APPARATUS

(71) Applicant: GLORY LTD., Himeji-shi, Hyogo (JP)

(72) Inventor: Toshihide Asada, Hyogo (JP)

(73) Assignee: GLORY LTD., Himeji-Shi, Hyogo (JP)

( * ) Notice: Subject to any disclaimer, the term of this patent is extended or adjusted under 35 U.S.C. 154(b) by 0 days.

(21) Appl. No.: 15/911,456

(22) Filed: Mar. 5, 2018

(65) Prior Publication Data

US 2018/0240295 A1 Aug. 23, 2018

Related U.S. Application Data

(63) Continuation of application No. 15/506,394, filed as application No. PCT/JP2015/074005 on Aug. 26, 2015, now abandoned.

(30) Foreign Application Priority Data

Aug. 27, 2014 (JP) ..... 2014-173340
Aug. 26, 2015 (WO) ..... PCT/JP2015/074005

(51) Int. Cl.
*G07D 11/50* (2019.01)
*G07D 11/24* (2019.01)
(Continued)

(52) U.S. Cl.
CPC ..... *G07D 11/50* (2019.01); *B65H 29/40* (2013.01); *B65H 31/02* (2013.01); *B65H 31/24* (2013.01);
(Continued)

(58) Field of Classification Search
CPC .. G07D 11/0087; G07D 11/009; G07D 11/20; G07D 11/24; G07D 11/30;
(Continued)

(56) References Cited

U.S. PATENT DOCUMENTS 6,328,166 B1 12/2001 Sakai
6,540,090 B1 * 4/2003 Sakai ..... B65H 31/06 209/534
(Continued)

FOREIGN PATENT DOCUMENTS

CN 101075363 A 11/2007
JP 10-111969 A 4/1998
(Continued)

OTHER PUBLICATIONS

Chinese Office Action (Application No. 201580045736.3) (5 pages—dated Aug. 13, 2018).

*Primary Examiner* — Mark J Beauchaine
(74) *Attorney, Agent, or Firm* — Renner Kenner Greive Bobak Taylor and Weber; Edward Greive; Tim Hodgkiss

(57) ABSTRACT

In order to display information for rejected paper sheets in an easily recognizable manner, the paper sheet handling apparatus includes: a transport path configured to transport paper sheets; a recognition unit configured to recognize the paper sheets transported in the transport path; a reject unit configured to stack rejected paper sheets discharged from the transport path based on a recognition result by the recognition unit; and a display unit configured to display information for rejected paper sheets in a manner which is different for a case where the number of the rejected paper sheets stacked in the reject unit can be determined, and for a case where the number of the rejected paper sheets stacked in the reject unit cannot be determined.

14 Claims, 24 Drawing Sheets

(51) Int. Cl.

| | |
|---|---|
| ***G07D 11/36*** | (2019.01) |
| ***G07F 7/04*** | (2006.01) |
| ***B65H 29/40*** | (2006.01) |
| ***B65H 31/02*** | (2006.01) |
| ***B65H 31/24*** | (2006.01) |
| ***B65H 31/30*** | (2006.01) |
| *B65H 7/12* | (2006.01) |

(52) U.S. Cl.
CPC ..... *B65H 31/3081* (2013.01); *G07D 11/24* (2019.01); *G07D 11/36* (2019.01); *G07F 7/04* (2013.01); *B65H 7/12* (2013.01); *B65H 2301/4214* (2013.01); *B65H 2551/21* (2013.01); *B65H 2701/1912* (2013.01)

(58) Field of Classification Search
CPC ..... G07D 11/34; G07D 11/36; G07D 11/50; G07F 7/04; G07F 9/02; G07F 9/023; G07F 19/202; B65H 7/00; B65H 7/06; B65H 7/12; B65H 2701/1912; B65H 29/40; B65H 31/02; B65H 31/24; B65H 31/3081
See application file for complete search history.

(56) References Cited

U.S. PATENT DOCUMENTS

| | | | |
|---|---|---|---|
| 2010/0126915 | A1 | 5/2010 | Iwami |
| 2011/0019901 | A1 | 1/2011 | Matsuura et al. |
| 2011/0172808 | A1 | 7/2011 | Fu et al. |

FOREIGN PATENT DOCUMENTS

| | | | |
|---|---|---|---|
| JP | 2007-156710 | A | 6/2007 |
| JP | 2009-205246 | A | 9/2009 |
| WO | WO 2009/118857 | A1 | 10/2009 |
| WO | WO 2013/153573 | A1 | 10/2013 |

* cited by examiner (A)

(B)

(A)

(B)

ANGLE a=70 DEGREES (60≤a≤80)
ANGLE b=15 DEGREES (0<b≤30)
ANGLE c=95 DEGREES (70<c<120)
d=93.0 mm (LARGEST BANKNOTE SHORT EDGE LENGTH IS 85mm)
e=71.5 mm (LARGEST BANKNOTE SHORT EDGE LENGTH IS 85mm)
f=33 mm (MAXIMUM NUMBER OF BANKNOTES TO BE STACKED IS 200)

(A)

(B)

(A)

(B)

| | STACKING UNIT | PRIORITY | DENOMINATION | FITNESS/UNFITNESS |
|---|---|---|---|---|
| PATTERN 1 | FIRST STACKING UNIT | 1 | — | — |
| | SECOND STACKING UNIT | 2 | — | — |
| PATTERN 2 | FIRST STACKING UNIT | 2 | — | — |
| | SECOND STACKING UNIT | 1 | — | — |

(A)

(B)

(C)

(D)

PAPER SHEET HANDLING APPARATUS

CROSS-REFERENCE TO RELATED APPLICATION

This is a Continuation of U.S. patent application Ser. No. 15/506,394 filed on Feb. 24, 2017, which was the National Stage of International Application No. PCT/JP2015/074005 filed on Aug. 26, 2015, which claimed the benefit of priority from the Japanese Patent Application No. 2014-173340 filed on Aug. 27, 2014, the entire contents of which are incorporated herein by reference.

TECHNICAL FIELD

The present invention relates to a paper sheet handling apparatus that recognizes kinds of paper sheets, and stacks the paper sheets in stacking units according to the recognition results.

BACKGROUND ART

To date, in financial facilities such as banks, paper sheet handling apparatuses that handle paper sheets such as banknotes and checks have been used. For example, a banknote handling apparatus is used to perform authentication of banknotes, or count the number of banknotes or the monetary amount of the banknotes. A small banknote handling apparatus that can be used at a teller window by a person (teller) in charge of the teller window is disclosed in Patent Literature 1. The banknote handling apparatus has a function of feeding banknotes placed in a hopper, one by one, into the apparatus, performing recognition of denominations of the banknotes and authentication of the banknotes, and counting the banknotes. The banknote handling apparatus includes, in addition to the hopper, four stacking units in which the recognized and counted banknotes are stacked, and a reject unit into which rejected notes such as counterfeit notes, and banknotes for which denominations or authenticity cannot be recognized, are discharged. The banknotes in the hopper are transported into the stacking units or the reject unit according to the recognition results. For example, banknotes received from a customer at a teller window are handled by the banknote handling apparatus, whereby results of authentication of the banknotes, and results of the handling such as the number of banknotes per denomination or the total monetary amount of the banknotes, can be obtained. Therefore, the burden of the task on a teller can be reduced. Further, banknotes are recognized and counted by the banknote handling apparatus, whereby human error in authentication or calculating the monetary value can be prevented.

In the banknote handling apparatus disclosed in Patent Literature 1, information about handled banknotes is displayed on a screen of a banknote management apparatus. For example, various information such as a denomination and the number of banknotes that are stacked in each of the four stacking units, as well as the total number of deposited banknotes and the total monetary amount thereof, are displayed in a depositing step.

CITATION LIST

Patent Literature

[PTL 1] Japanese Patent No. 5313257

SUMMARY OF THE INVENTION

Problems to be Solved by the Invention

However, the above conventional art has a problem that information for paper sheets that are rejected into the reject unit is not displayed. For example, in a case where a teller who receives 100 banknotes from a customer at the teller window uses the conventional banknote handling apparatus to perform recognition and counting of the banknotes, if five banknotes among the 100 banknotes are stacked as rejected notes in the reject unit, display on the display unit merely represents 95 banknotes, and information for the five rejected notes is not displayed. Therefore, in a case where, although 100 banknotes have been delivered to the teller, the display represents 95 banknotes, the customer may feel anxious or the teller may not find that the rejection of notes has occurred and be confused during the handling in some cases.

The rejected notes include not only a rejected note which can be determined as one banknote, such as a banknote for which a denomination or authenticity cannot be recognized or a banknote recognized as a counterfeit note, but also rejected notes for which the number of banknotes cannot be determined due to, for example, overlapping or chaining in which a plurality of banknotes are transported in a state where the entirety or some of the plurality of banknotes overlap each other. In a case where such rejected notes for which the number of banknotes cannot be determined occurs, a problem associated with how information for the rejected notes is to be displayed, arises.

The present invention is made in order to solve the aforementioned problem of the conventional art, and an object of the present invention is to provide a paper sheet handling apparatus which displays information for rejected paper sheets in an easily recognizable manner.

Solution to the Problems

In order to solve the aforementioned problem and attain the object, the present invention is directed to a paper sheet handling apparatus that includes: a transport path configured to transport paper sheets; a recognition unit configured to recognize the paper sheets transported in the transport path; a reject unit configured to stack rejected paper sheets discharged from the transport path based on a recognition result by the recognition unit; and a display unit configured to display information for rejected paper sheets in a manner which is different for a case where the number of the rejected paper sheets stacked in the reject unit can be determined and for a case where the number of the rejected paper sheets stacked in the reject unit cannot be determined.

Further, according to the present invention, the display unit: displays the total number of the rejected paper sheets stacked in the reject unit while the number of the rejected paper sheets stacked in the reject unit can be determined, the display unit: displays, as the number of times rejection has occurred, a value obtained by adding the total number of rejected paper sheets for which the number of paper sheets has been determined, and the number of times rejection has occurred in a state where the number of rejected paper sheets cannot be determined, instead of the total number of rejected paper sheets for which the number of paper sheets has been determined, being displayed, in a case where rejection has occurred in a state where the number of rejected paper sheets cannot be determined, and the number of rejected paper sheets stacked in the reject unit cannot be determined.

Further, according to the present invention, the display unit: displays the total number of the rejected paper sheets stacked in the reject unit while the number of the rejected paper sheets stacked in the reject unit can be determined. the display unit: displays, as the number of times rejection has occurred, the number of times rejection has occurred in a state where the number of rejected paper sheets cannot be determined, in addition to the total number of rejected paper sheets for which the number of paper sheets has been determined, being displayed, in a case where rejection has occurred in a state where the number of rejected paper sheets cannot be determined, and the number of rejected paper sheets stacked in the reject unit cannot be determined.

Further, according to the present invention, when the number of times rejection has occurred in a state where the number of rejected paper sheets cannot be determined is displayed as the number of times rejection has occurred, the number of times rejection has occurred is displayed according to respective reject reasons.

Further, according to the present invention, a numerical value representing the number of times rejection has occurred is displayed together with information indicating that the numerical value represents the number of times rejection has occurred in a state where the number of rejected paper sheets cannot be determined.

Further, according to the present invention, the total number of rejected paper sheets and the number of times rejection has occurred are displayed in different colors, respectively.

Further, according to the present invention, a case where the number of rejected paper sheets cannot be determined is a case where a paper sheet transported in the transport path is in at least one of: an overlapping state; a chaining state; an abnormal thickness state; and an abnormal size state.

Advantageous Effects of the Invention

According to the present invention, information about a paper sheet that is rejected into the reject unit can be displayed on a screen of the display unit. The information is displayed on the screen in a manner which is different for a case where the number of rejected paper sheets can be determined and for a case where the number of rejected paper sheets cannot be determined, whereby contents of the displayed information can be easily recognized. For example, a numerical value representing the number of rejected paper sheets is displayed while the number of rejected paper sheets can be determined, and the number of rejections representing the number of times rejection has occurred is displayed together with a predetermined mark or in parentheses after determination of the number of rejected paper sheets has become impossible. Thus, it can be easily known whether the displayed information represents the number of rejected paper sheets for which the number of paper sheets has been determined, or the displayed information represents the number of times rejection has occurred since the number of paper sheets cannot be determined.

Further, according to the present invention, the number of rejected paper sheets for which the number of paper sheets has been determined and the number of rejections representing the number of times rejection has occurred in a state where the number of rejected paper sheets cannot be determined can be separately displayed after determination of the number of rejected paper sheets has become impossible. By the number of rejected paper sheets being displayed, an operator of the paper sheet handling apparatus can know the total number of handled paper sheets according to the number of paper sheets stacked in the stacking unit, and the number of rejected paper sheets. Further, although the number of times rejection has occurred does not represent the number of rejected paper sheets, in a case where the number of times rejection has occurred is displayed, the operator of the paper sheet handling apparatus can easily know that rejection of a paper sheet has occurred.

DESCRIPTION OF EMBODIMENTS

A paper sheet handling apparatus according to the present invention will be described below with reference to the accompanying drawings. Although the paper sheet handling apparatus according to the present invention is capable of handling paper sheets such as banknotes, checks, and gift coupons, a banknote handling apparatus that handles banknotes will be described below as an example.

[External Structure of Apparatus]

Figure 1:
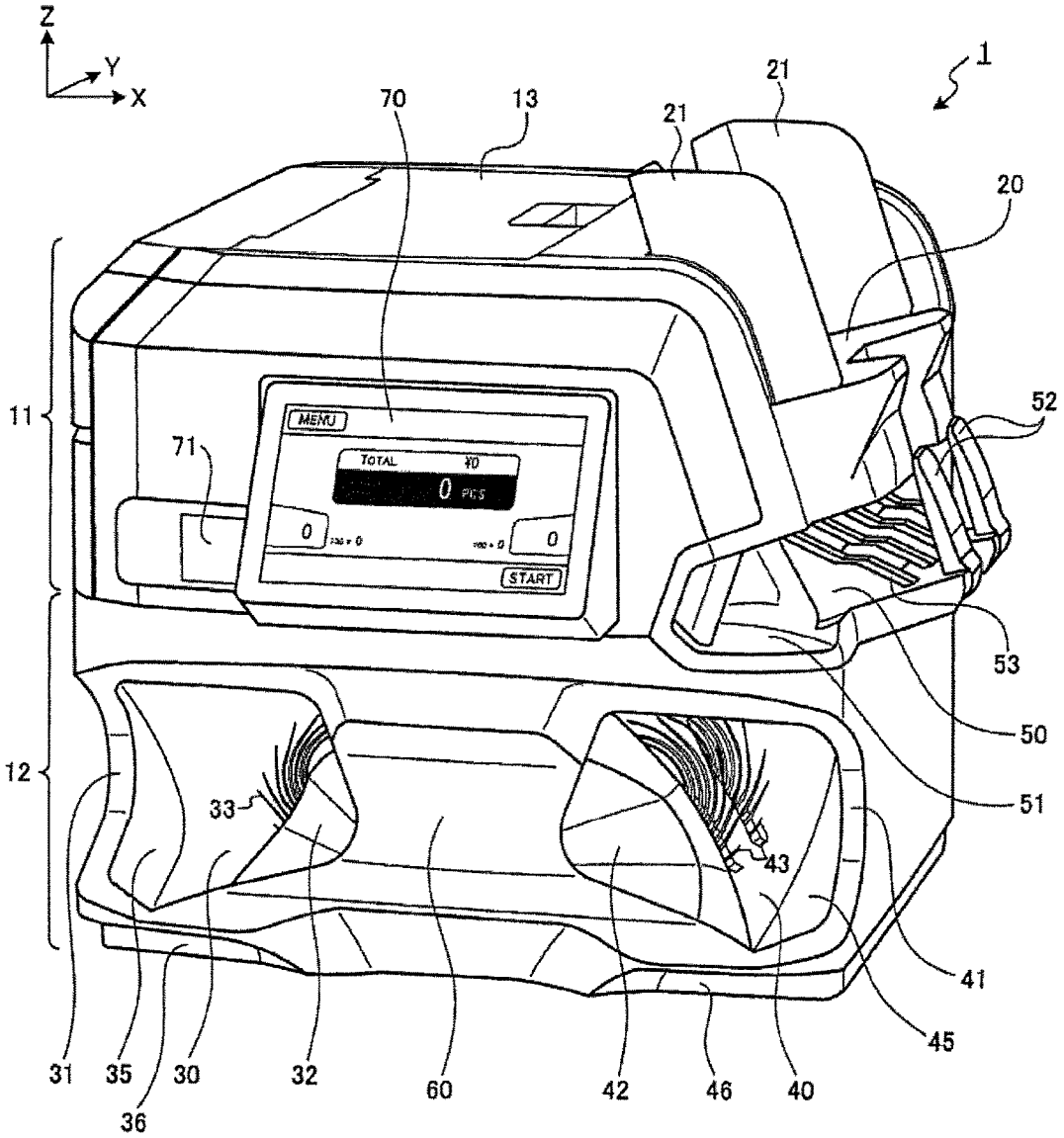
FIG. 1 is a perspective view of an external appearance of a banknote handling apparatus according to an embodiment.

FIG. 1 is a perspective view of an external appearance of a banknote handling apparatus 1. The banknote handling apparatus 1 which has a hopper 20 and a reject unit 50 on a side surface, and two banknote stacking units 30, 40 on the front surface, has a characteristic that the size of the apparatus is reduced by banknotes being stacked so as to be tilted in a standing state in the banknote stacking units 30, 40 each having an opening through which the banknotes are taken out, and by the protrusion of the reject unit 50 from the apparatus side surface being minimized to reduce the lateral width of the apparatus.

In the present embodiment, among four side surfaces of the apparatus, the apparatus front side surface on which an operation display unit 70 is disposed is referred to as the front surface, the side surface on the right side and the side surface on the left side as viewed from an operator who operates the operation display unit 70 on the front surface side of the banknote handling apparatus 1 are referred to as the right side surface and the left side surface, respectively, and the surface on the rear side is referred to as the rear surface. Further, in the present embodiment, as shown in FIG. 1, a direction from the apparatus left side surface toward the right side surface is defined as the X-axis direction, a direction from the apparatus front surface toward the rear surface is defined as the Y-axis direction, and a direction from the apparatus bottom surface toward the upper surface is defined as the Z-axis direction.

An upper unit 11 and a lower unit 12 are included on the front surface side of the banknote handling apparatus 1. The banknote handling apparatus 1 is a small apparatus that can be mounted in a space in which the lateral width (in the X-axis direction) is 450 mm, the depth (in the Y-axis direction) is 450 mm, and the height (in the Z-axis direction) is 400 mm. A part of the reject unit 50 protrudes on the right side surface, whereby the lateral width of an installation surface is further reduced to be less than or equal to 400 mm.

In the lower left and right end portions of the front surface of the banknote handling apparatus 1, recesses 36, 46 are provided so as to form gaps into which hands are placed between a desk and an apparatus housing in a case where, for example, the banknote handling apparatus 1 is installed on the desk. Recesses 36, 46 are formed also on the apparatus rear surface side. Hands can be placed in the recesses 36, 46 at the four corners on the bottom surface, whereby the banknote handling apparatus 1 can be carried.

At almost the center of the front surface of the upper unit 11, a large operation display unit 70 that allows input operation of various kinds of information and output display of various kinds of information, is disposed. In the operation display unit 70, the upper side is disposed at almost the same position as the apparatus front surface, whereas the lower side protrudes forward from the apparatus front surface, and the operation display unit 70 is fixed so as to be tilted upward such that an operator can easily view the displayed contents. A push-to-open type dust tray 71 is disposed in a portion leftward of the operation display unit 70, and is ejected from the front surface side by pushing the tray toward the rear surface side. Dust such as paper powder generated while banknotes are transported in the apparatus is collected into the dust tray 71, and the dust tray 71 can be taken out from the apparatus.

On the right side surface of the upper unit 11, the hopper 20 in which banknotes to be recognized and counted are placed, is provided. Below the hopper 20, the reject unit 50 into which rejected notes are discharged, is disposed. In the reject unit 50, the upper surface of a stacking space in which the rejected notes are stacked is in the upper unit 11, and the bottom surface thereof is in the lower unit 12. On the upper surface of the upper unit 11, an openable and closable upper lid 13 is disposed. An engagement member is disposed between the upper lid 13 and the upper unit 11, and the upper lid 13 and the upper unit 11 are usually fixed by the engagement member. As shown in FIG. 1, a lever for disengaging the engagement by the engagement member is disposed at almost the center position in the front-rear direction on the right side of the upper lid 13. When an operation of opening the upper lid 13 upward in a state where a finger is placed on the lever, is performed, an operation of disengaging the engagement by the engagement member and an operation of opening the upper lid 13 having been disengaged can be performed as a series of operation. By opening the upper lid 13, the recognition unit and the transport path in the upper unit 11 are exposed to allow inspection, maintenance, or the like to be performed.

In the hopper 20, banknotes can be placed in a stacked state such that the short edges of the banknotes face toward the front surface side (in the Y-axis negative direction), and the long edges of the banknotes face forward in the transporting direction (in the X-axis negative direction). The banknotes stacked on a stage of the hopper 20 are fed one by one into the transport path in the apparatus in order starting from the lowermost banknote. The banknotes in the transport path are transported in a state where the long edge of each banknote faces forward in the transporting direction. The hopper 20 includes guide members 21 that support the banknotes placed in a stacked state, from the short edge sides (in the Y-axis direction). The guide members 21 are formed of a transparent resin, and the banknotes placed in the hopper 20 can be checked from the outside. The two guide members 21 having shapes which are symmetrical with respect to the XZ plane can cooperate to slide in the Y-axis direction. Positions of the two guide members 21 are adjusted according to the length of the long edges of the banknotes, whereby the banknotes can be placed at almost the center of the hopper 20 in the front-rear direction (the Y-axis direction) and fed into almost the center portion, in the width direction (the Y-axis direction), of the transport path. The stage on which the banknotes are placed in the hopper 20 is shaped such that almost the center portion in the front-rear direction (the Y-axis direction) is recessed leftward (in the X-axis negative direction). Through the recess, the stacking space of the reject unit 50 below the hopper 20 can be seen (see (B) of FIG. 2). After all the banknotes on the stage are fed into the apparatus, whether or not a rejected note discharged into the reject unit 50 is present can be easily checked.

As shown in FIG. 1, the reject unit 50 includes: two stopper members 52 that stop a rejected note discharged from the transport path of the apparatus into the stacking space of the reject unit 50 so as not to eject the rejected note to the outside; and a holder member 53 that holds, from the upper side, the rejected note that have stopped in the stacking space. The stopper members 52 are maintained at a normal position shown in FIG. 1 by a spring member, and are also supported so as to be pivotable, about the Y axis, outward of the apparatus. When the rejected notes stacked in the reject unit 50 are taken out from the apparatus right side, the stopper members 52 pivot clockwise, to allow the rejected notes to be easily taken out. At the lower right portion on the front surface of the upper unit 11, a recess 51 is formed so as to be recessed from the housing front surface toward the rear surface. Further, a side wall that supports the rejected notes in the stacking space of the reject unit 50 from the short edge side is shaped such that the right side portion of the side wall on the front surface side is cut leftward. By the cutting of the side wall, the stacking space of the reject unit 50 and the space of the recess 51 connect with each other in a portion inward of the housing outer side surface. The space of the recess 51 on the housing front surface is connected with the stacking space of the reject unit 50 disposed on the right side surface, whereby an operator of the banknote handling apparatus 1 is allowed to easily check whether or not rejected notes are in the reject unit 50, and to easily take out the rejected notes from the reject unit 50 when the operator is on the apparatus front surface side.

In the recess 51, a lever for disengaging engagement by the engagement member by which the upper unit 11 and the lower unit 12 are engaged with each other is disposed at a diagonally upper left position. The lever is disposed at a position where a finger can be placed on the lever when a right hand is inserted into the recess 51 so as to raise the right side surface portion of the upper unit 11 upward. Thus, an operation of opening the upper unit 11 upward in a state where a hand is inserted into the recess 51 and a finger is placed on the lever, is performed, whereby an operation of disengaging the engagement by the engagement member and an operation of opening the upper unit 11 having been disengaged can be performed as a series of operation.

The two banknote stacking units 30 and 40 each having an opening on the front surface side are disposed on both the left and the right outer sides of the lower unit 12. The banknotes fed from the hopper 20 into the apparatus are recognized and counted by the recognition unit in the apparatus. Banknotes which are recognized to be stacked in the banknote stacking unit 30 or 40 are stacked in the first banknote stacking unit 30 or the second banknote stacking unit 40 according to the recognition result. The banknotes discharged into the banknote stacking unit from the upper right portion in the first banknote stacking unit 30 are transported toward a left side wall in the banknote stacking unit by a stacking wheel 33 that rotates about the Y axis counterclockwise. The left side wall is tilted such that the upper portion thereof is on the left side and the lower portion thereof is on the right side. The banknotes transported toward the left side wall by the stacking wheel 33 are stacked such that the banknote face is parallel to the wall surface of the tilted left side wall, and the banknotes are stacked so as to be tilted in a standing state. Similarly, the banknotes discharged into the banknote stacking unit from the upper left portion in the second banknote stacking unit 40 are transported toward a right side wall in the banknote stacking unit by a stacking wheel 43 that rotates about the Y axis clockwise. The right side wall is tilted such that the upper portion thereof is on the right side, and the lower portion thereof is on the left side. The banknotes transported toward the right side wall by the stacking wheel 43 are stacked such that the banknote face is parallel to the wall surface of the tilted right side wall, and the banknotes are stacked so as to be tilted in a standing state. That is, the banknotes are stacked in the stacking space of the banknote stacking unit, in a state where the short edge faces forward and the long edge contacts with the bottom surface, so as to be tilted in a standing state such that the upper side portion of the short edge is closer to the outer side of the apparatus than the lower side portion of the short edge is. The stacking wheels 33, 43 are stacking wheels that rotate for stacking banknotes in an aligned state in the stacking spaces of the first banknote stacking unit 30 and the second banknote stacking unit 40.

The banknote handling apparatus 1 has the two banknote stacking units 30, 40 on the left and the right sides, and stacks banknotes in each of the banknote stacking units such that the banknotes are tilted in a standing state. Thus, the lateral width of the stacking space necessary for stacking the banknotes is reduced as compared to a case where the banknotes are stacked in a state where the banknote face is horizontally oriented.

On the front side of the left side surface of the lower unit 12, a cut portion 31 (cut-away portion 31) is formed by the left side surface being cut from the front surface side toward the rear surface side so as to be curved. Similarly, also on the front side of the right side surface of the lower unit 12, a cut portion 41 (cut-away portion 41) is formed by the right side surface being cut from the front surface side toward the rear surface side so as to be curved. Further, on the front surface of the lower unit 12, a recess 60 is formed between the left and the right banknote stacking units 30 and 40 so as to be recessed toward the rear surface side.

The front end of the left side wall which forms the stacking space of the first banknote stacking unit 30 is closer to the rear surface side than the cut portion 31 of the housing left side surface is, and the cut portion 31 and the front end of the left side wall of the stacking space are connected through an opening left side surface 35. Further, the front end of the right side wall which forms the stacking space of the first banknote stacking unit 30 is closer to the rear surface side than the recess 60 formed between the first banknote stacking unit 30 and the second banknote stacking unit 40 is, and is closer to the front surface side than the stacking wheel 33 is. The recess 60 and the front end of the right side wall of the stacking space are connected through an opening right side surface 32. Similarly, the front end of the right side wall which forms the stacking space of the second banknote stacking unit 40 and the cut portion 41 are connected through an opening right side surface 45. Further, the front end of the left side wall which forms the stacking space of the second banknote stacking unit 40 and the recess 60 are connected through an opening left side surface 42.

An operator who is on the front surface side is allowed to visually check, with ease, whether or not banknotes are stacked in the first banknote stacking unit 30 and the second banknote stacking unit 40, by the recess 60 and the left and the right opening side surfaces 32, 42 on the front surface of the lower unit 12. Further, in the first banknote stacking unit 30, by: the cut portion 31 on the housing left side surface, and the opening left side surface 35 connecting from the cut portion 31 to the left side wall of the stacking space; and the opening right side surface 32 connecting from the right side wall of the stacking space to the recess 60, the banknotes stacked so as to be tilted along the left side wall of the stacking space in a standing state can be easily held from the left and the right sides and taken out. Similarly, also in the second banknote stacking unit 40, by: the cut portion 41 on the housing right side surface, and the opening right side surface 45 connecting from the cut portion 41 to the right side wall of the stacking space; and the opening left side surface 42 connecting from the left side wall of the stacking space to the recess 60, the banknotes stacked so as to be tilted along the right side wall of the stacking space in a standing state, can be easily taken out.

In the first banknote stacking unit 30 and the second banknote stacking unit 40, the cut portions 31, 41 are formed on the side surfaces, and the bottom surfaces continuously extend to the housing front surface of the apparatus. Therefore, the banknotes can be stably stacked so as to be tilted in a standing state such that the long edge portions are along the bottom surface.

The opening right side surface 32 and the opening left side surface 35 formed at the opening of the first banknote stacking unit 30 are each formed as a curved surface that is tilted so as to reduce the opening area toward the stacking space. However, the tilted curved surfaces may be removed and the front ends of the left and right side walls of the stacking space may be exposed. Similarly, the opening left side surface 42 and the opening right side surface 45 formed at the opening of the second banknote stacking unit 40 are each formed as a curved surface that is tilted so as to reduce the opening area toward the stacking space. However, also for these, the front ends of the left and right side walls of the stacking space may be exposed.

Thus, in the banknote handling apparatus 1, the cut portions 31, 41 on the left and right side surfaces of the housing of the lower unit 12, the recess 60 formed between the first banknote stacking unit 30 and the second banknote stacking unit 40, the tilted opening side surfaces 32, 35 of the first banknote stacking unit 30, and the tilted opening side surfaces 42, 45 of the second banknote stacking unit 40, are formed. Thus, whether or not banknotes are stacked in the stacking space of each of the first banknote stacking unit 30 and the second banknote stacking unit 40, can be easily checked from the apparatus right side. Further, similarly, whether or not banknotes are stacked in the first banknote stacking unit 30 and the second banknote stacking unit 40, can be easily checked also from the apparatus left side.

For example, at a counter of a teller window of a bank, the banknote handling apparatus 1 is installed such that the apparatus right side surface that includes the hopper 20 and the reject unit 50 faces toward a customer outside the teller window. A teller operates the banknote handling apparatus 1 from the apparatus front surface side. At this time, the customer can see a state where banknotes delivered to the teller are placed in the hopper 20 and fed one by one into the apparatus, or a state where rejected notes are discharged into the reject unit 50. Further, in a case where the lower unit 12 has the cut portions 31, 41, the recess 60, and the opening side surfaces 32, 35, 42, 45, a customer who is on the right side of the apparatus so as to oppose a teller, can see a state where banknotes are stacked in the first banknote stacking unit 30 and the second banknote stacking unit 40. Thus, the banknote handling apparatus 1 is disposed so as to allow a customer to easily see the hopper 20, the first banknote stacking unit 30, the second banknote stacking unit 40, and the reject unit 50, and a teller handles, in front of the customer, the banknotes received from the customer, thereby avoiding doubt about an operation, by the teller, for handling the banknotes and banknote handling by the banknote handling apparatus 1.

[Position at which Ports and the Like are Arranged]

Figure 2:
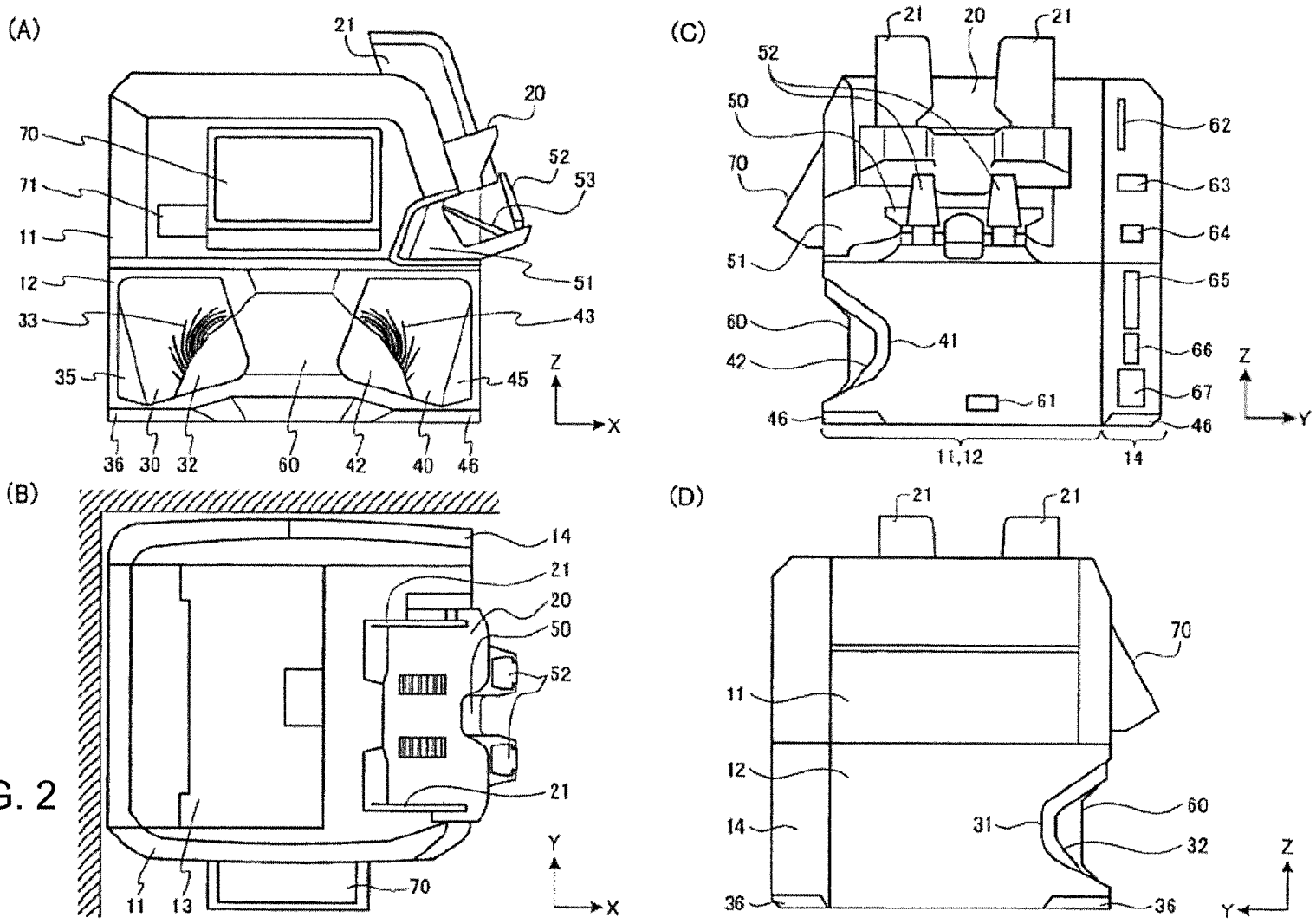
FIG. 2 is a plan view of an external appearance of the banknote handling apparatus.

FIG. 2 is a plan view of an external appearance of the banknote handling apparatus 1. FIG. 2(A) illustrates the front surface of the banknote handling apparatus 1, FIG. 2(B) illustrates the upper surface thereof, FIG. 2(C) illustrates the right side surface thereof, and FIG. 2(D) illustrates the left side surface thereof. FIG. 2(B) illustrates an exemplary case where the banknote handling apparatus 1 is installed at a place where two side surfaces thereof face wall surfaces such that the rear surface and the left side surface face the wall surfaces. The cross sections of the wall surfaces as viewed from above the upper surface are indicated by diagonal lines.

The banknote handling apparatus 1 has a characteristic that a slot into which a memory card that is a portable storage medium is inserted, ports for connection of a USB cable and a LAN cable, an inlet for connection of a power supply cable, and the like, are disposed collectively on the rear side of the right side surface on which the hopper 20 and the reject unit 50 are disposed, whereby the banknote handling apparatus 1 can be installed without a gap between: the apparatus left side surface and the apparatus rear surface; and the wall surfaces, as shown in FIG. 2(B).

As shown in FIG. 2(C), the upper unit 11 and the lower unit 12 are disposed on the apparatus front side, and a rear unit 14 in which upper and lower portions are integrated with each other is disposed on the rear side. That is, the housing of the banknote handling apparatus 1 includes three units which are the upper unit 11 on the front side, the lower unit 12 on the front side, and the rear unit 14 on the rear side.

In the banknote handling apparatus 1, as shown in FIG. 2(C), a memory card slot 62, a USB port 63, a LAN port 64, a dedicated port 65 for connection of a dedicated external device such as a printer, a main power supply switch 66, and a power supply inlet 67 are provided on the right side surface of the rear unit 14 so as to be aligned in line in the vertical direction. That is, the ports and the like are disposed collectively in a vertically elongated partial region on the rear side of the housing right side surface.

The power supply inlet 67 to which a power supply cable is connected when the banknote handling apparatus 1 is used, is disposed at the lowermost position. Further, above the power supply inlet 67, the LAN port 64 to which a LAN cable may be connected, and the dedicated port 65 to which a cable for connection of an external device may be connected, are disposed. Further, above the ports 64, 65, the USB port 63 to which a USB cable may be connected is disposed. The memory card slot 62 to which a cable or the like is not connected, is disposed at the uppermost position. Thus, the more likely a port is to be a port to which a cable or the like is connected, the lower a position at which the port is disposed. Thus, connection of a cable or the like to each port, and insertion of a portable storage medium such as a memory card or a USB memory, can be facilitated.

The memory card slot 62 allows insertion thereinto of a memory card in which, for example, new template data for banknote recognition, or new firmware for updating a function of the banknote handling apparatus 1, is stored, and is used for updating the template data for recognition, the firmware, or the like. Further, in a memory card inserted into the memory card slot 62, data for handling of banknotes, or log data for, for example, recording of operation of each component in the banknote handling apparatus 1, can be stored. Further, the USB port 63 can be used for, for example, updating template data for recognition, updating firmware, or recording log data by using a USB memory. Further, the USB port 63 is used for connection of a USB cable when a device capable of performing data communication using the USB cable is connected.

The LAN port 64 is used for connecting the banknote handling apparatus 1 to a network via a LAN cable. By the banknote handling apparatus 1 being connected to a network, data communication with an external device such as a higher-ranking terminal or a management server can be performed, or the banknote handling apparatus 1 can be controlled from an external device. Further, for example, updating of template data for recognition for the banknote handling apparatus 1, updating of firmware therefor, or collecting log data therefor, can be performed via a network from another device such as a higher-ranking terminal.

The dedicated port 65 is an interface for connection of a dedicated device such as a printer or a display device. The power supply inlet 67 is a port for connection of a power supply cable for supplying power to the banknote handling apparatus 1. The main power supply switch 66 is a switch for controlling ON and OFF of power supplied through the power supply cable. As shown in FIG. 2(C), an auxiliary power supply switch 61 is provided on the right side surface of the lower unit 12 of the banknote handling apparatus 1, and both the main power supply switch 66 and the auxiliary power supply switch 61 are made ON, whereby the banknote handling apparatus 1 is actuated. In a state where the main power supply switch 66 is OFF, even if the auxiliary power supply switch 61 is ON, the banknote handling apparatus 1 cannot perform banknote handling. In a state where the main power supply switch 66 is ON and the auxiliary power supply switch 61 is OFF, the apparatus is in a standby state.

On the right side surface, of the banknote handling apparatus 1, on which the hopper 20 and the reject unit 50 are disposed, banknotes need to be placed in the hopper 20, and banknotes need to be taken out from the reject unit 50. Therefore, in general, the banknote handling apparatus 1 cannot be installed so as to bring the right side surface into close contact with a wall surface. Similarly, on the front surface in which the opening of each of the first banknote stacking unit 30 and the second banknote stacking unit 40 is formed, banknotes stacked thereinside need to be taken out. Therefore, in general, the banknote handling apparatus 1 cannot be installed so as to bring the front surface into close contact with a wall surface. In the banknote handling apparatus 1, the ports and the like are disposed on a surface, of the housing, which cannot be usually positioned so as to face a wall surface.

Specifically, all of the memory card slot 62, the USB port 63, the LAN port 64, the dedicated port 65 for connection of an external device, the main power supply switch 66, and the power supply inlet 67 are disposed collectively on the right side surface which cannot be positioned so as to oppose a wall surface since a state of handling of banknotes is shown to a customer when the banknotes are handled. Thus, the left side surface and the rear surface on which ports and the like are not disposed, can be disposed so as to nearly contact with wall surfaces as shown in FIG. 2(B), whereby an unnecessary space may not be formed between the wall surface and the apparatus when the apparatus is installed. Further, also in a case where the banknote handling apparatus 1 is installed as shown in FIG. 2(B), the right side surface on which the ports and the like are disposed, is open, whereby the ports and the like can be used without moving the banknote handling apparatus 1.

Figure 3:
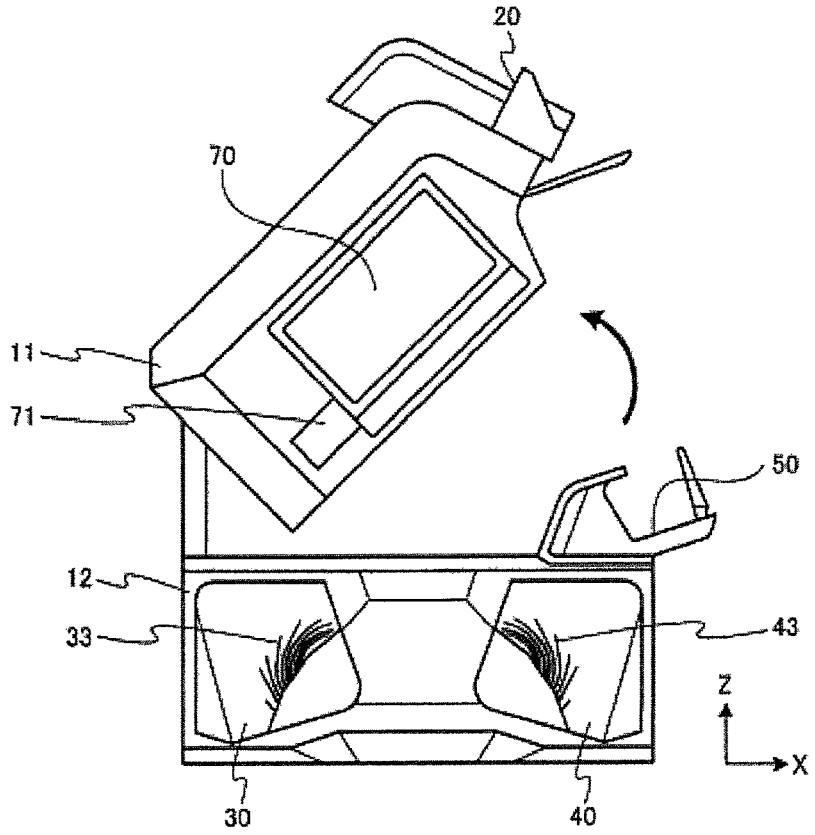
FIG. 3 illustrates an opening and closing operation of an upper unit and a rear unit.
Figure 3:
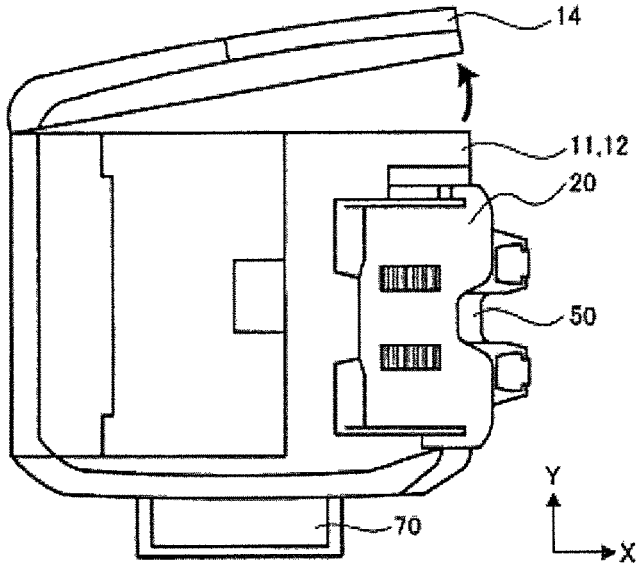

FIG. 3 illustrates a state where the upper unit 11, the lower unit 12, and the rear unit 14 are opened and closed. The engagement member is disposed between the upper unit 11 and the lower unit 12, and the upper unit 11 and the lower unit 12 are usually fixed by the engagement member. In the banknote handling apparatus 1, the engagement member is unlocked, whereby, as shown in FIG. 3(A), the right side portion of the upper unit 11 can be opened upward relative to the lower unit 12. Further, the right side portion, of the rear unit 14, in which the ports and the like are collectively disposed as shown in FIG. 2(C), can be opened rearward relative to the upper unit 11 and the lower unit 12, as shown in FIG. 3(B).

By the upper unit 11 being opened upward, for example, in a case where a banknote is jammed in the transport path in the apparatus, during handling of banknotes, due to occurrence of an error such as jamming of a banknote (jamming), the jammed banknote can be removed from the transport path, or inspection or repair of each component of the apparatus can be performed.

In the rear unit 14, a substrate to which the memory card slot 62, the USB port 63, the LAN port 64, the dedicated port 65 for an external device, the main power supply switch 66, the power supply inlet 67, and the like are connected, a power supply unit, and the like are accommodated. Further, substrates for, for example, controlling the recognition unit that performs recognition of denominations of banknotes and the like in the banknote handling apparatus 1, controlling transporting of banknotes in the transport path are also accommodated in the rear unit 14. For example, in a case where the banknote handling apparatus 1 installed as shown in FIG. 2(B) is out of order, the banknote handling apparatus 1 is moved forward, and the rear unit 14 is opened rearward, whereby, for example, a motor for driving rollers in the transport paths in the upper unit 11 and the lower unit 12 can be inspected.

[Structure of Reject Unit]

Figure 4:
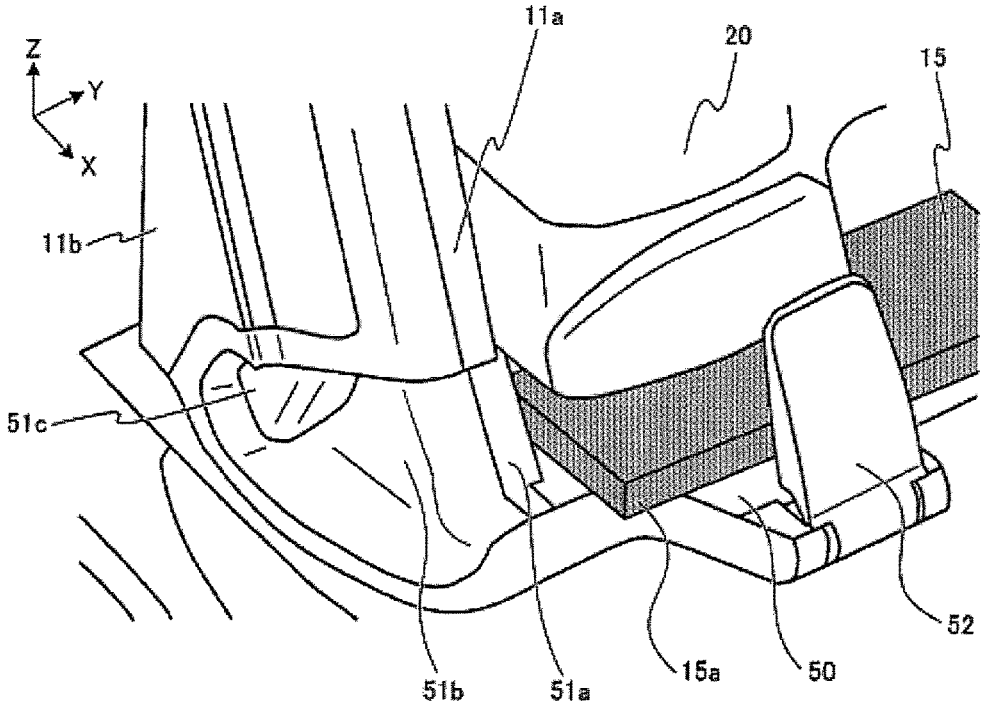
FIG. 4 illustrates a structure of a reject unit.
Figure 4:
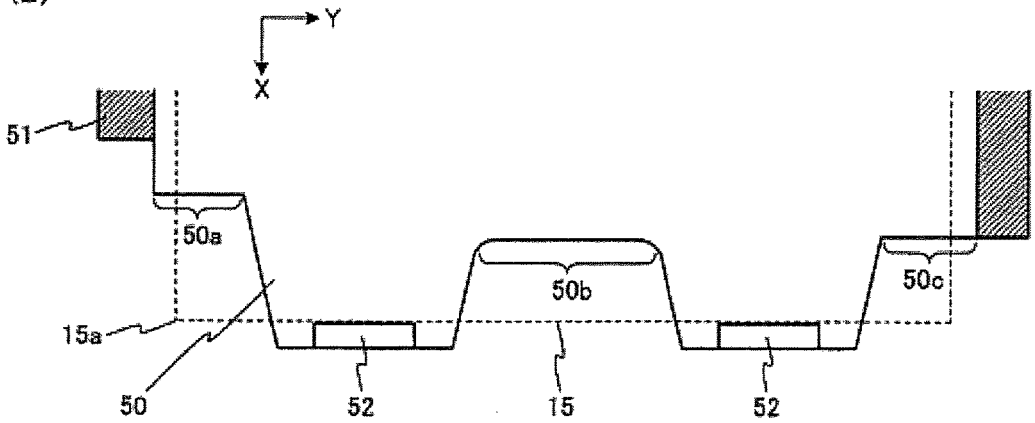

FIG. 4 illustrates structures of the reject unit 50, and the housing recess 51 formed on the apparatus front surface side of the reject unit 50. FIG. 4(A) is a perspective view of an external appearance of the reject unit 50, and FIG. 4(B) is a plan view of the reject unit 50 as viewed from thereabove. The banknote handling apparatus 1 has a characteristic that the right side portion of a side wall 11*a* on the front surface side of the reject unit 50 is cut, and the recess 51 is formed on the housing front surface so as to connect with the stacking space of the reject unit 50 via a cut portion 51*a* (cut-away portion 51*a*). The recess 51 is recessed from a front surface 11*b* of the upper unit 11 toward the rear surface side, and the recess 51 and the stacking space of the reject unit 50 are connected with each other via the cut portion 51*a*, of the side wall 11*a*, formed so as to be continuous with a front surface 51*b* of the recess 51.

By such a structure, rejected notes can be easily taken out also from the apparatus front surface side. As shown in FIG. 4(A), a corner portion 15*a*, on the right side of the short edge, of rejected notes 15 stacked in the reject unit 50 protrudes from the stacking surface of the reject unit 50 in the front-right direction. The rejected notes 15 can be taken out by nipping and holding the corner portion 15*a* from the upper and the lower sides.

A lever 51*c* for opening the upper unit 11 is disposed in the recess 51. By gripping the lever 51*c* so as to lift the lever 51*c* upward, the engagement between the upper unit 11 and the lower unit 12 by the engagement member is disengaged. By further lifting the lever 51*c* upward, the upper unit 11 having been disengaged, is lifted upward, whereby opening can be performed as shown in FIG. 3(A).

As shown in FIG. 4(B), in the stacking space of the reject unit 50, the rejected notes 15 are stacked as indicated by dashed lines. On the stacking surface on which the rejected notes 15 are stacked, a stacking surface 50*b* between the two stopper members 52 is positioned so as to be cut in the leftward direction (the X-axis negative direction) of the apparatus, and the rejected notes 15 can be taken out by nipping and holding the rejected notes 15 from the upper side and the lower side in the cut portion.

A rear surface side stacking surface 50*c* of the reject unit 50 is positioned so as to be cut up to the same position as the stacking surface 50*b* between the stopper members 52 in the leftward direction (the X-axis negative direction) of the apparatus. Meanwhile, a front surface side stacking surface 50*a* of the reject unit 50 is positioned so as to be cut more deeply, in the leftward direction of the apparatus, than the stacking surface 50*b* between the stopper members 52, and the rear surface side stacking surface 50*c*. Further, the cut portion 51*a* of the side wall of the reject unit 50 on the apparatus front surface side is retracted, in the leftward direction of the apparatus, more greatly than the front surface side stacking surface 50*a*. On the apparatus front surface side, the stacking surface 50*a* is positioned so as to be cut more deeply than the other stacking surfaces 50*b*, 50*c*, and the cut portion 51*a* of the side wall is positioned so as to be cut more deeply than the stacking surface 50*a*. That is, on the apparatus front surface side, two levels of the cut portions are formed by the front surface side stacking surface 50*a* and the cut portion 51*a* of the side wall.

[Operation Display Unit]

Figure 5:
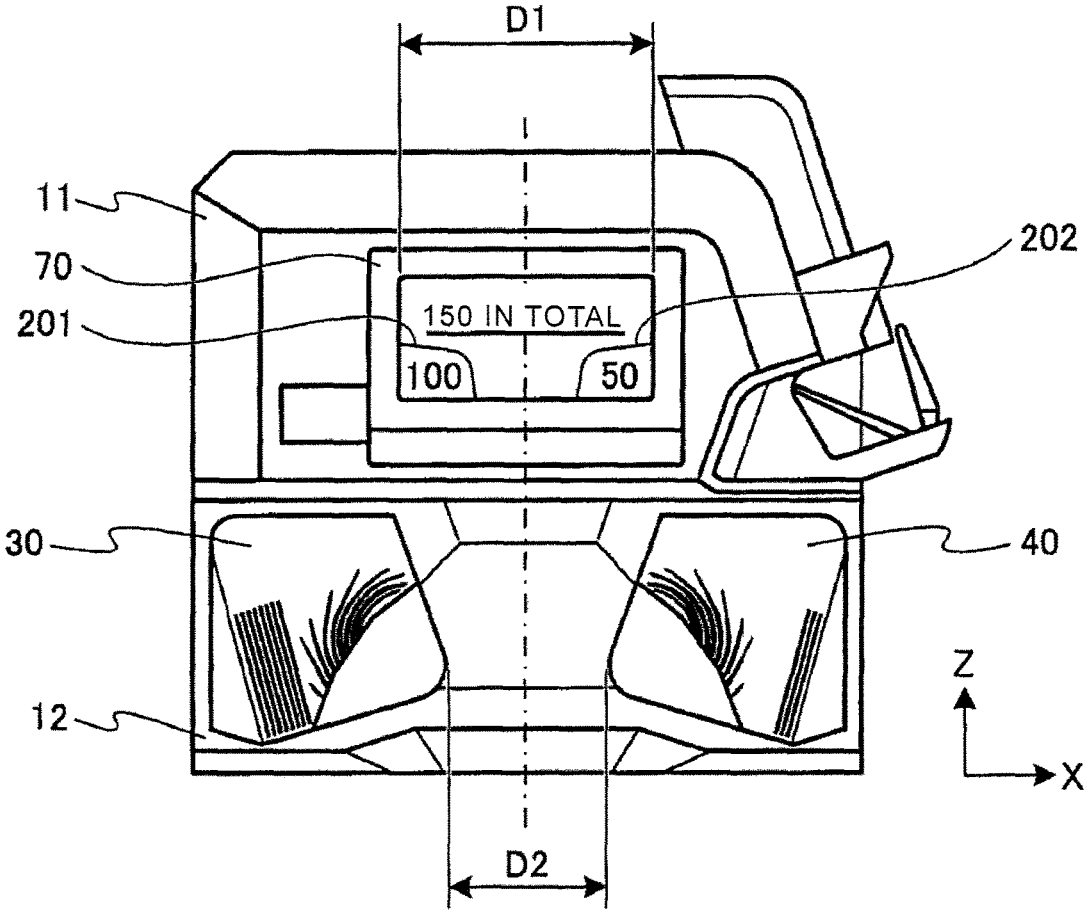
FIG. 5 illustrates a positional relationship between two banknote stacking units and an operation display unit on the apparatus front surface.

FIG. 5 illustrates a positional relationship between the two banknote stacking units 30, 40 and the operation display unit 70. The banknote handling apparatus 1 has a characteristic that the banknote handling apparatus 1 is a small apparatus but has a large operation display unit 70 capable of displaying multiple information, and information for each banknote stacking unit is displayed on the operation display unit 70 so as to allow the relationship between the displayed information and each banknote stacking unit to be easily recognized.

The operation display unit 70 is a touch panel type liquid crystal display device that has a 7-inch liquid crystal screen having a longitudinal dimension of 107 mm and a transverse dimension of 142 mm, displays information such as characters, still images, and moving images in color, and can receive input of information through a touch panel. The front surface of the banknote handling apparatus 1 that includes the upper unit 11 and the lower unit 12 has a longitudinal dimension of about 390 mm and a transverse dimension of about 350 mm. The size of the display screen of the operation display unit 70 corresponds to about 11% of the area of the apparatus front surface.

As shown in FIG. 5, the first banknote stacking unit 30 and the second banknote stacking unit 40 are disposed on both the left and the right outer sides, respectively, of the lower unit 12. The operation display unit 70 is disposed, in a portion that includes the center line of the banknote stacking unit, at almost the center in the left-right direction as viewed from the front surface side. Further, the banknote stacking units 30, 40 are disposed in the lower unit 12 and the operation display unit 70 is disposed in the upper unit 11, whereby the operation display unit 70 in which a display screen made of liquid crystal has a lateral width (D1) wider than a distance (D2) between the left and the right banknote stacking units 30 and 40.

The left end of the display screen of the operation display unit 70 is disposed, in the apparatus, outward (leftward) of the right end of the first banknote stacking unit 30, and the right end of the display screen thereof is disposed, in the apparatus, outward (rightward) of the left end of the second banknote stacking unit 40. Therefore, a first display region 201 dedicated for displaying information for the first banknote stacking unit 30 is disposed in the lower left portion of the display screen of the operation display unit 70, and a second display region 202 dedicated for displaying information for the second banknote stacking unit 40 is disposed in the lower right portion of the display screen thereof, whereby information corresponding to each banknote stacking unit can be easily recognized. For example, as shown in FIG. 5, the number of banknotes stacked in the first banknote stacking unit 30 is displayed in the first display region 201, and the number of banknotes stacked in the second banknote stacking unit 40 is displayed in the second display region 202, and the total number of the banknotes obtained as a sum of the numbers of banknotes is displayed at almost the center of the operation display unit 70. Thus, even if character information indicating whether the information displayed in each of the first display region 201 and the second display region 202 is for the banknote stacking unit 30 or the banknote stacking unit 40, is not displayed, an operator of the banknote handling apparatus 1 can easily recognize the relationship between the displayed information and the banknote stacking units 30, 40.

Thus, in a case where the display screen is divided into a plurality of divisional regions such that the upper side of the display screen of the operation display unit 70 corresponds to the upper surface of the banknote handling apparatus 1, the left and the right sides of the display screen correspond to the left and the right side surfaces of the banknote handling apparatus 1, the lower side of the display screen corresponds to the bottom surface of the banknote handling apparatus 1, and the display screen of the operation display unit 70 is regarded as the apparatus front surface, the information for the banknotes stacked in the first banknote stacking unit 30 is displayed in the first display region 201 formed in the lower left portion, of the screen, corresponding to a position at which the first banknote stacking unit 30 is disposed, and the information for the banknotes stacked in the second banknote stacking unit 40 is displayed in the second display region 202 formed in the lower right portion, of the screen, corresponding to the second banknote stacking unit 40. Thus, the information for the banknotes stacked in the first banknote stacking unit 30 is displayed, in the first display region 201 close to the first banknote stacking unit 30, on the display screen of the operation display unit 70, and the information for the banknotes stacked in the second banknote stacking unit 40 is displayed, in the second display region 202 close to the second banknote stacking unit 40, on the display screen.

When the information for the banknote handling apparatus 1 is displayed on the display screen of the operation display unit 70, the information is displayed such that the position of the displayed information corresponds to a position of the component, of the banknote handling apparatus 1, associated with the information, whereby an operator can easily recognize the relationship between the displayed information and the component of the banknote handling apparatus 1.

In FIG. 5, an exemplary case where the number of banknotes stacked in each banknote stacking unit is displayed on the display screen of the operation display unit 70, is illustrated. In addition thereto, for example, the kinds of banknotes such as denominations and fitness/unfitness, the total monetary amount of banknotes stacked in each banknote stacking unit, and information indicating the remaining number of banknotes by which a predetermined number of banknotes are reached can be displayed, by changing the setting for the displayed information. Further, for example, information for an operation to be performed for each banknote stacking unit, such as information of instruction for taking out banknotes from the banknote stacking unit, can be displayed. Further, for example, a plurality of kinds of information, such as both the denomination and the number of banknotes, can be displayed in each of the display regions 201 and 202. Further, the batch number of banknotes, or the number of times the batch has been obtained can be displayed on the screen when the batch process is performed, which will be described below in detail.

[Internal Structure of Apparatus]

Figure 6:
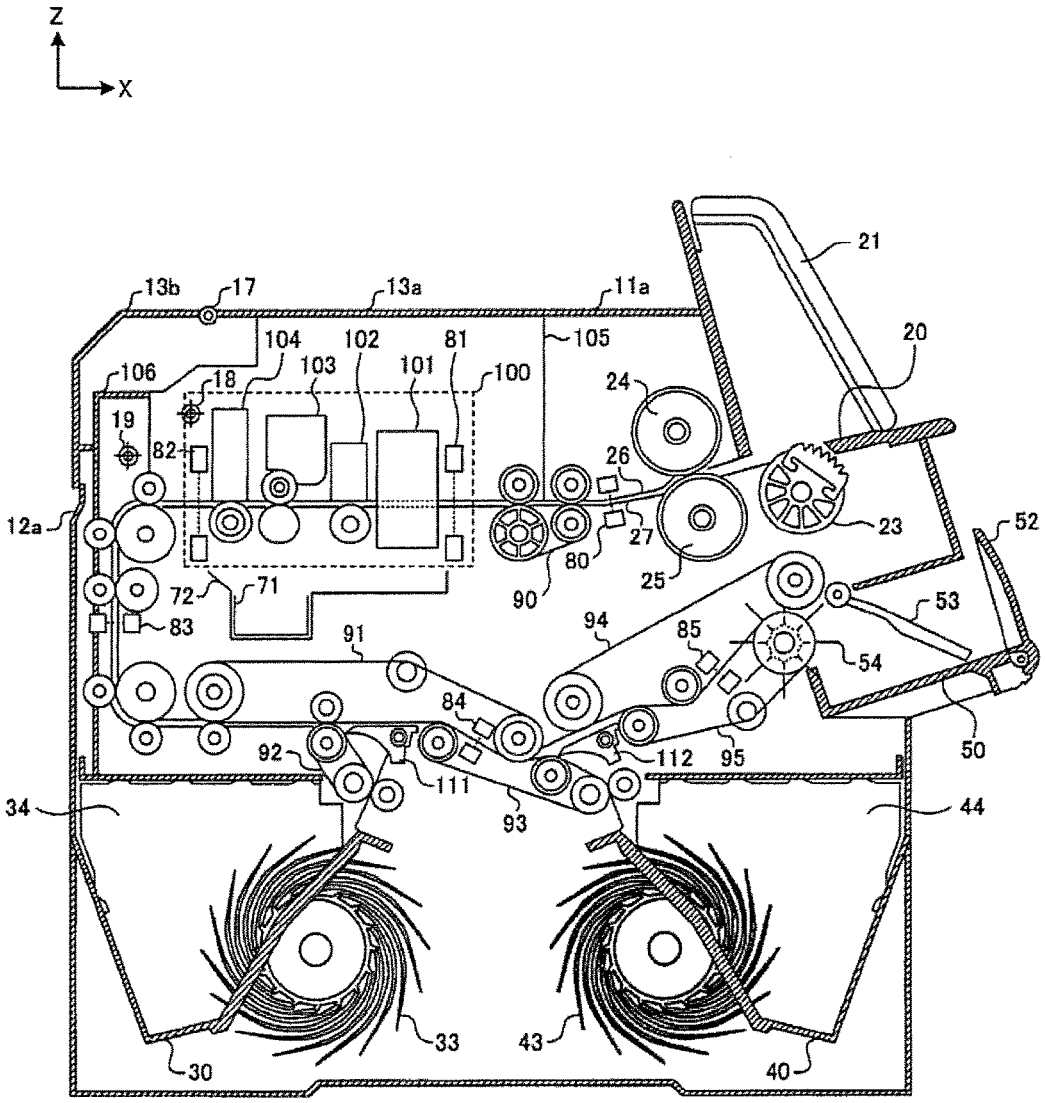
FIG. 6 is a schematic cross-sectional view illustrating a schematic internal structure of the banknote handling apparatus.

Next, an internal structure of the banknote handling apparatus 1 will be described. FIG. 6 is a schematic cross-sectional view illustrating a schematic internal structure of the banknote handling apparatus 1 as viewed from the front thereof. A banknote, located on the lowermost position, among a plurality of banknotes placed in a stacked state in the hopper 20 which is disposed in the upper right portion of the apparatus is fed into the apparatus by a kicker roller 23. The banknotes are separated one by one by a feed roller 25 and a reverse rotation roller 24 which oppose each other, and only the banknote located on the lowermost position is fed into the transport path. The banknote fed into the apparatus, is transported leftward in the transport path formed by an upper transport guide 26 and a lower transport guide 27. In the transport path, multiple rollers, and transport belts 90 to 95 wound around a plurality of rollers are exposed into the transport path from the transport guides 26, 27, and the banknotes are transported by the rollers or the transport belts 90 to 95.

In each of the transport belts 91 to 95, the upper transport belt and the lower transport belt wound around the rollers on both ends, are not parallel to each other, and the transport belt which forms the transport path is pushed upward or downward by the rollers. Thus, even when the rollers may not be disposed on the upper side and the lower side in the transport path so as to oppose each other, a gripping force between the transported banknote and the transport belt is assured, whereby transporting can be stably performed.

The transport path of the banknote handling apparatus 1 includes: an upper transport path that transports banknotes leftward (in the X-axis negative direction) in the upper unit 11; a lower transport path that transports banknotes rightward (in the X-axis positive direction) in the lower unit 12; and an the intermediate transport path that connects between the upper transport path and the lower transport path, and transports banknotes downward (in the Z-axis negative direction). The banknote which is fed from the hopper 20 and transported leftward in the upper transport path passes through the recognition unit 100, and the banknote is thereafter transported in a different direction so as to be transported downward in the intermediate transport path, and the banknotes is thereafter transported in a different direction again so as to be transported rightward in the lower transport path.

The recognition unit 100 disposed in the upper transport path includes: a line sensor 101 for obtaining an transmission image, an image obtained by the upper face of a banknote being reflected, and an image obtained by the back face of the banknote being reflected; a UV sensor 102 for detecting light emission excited by applying UV light (ultraviolet); a thickness detection sensor 103 for detecting the thickness of a banknote; and a magnetic detection sensor 104 for detecting magnetic characteristic of a banknote. Recognition of a denomination of the banknote, authentication of the banknote, recognition of fitness/unfitness of the banknote, recognition of the face/back of the banknote, recognition of an orientation of the banknote, and the like can be performed based on the banknote optical characteristic, the banknote magnetic characteristic, and the banknote thickness obtained by these sensors.

In the transport path, a plurality of banknote detection sensors 80 to 85 for detecting passage of the banknote are disposed. The banknote detection sensors 80 to 85 each include a light transmitter unit and a light receiver unit, and detect a banknote based on change between transmission of light and blocking of light due to passage of the banknote. In the upper transport path, the recognition unit 100 performs, when having recognized a banknote passing timing on the basis of the detection result by the banknote detection sensor 81, recognition of the banknote that passes therethrough.

In the lower transport path, a first diverter 111 is disposed at a first diverging point, and a second diverter 112 is disposed at a second diverging point located downstream of the first diverging point. At the first diverging point, the banknote is diverted by the first diverter 111 so as to be transported downstream in the lower transport path or be transported to the first banknote stacking unit 30. Similarly, at the second diverging point, the banknote is diverted by the second diverter 112 so as to be transported to the reject unit 50 or the second banknote stacking unit 40.

Specifically, the first diverter 111 is controlled on the basis of the recognition result by the recognition unit 100, and a banknote passing time detected by the banknote detection sensor 83 in the intermediate transport path. In a case where the banknote detected by the banknote detection sensor 83 is not a banknote to be stacked in the first banknote stacking unit 30, the first diverter 111 enters the state shown in FIG. 6 and the banknotes is not diverted so as to be transported to the first banknote stacking unit 30 and is transported rightward through the first diverging point. Meanwhile, in a case where the banknote is a banknote to be stacked in the first banknote stacking unit 30, the first diverter 111 rotates clockwise, and the banknote is diverted from the transport path, and then transported toward the first banknote stacking unit 30. Similarly, the second diverter 112 is controlled on the basis of the recognition result, and a banknote passing time detected by the banknote detection sensor 84 in the lower transport path. The banknote to be stacked in the second banknote stacking unit 40 is diverted from the transport path, and then transported toward the second banknote stacking unit 40. Meanwhile, in a case where the banknote is a rejected note, the banknote is not diverted so as to be transported toward the second banknote stacking unit 40, and the banknote is further transported rightward through the second diverging point into the reject unit 50. In the reject unit 50, although the rejected note transported at a high speed is vigorously discharged, the front end of the rejected note is received by the stopper members 52 and the rear end of the rejected note is pushed downward by an elastic fin wheel 54 which is rotating. Further, the rejected note is pressed downward by the holder member 53 and thus stacked into the reject unit 50. The elastic fin wheel 54 is a stacking wheel that rotates so as to stack banknotes in an aligned state in the stacking space of the reject unit 50.

A tilt transport path is formed so as to be tilted upward on the side downstream of the second diverter 112 such that the height at which the tilt transport path is positioned is increased toward the downstream side. The reject unit 50 is disposed below the tilt transport path so as to be embedded in the leftward direction, and the rejected note having been transported diagonally upward in the tilt transport path is discharged from the upper left side of the reject unit 50 into the stacking space of the reject unit 50. The reject unit 50 is disposed in the innermost possible portion in the apparatus by the transport path being tilted. As a result, the rotation shaft of the elastic fin wheel 54 is positioned inward (in the X-axis negative direction) of the rotation shaft of the kicker roller 23 of the hopper 20 in the horizontal direction (the X-axis direction) in the apparatus. In the banknote handling apparatus 1, in addition to the banknotes being stacked in the banknote stacking units 30, 40 so as to be tilted in a standing position, a part of the reject unit 50 is thus embedded in the apparatus, whereby the size of the banknote handling apparatus 1 can be reduced.

The banknote detection sensor 85 is disposed downward of the second diverter 112, and the banknote detection sensors 86 and 87 are disposed in a diverging transport path that diverges from the first diverter 111 toward the first banknote stacking unit 30, and a diverging transport path that diverges from the second diverter 112 toward the second banknote stacking unit 40, respectively, (see FIG. 11), and a banknote in the transport path can be detected. The banknote detection sensors 80 to 87 not only detects whether or not a transported banknote is present but also is used for detecting whether or not a banknote remains in the transport path when transporting of banknotes is stopped due to occurrence of an error.

Further, pushing members 34, 44 are disposed on the rear surface sides of the first banknote stacking unit 30 and the second banknote stacking unit 40, respectively. Handling of the banknotes placed in the hopper 20 is completed, and all the banknotes are each stacked in the first banknote stacking unit 30, the second banknote stacking unit 40, or the reject unit 50, and thereafter the pushing members 34, 44 move forward, whereby all the banknotes stacked in the stacking spaces are pushed toward the front surface opening, which will be described below in detail.

[Opening and Closing of Apparatus Upper Portion]

Next, opening and closing of the upper unit 11 of the banknote handling apparatus 1, and opening and closing of the recognition unit 100 of the upper unit 11 will described. A pivot 19 that acts as the rotation center when the upper unit 11 is opened upward as shown in FIG. 3(A), is disposed in a frame 106 fixed to the lower unit 12, as shown in FIG. 6. Further, a pivot 18 that acts as the rotation center when the recognition unit 100 of the upper unit 11 is opened upward in a state where the upper unit 11 is closed, is disposed in a frame fixed to the upper unit 11.

Further, the upper lid 13 of the housing is divided into a front lid 13*a* and a rear lid 13*b*. The rear lid 13*b* is supported by a pivot 17 disposed at the rear end of the front lid 13*a* so as to be pivotable upward about the pivot 17 clockwise.

Figure 7:
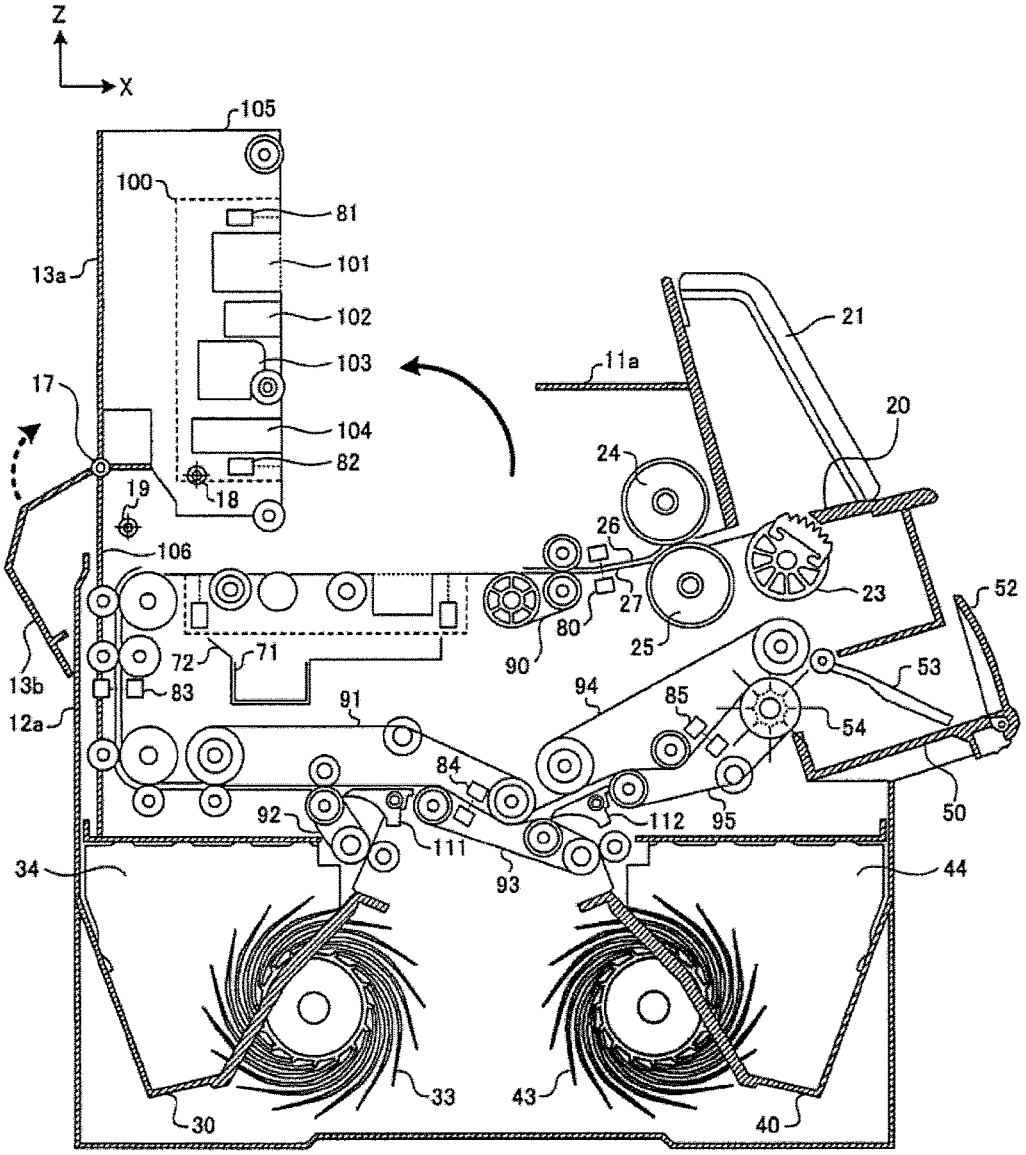
FIG. 7 is a schematic cross-sectional view illustrating an opening and closing operation of a recognition unit.

FIG. 7 is a schematic cross-sectional view illustrating a state where the recognition unit 100 is opened upward. The recognition unit 100 is separated into two portions that are a portion above the transport path and a portion below the transport path. A recognition upper unit 105 includes: a portion, of the recognition unit 100, above the transport path; and a part of rollers disposed on the upper side of the transport path on the upstream side and the downstream side of the recognition unit 100. The recognition upper unit 105 pivots about the pivot 18 and is opened upward. Thus, inspection or maintenance for each of the sensors 101 to 104 disposed in the recognition unit 100 can be performed, or a banknote or dust jammed in the upper transport path can be removed.

When the recognition upper unit 105 with the front lid 13*a* are opened upward as indicated by a solid line arrow in FIG. 7, the rear lid 13*b* pivots about the pivot 17 as indicated by a dashed line arrow. The rear lid 13*b* pivots while the lower rear end thereof is moved downward along a housing left side surface 12*a*. Thus, unlike in a case where the front lid 13*a* and the rear lid 13*b* are integrated with each other, pivoting of the recognition upper unit 105 is prevented from being restricted by the lower rear end of the rear lid 13*b* interfering with another member. Therefore, the recognition upper unit 105 can be widely opened upward.

Figure 8:
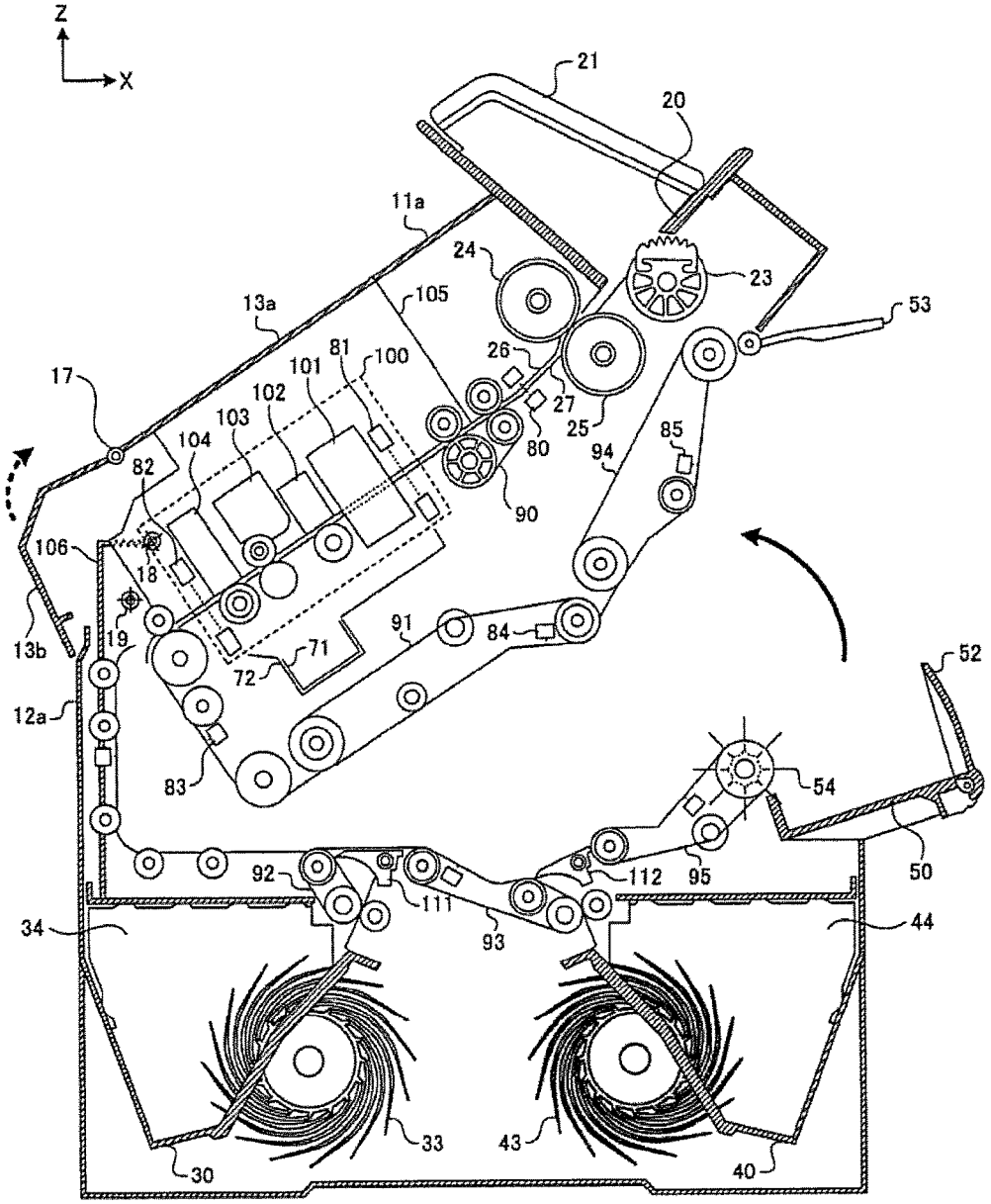
FIG. 8 is a schematic cross-sectional view illustrating an opening and closing operation of the upper unit.

FIG. 8 is a schematic cross-sectional view illustrating a state where the upper unit 11 is opened upward. When the upper unit 11 pivots about the pivot 19 and is opened upward as indicated by a solid line arrow shown in FIG. 8, the rear lid 13*b* pivots about the pivot 17 as indicated by a dashed line arrow. The rear lid 13*b* pivots while the lower rear end thereof is moved downward along the housing left side surface 12*a*, whereby pivoting of the upper unit 11 is prevented from being restricted by the upper lid 13 interfering with another member, whereby the upper unit 11 can be widely opened upward.

The upper transport path that includes the recognition unit 100 is included in the upper unit 11 that moves upward when the upper unit 11 is opened upward as shown in FIG. 8. Further, the intermediate transport path is divided into a right side portion of the transport path and a left side portion of the transport path, and the units in the right side portion are included in the upper unit 11, and the units in the left side portion are included in the lower unit 12. The lower transport path is divided into an upper portion of the transport path and a lower portion of the transport path, and the units in the upper portion are included in the upper unit 11 and the units in the lower portion are included in the lower unit 12. Thus, the intermediate transport path and the lower transport path are each divided into the upper unit 11 and the lower unit 12, whereby the upper unit 11 is opened to open the intermediate transport path and the lower transport path, and a banknote, dust, or the like jammed in the transport path can be removed.

The hopper 20 and the holder member 53 that holds banknotes in the reject unit 50 are included in the upper unit 11, and the main body portion of the reject unit 50 is included in the lower unit 12. In the banknote handling apparatus 1, the components are positioned such that the main body portion of the reject unit 50 is embedded into the innermost possible portion of the apparatus so as to prevent the reject unit 50 from greatly protruding outward of the apparatus right side surface, in order to reduce the size of the apparatus. However, when the upper unit 11 is opened as shown in FIG. 8, a banknote, dust, or the like jammed in the reject unit 50 or the lower transport path up to the rejected unit 50 can be easily removed.

In the lower unit 12, the length of the diverging transport path to the first banknote stacking unit 30 from the first diverging point at which a banknote is diverted from the lower transport path toward the first banknote stacking unit 30, is shorter than the length, in the transporting direction, of a banknote, that is, the length of the short edge of the banknote. Therefore, even in a case where a banknote that is diverted at the first diverging point is jammed while being transported to the first banknote stacking unit 30, the front end of the banknote is exposed into the stacking space of the first banknote stacking unit 30 or the rear end of the banknote is exposed into the lower transport path. Similarly, the length of the diverging transport path to the second banknote stacking unit 40 from the second diverging point at which a banknote is diverted from the lower transport path toward the second banknote stacking unit 40, is also shorter than the length of the short edge of the banknote. Even when transporting of a banknote is stopped at that position, the front end of the banknote in the stacking space of the second banknote stacking unit 40 or the rear end of the banknote in the lower transport path can be confirmed.

Thus, in the banknote handling apparatus 1, in a case where transporting of banknotes is stopped due to jamming of a banknote or the like, the recognition upper unit 105 and the upper unit 11 are opened upward as shown in FIG. 7 and FIG. 8, whereby, for example, a banknote in the upper transport path, the intermediate transport path, or the lower transport path, or a banknote that has passed through the first diverging point or the second diverging point and has then stopped, can be assuredly removed.

[Dust Receiver Unit]

As shown in FIG. 1, on the front surface of the upper unit 11, the push-to-open type dust tray 71 that is ejected from the front surface side by being pushed toward the rear surface side, is disposed. As shown in FIG. 6, the dust tray 71 slides in the front-rear direction in a groove formed in a dust receiver plate 72 fixed below the recognition unit 100. On the rear surface side of the dust tray 71, a push-to-open mechanism is provided. A dust receiver unit is formed by the dust tray 71 and the dust receiver plate 72.

In the thickness detection sensor 103 of the recognition unit 100, a reference roller which is disposed on the lower side of the transport path and supported on a fixed shaft so as to be rotatable, and a detection roller which is supported so as to be movable in the up-down direction and rotatable on the upper side of the transport path, are brought into close contact with each other to form a roller pair. The thickness of a banknote is detected on the basis of movement of the detection roller that moves in the up-down direction when the banknote passes between the rollers of the roller pair. Multiple roller pairs each of which includes the reference roller and the detection roller are disposed in the direction (the Y-axis direction) perpendicular to the transporting direction, and dust adhered to a banknote is easily removed and falls down while the banknote passes through a plurality of the roller pairs in each of which rollers closely contact with each other. Further, paper powder may be removed and fall from a banknote itself. In the magnetic detection sensor 104, a banknote is brought into close contact with the magnetic detection sensor disposed on the upper side of the transport path, by a flocked roller disposed on the lower side of the transport path, and dust or paper powder is likely to occur in this portion. Therefore, the dust tray 71 is disposed below the thickness detection sensor 103 and the magnetic detection sensor 104, to receive paper powder or dust by the dust tray 71.

Figure 9:
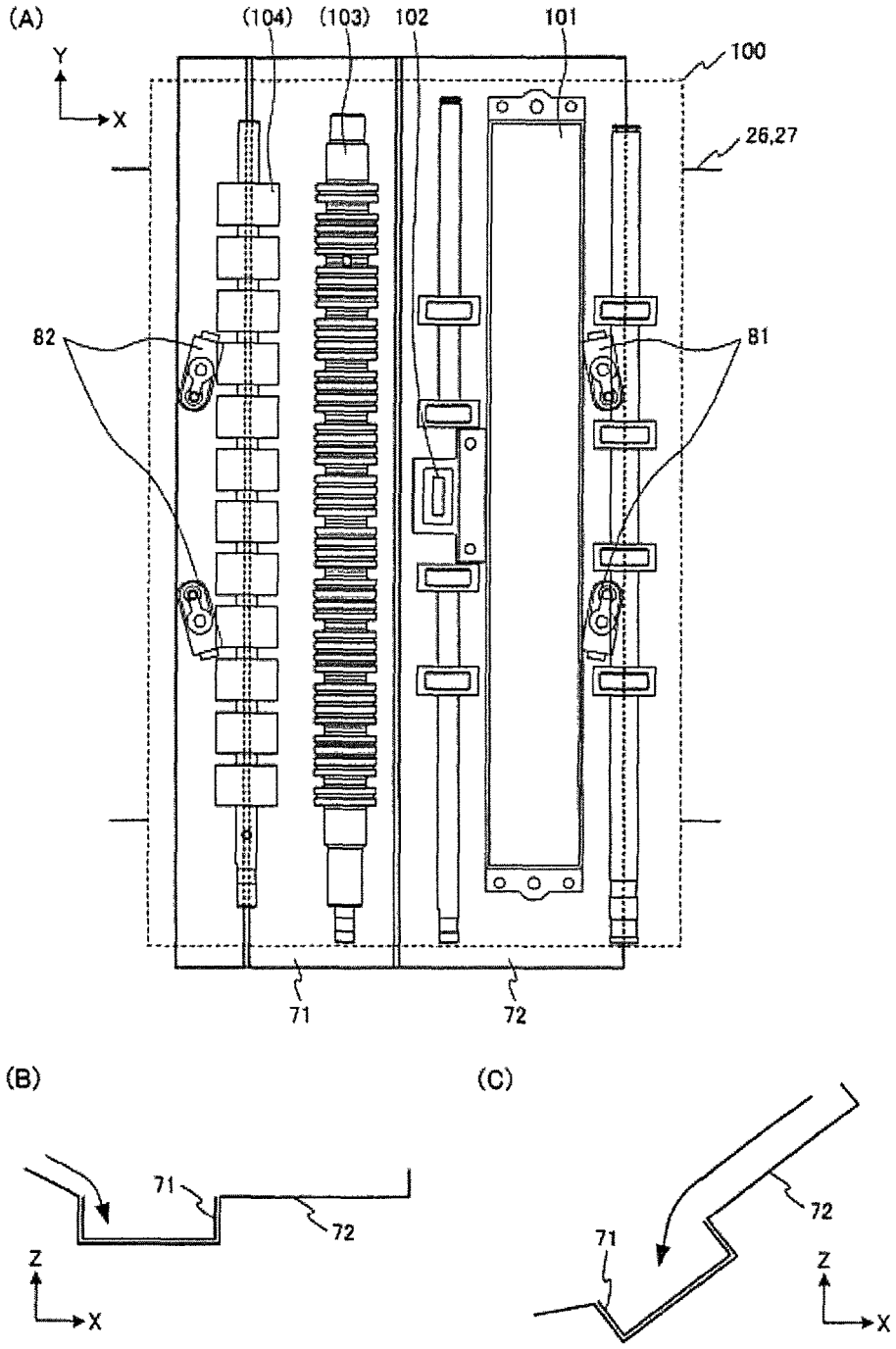
FIG. 9 illustrates a structure of a dust receiver unit.

FIG. 9 is a schematic diagram illustrating the shapes of the dust tray 71 and the dust receiver plate 72. FIG. 9(A) illustrates the dust tray 71 and the dust receiver plate 72 as viewed from thereabove. FIG. 9(B) illustrates the dust tray 71 and the dust receiver plate 72 as viewed from the front thereof. Further, FIG. 9(C) illustrates the dust tray 71 and the dust receiver plate 72 as viewed from the front thereof when the upper unit 11 is opened as shown in FIG. 8. FIG. 9(A) illustrates a portion of the recognition unit 100 below the transport path. Therefore, the reference roller is shown at the position of the thickness detection sensor 103, and the flocked roller is shown at the position of the magnetic sensor 104.

As shown in FIG. 9(A), the length of each of the dust tray 71 and the dust receiver plate 72 in the apparatus front-rear direction (the Y-axis direction) is greater than the width (the length in the Y-axis direction) of the transport path formed by the transport guides 26, 27, and is longer than the recognition unit 100.

As shown in FIG. 9(B), in a portion leftward of the dust tray 71, the shape of the dust receiver plate 72 as viewed from the front thereof, is tilted downward toward the dust tray 71 from the left end positioned below the magnetic detection sensor 104. Thus, as indicated by an arrow in FIG. 9(B), paper powder or dust received at the tilted portion slides into the dust tray 71.

Further, the shape of the dust receiver plate 72 is horizontal in a portion rightward of the dust tray 71. However, when the right side surface of the upper unit 11 is opened upward as shown in FIG. 8, the dust receiver unit that includes the dust tray 71 and the dust receiver plate 72 is tilted together with the upper unit 11 such that the right side portion is raised upward as shown in FIG. 9(C). Therefore, as indicated by an arrow in FIG. 9(C), paper powder or dust stored in the horizontal portion on the right side of the dust receiver plate 72 slides downward, to be collected into the dust tray 71.

Thus, when the dust tray 71 into which paper powder or dust is collected, is pushed toward the rear surface side, a part of the dust tray 71 is ejected toward the front surface side by the push-to-open mechanism disposed on the rear surface side. The dust tray 71, a part of which is ejected from the housing front surface, is removed from the apparatus, whereby the paper powder or dust collected into the dust tray 71 can be discarded.

The structure of the dust receiver unit is not limited to a structure in which the dust receiver plate 72 is shaped such that a groove portion that allows the dust tray 71 to slide and a plate portion on which dust is collected, are integrated with each other. The dust tray 71 that slides and a plate portion on which dust is collected may be separately provided, and the plate portion on which dust is collected may be provided as the dust receiver plate 72. Further, the dust receiver plate 72 may be formed as a single plate or a plurality of plates. Further, tilted plates that allow dust to be slid downward into the dust tray 71 may be disposed, as the dust receiver plate 72, on the right side, the rear surface side, or the like as well as in a portion leftward of the dust tray 71. At least one of the dust tray 71 and the dust receiver plate 72 is disposed below the thickness detection sensor 103 and the magnetic detection sensor 104 of the recognition unit 100, regardless of the structure of the dust receiver unit.

[Structure of Banknote Stacking Unit]

Figure 10:
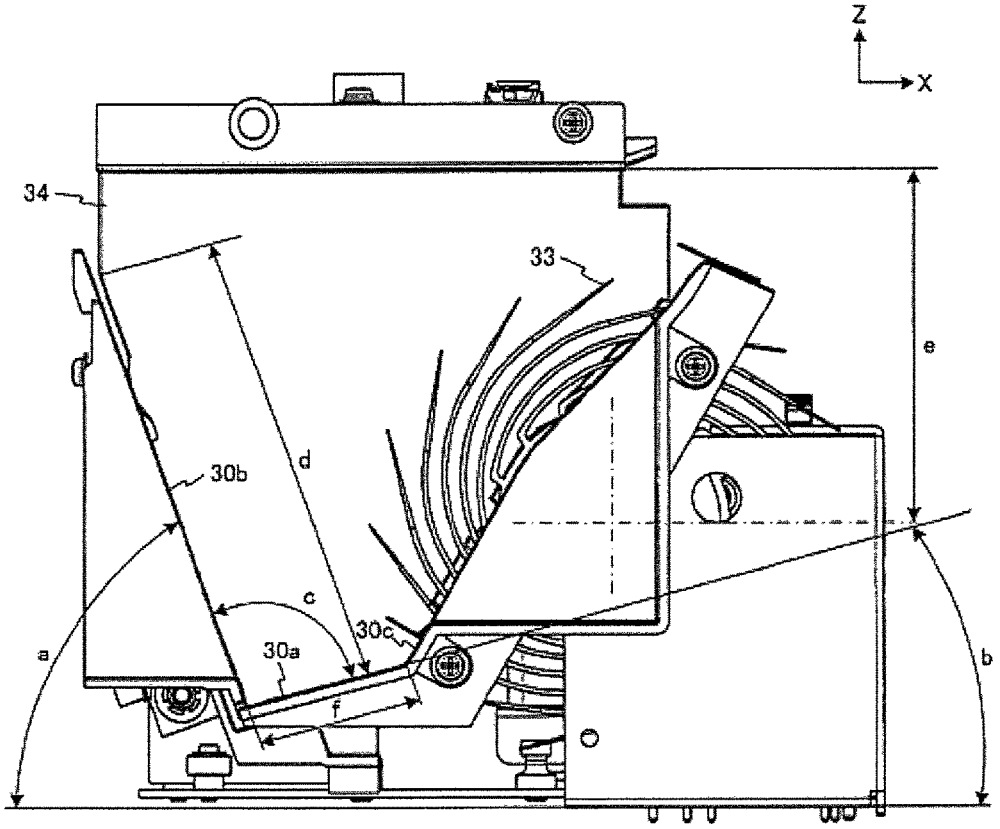
FIG. 10 illustrates a structure of the banknote stacking unit.

FIG. 10 illustrates a structure of the first banknote stacking unit 30. The second banknote stacking unit 40 has the same structure as the first banknote stacking unit 30, and, when the first banknote stacking unit 30 shown in FIG. 10 is laterally mirrored, the structure of the second banknote stacking unit 40 is obtained. Therefore, the description of the second banknote stacking unit 40 is not given. Thus, the first banknote stacking unit 30 will be described.

The stacking space of the first banknote stacking unit 30 is formed by a plurality of members such as the side wall members. In FIG. 10, the bottom surface and the left and right side walls are indicated as a part of the first banknote stacking unit 30 by reference characters 30*a*, 30*b*, 30*c*, respectively. On the front end of the left side wall 30*b*, a triangular surface parallel to the XZ-plane is formed, and, also on the front end of the right side wall 30*c*, an almost triangular surface parallel to the XZ-plane is formed. The bottom side of the front end flat surface portion of the left side wall 30*b* and the bottom side of the front end flat surface portion of the right side wall 30*c* are different from each other in height. The left side wall 30*b* and the right side wall 30*c* are retracted toward the rear surface side as compared to the bottom surface 30*a*. On the surface (see reference character 130*a* in FIG. 15) that protrudes forward from the bottom side of the triangular flat surface of the left side wall 30*b* so as to be parallel to the XY-plane, the opening left side surface 35 shown in FIG. 1 is formed. On the surface (see 131*a* in FIG. 15) that protrudes forward from the bottom side of the almost triangular flat surface of the right side wall 30*c* so as to be parallel to the XY-plane, the opening right side surface 32 shown in FIG. 1 is formed. Specifically, the opening left side surface 35 shown FIG. 1 is formed so as to connect between the left side wall 30*b* and the cut portion 31 of the housing left side surface such that the opening left side surface 35 covers the triangular flat surface portion positioned at the front end of the left side wall 30*b*. The opening right side surface 32 shown in FIG. 1 is formed so as to connect between the right side wall 30*c* and the recess 60 such that the opening right side surface 32 covers the almost triangular flat surface portion positioned at the front end of the right side wall 30*c*.

A banknote that is diverted from the lower transport unit by the first diverter 111, is transported in the diverging transport path, and discharged from the upper right portion into the stacking space in the first banknote stacking unit 30. The banknote discharged into the banknote stacking unit is transported leftward by the stacking wheel 33 that rotates counterclockwise, and stacked such that the banknote face is along the tilted side wall 30*b*, and the long edge portion of the banknote contacts with the bottom surface 30*a*.

An angle a between the horizontal plane and the side wall 30*b* as shown in FIG. 10 is 70 degrees. An angle b between the horizontal plane and the bottom surface 30*a* is 15 degrees. An angle c between the bottom surface 30*a* and the side wall 30*b* is 95 degrees. Reduction of the angle a causes increase of the size, in the lateral direction (the X-axis direction), of the banknote stacking unit, thereby increasing the size of the banknote handling apparatus 1. Further, when the angle a is increased, the banknotes that are tilted in a standing state are not stabilized, and the stacked banknotes are tilted toward the stacking wheel 33, and interfere with a banknote that enters the banknote stacking unit anew, whereby the banknotes are not normally stacked. Therefore, the angle a is preferably greater than or equal to 60 degrees and not greater than 80 degrees.

For example, a banknote which is stacked for the first time in a state where no banknotes are stacked, is stacked in many cases such that the long edge portion on the upper side contacts with the side wall 30*b*, and the long edge portion on the lower side contacts with the bottom surface 30*a* at a position distant from the side wall 30*b*. Thereafter, while the subsequent banknotes are sequentially stacked, the long edge portion, on the lower side of the banknote, which contacts with the bottom surface 30*a* is pushed and moved toward the side wall 30*b*, and the banknote face of the banknote which has been stacked for the first time is along the side wall 30*b*. The subsequent banknotes are similarly moved and stacked on the banknote which has been stacked for the first time. The angle b formed by the bottom surface 30*a* is preferably greater than 0 degrees such that the banknote is easily moved on the bottom surface 30*a* toward the side wall 30*b* by the long edge portion on the lower side of the banknote which has been previously stacked being pushed by subsequent banknotes. Meanwhile, in a case where the angle b is excessively increased, the angle a needs to be reduced according to the increase. Thus, the size, in the lateral direction, of the banknote stacking unit is increased to increase the size of the apparatus. Therefore, the angle b is preferably greater than 0 degrees, and preferably less than or equal to 30 degrees.

According to the ranges of the angle a and the angle b being set as described above, the angle c between the bottom surface 30*a* and the side wall 30*b* is preferably greater than 70 degrees and less than 120 degrees. Further, length d of the side wall 30*b* is set according to the largest banknote, among the banknotes to be handled, having the largest short edge length. For example, in a case where the short edge length of the largest banknote is 85 mm, the length d of the side wall 30*b* is set as 93 mm.

Heighte from the center of the rotation shaft of the stacking wheel 33 to the top of the stacking space is set according to the largest banknote, among banknotes to be handled, which has the largest short edge length. In a case where a banknote that enters the stacking space from the upper right portion hits against the top portion that forms the stacking space while the banknote is transported leftward by the stacking wheel 33 which rotates counterclockwise, the banknotes cannot be stacked so as to be aligned, and the banknotes cannot be normally stacked. Therefore, the height e is set such that, while the stacking wheel 33 rotates in a state where the largest banknote is inserted between blades of the stacking wheel 33 and one of the long edge portions of the largest banknote contacts with the root portions of the blades, the trajectory of the other of the long edge portions of the largest banknote is formed in a portion lower than the top of the stacking space.

In the banknote handling apparatus 1, 16 blades are provided at 30 degree intervals on the outer circumferential surface of a base body portion which is disposed around the rotation shaft positioned at the center and which has the outer diameter of 50 mm, and the front end of each blade extends in the direction opposite to the direction in which the stacking wheel 33 rotates, and the stacking wheel 33 having the outer diameter of 100 mm is formed. The central angle from the root portion of each blade to the front end of the blade is 60 degrees as viewed from the center of the stacking wheel 33. In the banknote handling apparatus 1, the height e is set as 71.5 mm so as to stack the largest banknotes having the short edge length of 85 mm by the stacking wheel 33 such that the banknotes are prevented from being not normally stacked.

A length f of the bottom surface 30*a* is set according to the number of banknotes stacked in the banknote stacking unit. A dog earred note or a wrinkled note is included in banknotes to be handled. Therefore, the length f is set in consideration thereof. In the banknote handling apparatus 1, the length f is set as 33 mm in order to stack 200 banknotes.

[Structure of Banknote Transport Path]

Figure 11:
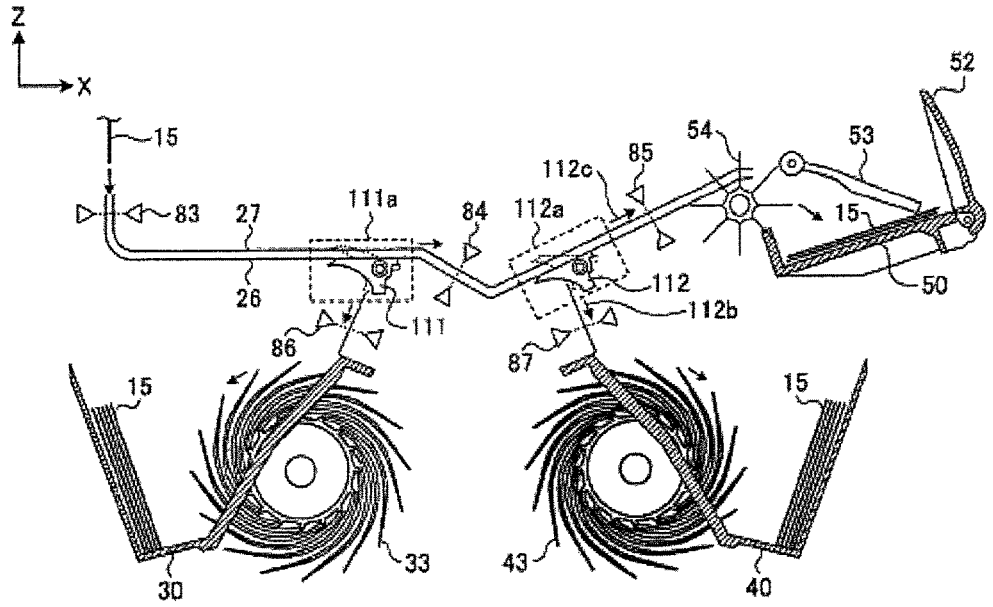
FIG. 11 is a schematic diagram illustrating a structure of a transport path.
Figure 11:
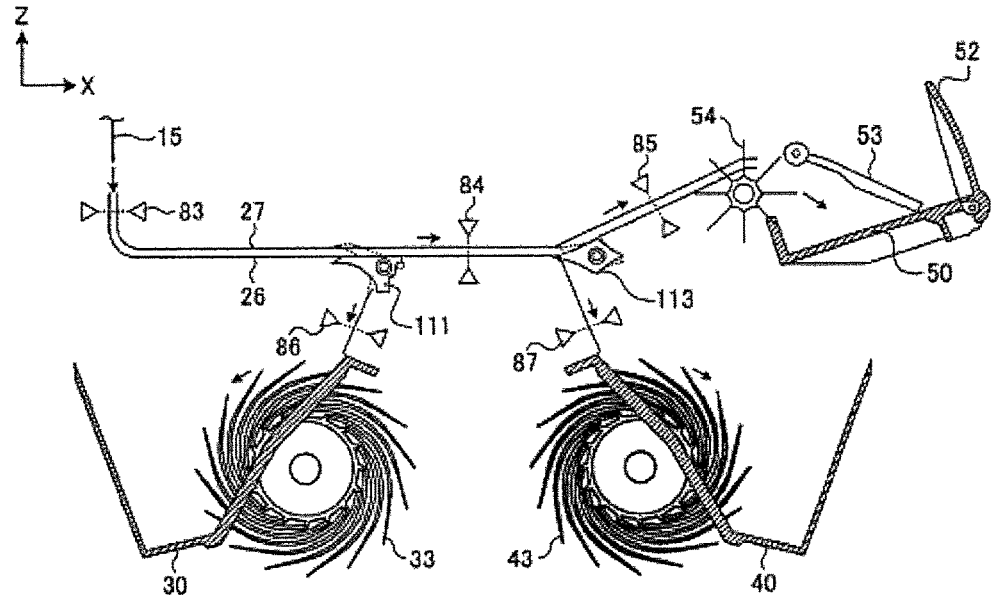

FIG. 11 is a schematic diagram illustrating the shape of the lower transport path in the lower unit 12 as viewed from the front thereof. FIG. 11(A) shows the shape of the lower transport path of the banknote handling apparatus 1 shown in FIG. 6, and FIG. 11(B) shows an exemplary case where the shape of the lower transport path is different. In FIG. 11, for allowing the shape of the lower transport path to be easily understood, the transport belts and the rollers are not shown, and the shape of the transport path is indicated by the transport guides 26, 27. The banknotes are transported between the transport guides 26 and 27. Further, as shown in FIG. 11, the banknote detection sensor 86 is disposed in the diverging transport path which diverges from the lower transport path toward the first banknote stacking unit 30, and the banknote detection sensor 87 is disposed also in the diverging transport path that diverges from the lower transport path toward the second banknote stacking unit 40, which are not shown in FIG. 6.

As shown in FIG. 11(A), in the lower transport path in which the banknote 15 having been transported downward in the intermediate transport path is transported in a different direction so as to be transported rightward, the transport path is horizontally formed up to a position where the banknote passes through a first diverging point 111*a* at which the first diverter 111 is mounted. In the banknote handling apparatus 1, also at a second diverging point 112*a* at which a banknote is diverted so as to be transported to the second banknote stacking unit 40, a diverter member having the same shape as the first diverter 111 is used as the second diverter 112.

In order to transport a banknote to the second banknote stacking unit 40 or the reject unit 50 by swinging the second diverter 112, an angle between a transporting direction 112*b* toward the second banknote stacking unit 40 and a transporting direction 112*c* toward the reject unit 50 needs to be set as a predetermined angle or a greater angle. In other words, if the transport path at the second diverging point 112*a* is horizontal, an angle between the horizontal transport path and the transport path that diverges in the transporting direction 112*b* is reduced, and the second diverter 112 cannot be used. Therefore, in the banknote handling apparatus 1, the transport path at the second diverging point 112*a* is tilted upward such that the height is increased on the downstream side, and the angle between the transporting direction 112*b* toward the second banknote stacking unit 40 and the transporting direction 112*c* toward the reject unit 50 is increased, whereby the components as used for the first diverter 111 can be used for the second diverter 112. As a result, the transporting direction in which the banknote passes through the first diverging point 111*a* toward the second banknote stacking unit 40, and the transporting direction in which the banknote passes through the second diverging point 112*a* toward the reject unit 50, are made different.

Further, a direction in which a banknote is transported toward the first banknote stacking unit 30 in the diverging transport path after the banknote is diverted at the first diverging point 111*a*, and a direction in which a banknote is transported toward the second banknote stacking unit 40 in the diverging transport path after the banknote is diverted at the second diverging point 112*a*, are made different. Specifically, a straight line that connects between the first diverging point 111*a* and the rotation shaft of the stacking wheel 33 of the first banknote stacking unit 30, and a straight line that connects between the second diverging point 112*a* and the rotation shaft of the stacking wheel 43 of the second banknote stacking unit 40, extend in different directions, respectively.

Further, as described above, a distance from the lower transport path to the stacking space needs to be shorter than the short edge length of a banknote such that, also in a case where transporting of banknotes is stopped, the front end, in the transporting direction, of the banknote is exposed into the stacking space of the banknote stacking unit, or the rear end, in the transporting direction, of the banknote is exposed into the lower transport path. If the first diverter 111 and the second diverter 112 are disposed at the same height, and the first banknote stacking unit 30 and the second banknote stacking unit 40 are formed in the same shape, the position of the second banknote stacking unit 40 is made higher than the position of the first banknote stacking unit 30. Therefore, in the banknote handling apparatus 1, the height at which the second diverter 112 is mounted is made lower than the height at which the first diverter 111 is mounted, whereby the condition concerning the transporting distance is satisfied, and the positional relationship is satisfied such that the first banknote stacking unit 30 and the second banknote stacking unit 40 having the same shape are positioned at the same height.

The lower transport path is formed such that the transport path is tilted downward so as to reduce its height in a portion downstream of the first diverging point 111*a* and then tilted in a different direction so as to connect to the transport path that is tilted upward, in order to connect between the horizontal transport path at the first diverging point 111*a* and the upward tilted transport path at the second diverging point 112*a*.

Thus, in the lower transport path of the banknote handling apparatus 1, a banknote that has passed through the first diverging point 111*a* in the horizontal direction, is transported in the transport path that is tilted downward relative to the horizontal direction, then transported in the different direction so as to be transported in the upward tilted transport path, and reaches the second diverging point 112*a*, and then transported in the upward tilted transport path toward the reject unit 50. In the banknote handling apparatus 1, as shown in FIG. 6, the lower transport unit is formed by the banknote transport belts 91 to 95 in order to assuredly transport a banknote in the transport path having such a curved shape.

The lower transport path of the banknote handling apparatus 1 has a shape as shown in FIG. 11(A) in order to use the same type of components in both the first diverter 111 and the second diverter 112. However, the shape of the lower transport path is not limited thereto, and may be the shape shown in FIG. 11(B). Specifically, the transport path may be horizontal, and, in a portion downstream of the first diverter 111, a second diverter 113 having a shape different from the first diverter 111 may be used to transport a banknote to the second banknote stacking unit 40 or the reject unit 50.

A control unit is disposed in the banknote handling apparatus 1. For example, feeding from the hopper 20, transporting of banknotes in the transport path, recognition of banknotes by the recognition unit 100, determination, based on the recognition result, of a destination to which the banknote is transported, and controlling of the diverters 111, 112 based on the determination, as described above, are performed by the control unit. Further, for example, each component is controlled by the control unit to enable: movement of the pushing member 34; detection of taking-out of banknotes from the banknote stacking units 30, 40; display of various kinds of information on the operation display unit 70; notifying an operator of various kinds of information; selection of a banknote stacking unit based on priority setting in which priorities for a plurality of banknote stacking units are set; and assigning of a kind of banknotes to each banknote stacking unit based on the priority setting for the banknote stacking units and on the number of banknotes, for each kind, which have been previously handled, as described below. These controls are performed by the control unit executing programs stored in a storage unit with reference to the various setting contents stored in the storage unit. However, a method for the control is the same as a method in conventional arts. Therefore, functions and operations, of the components, enabled by the control unit will be mainly described below.

[Banknote Pushing Mechanism]

Next, the pushing members 34, 44 disposed on the rear surface side in the stacking spaces of the first banknote stacking unit 30 and the second banknote stacking unit 40 of the banknote handling apparatus 1, will be described. Handling of banknotes placed in the hopper 20 has been completed, and all the banknotes are each stacked in the first banknote stacking unit 30, the second banknote stacking unit 40, or the reject unit 50. Thereafter, in the first banknote stacking unit 30 and the second banknote stacking unit 40, all the banknotes stacked in the banknote stacking unit are pushed toward the opening on the front side by the pushing members 34, 44 moving forward. The structure of the pushing member 34 and a driving mechanism for moving the pushing member 34 in the first banknote stacking unit 30 are the same as the structure of the pushing member 44 and a driving mechanism for moving the pushing member 44 in the second banknote stacking unit 40, respectively. Thus, the first banknote stacking unit 30 will be described below.

Figure 12:
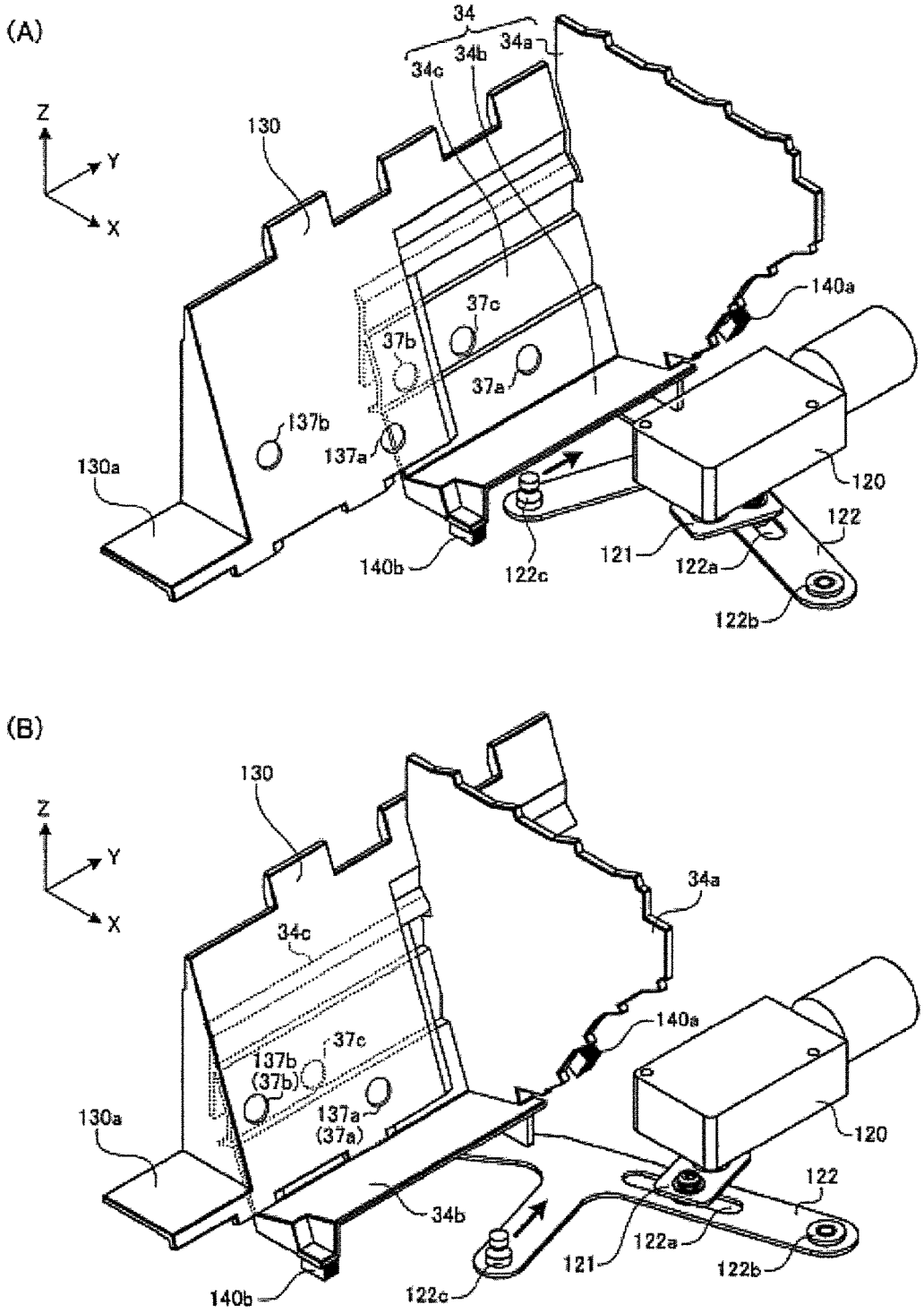
FIG. 12 is a perspective view illustrating a structure of a pushing member disposed in the banknote stacking unit, and a driving mechanism for moving the pushing member.

FIG. 12 is a perspective view illustrating the structure of the pushing member 34 disposed in the first banknote stacking unit 30, and the driving mechanism for moving the pushing member 34. FIG. 12 illustrates: an outer side-wall member 130, disposed on the apparatus outer side (side in the X-axis negative direction), which allows banknotes transported by the stacking wheel 33 in the stacking space of the first banknote stacking unit 30 to be stacked such that the banknote faces contact with the outer side-wall member 130; the pushing member 34 provided so as to be slidable along the outer side-wall member 130 fixed to the apparatus in the front-rear direction (in the Y-axis direction); and the driving mechanism for driving the pushing member 34. FIG. 12(A) illustrates a retracted position in the case of banknotes being stacked, and FIG. 12(B) illustrates a pushed position in the case of banknotes stacked therein being pushed forward by the pushing member 34.

The pushing member 34 has a structure in which a rear surface plate 34*a*, a bottom surface plate 34*b*, and a side surface plate 34*c* are integrated with each other. The rear surface plate 34*a*, the bottom surface plate 34*b*, and the side surface plate 34*c* each have a thin-plate-like shape. When the inside of the stacking space of the banknote stacking unit is regarded as a front side, ribs for maintaining strength are provided on the back sides of the rear surface plate 34*a*, the bottom surface plate 34*b*, and the side surface plate 34*c*. In the banknote handling apparatus 1, for example, the pushing member 34 in which the rear surface plate 34*a*, the bottom surface plate 34*b*, and the side surface plate 34*c* are integrally formed of resin, is used.

On the outer circumferential edge portion of the rear surface plate 34*a*, a plurality of sawtooth-shaped projections are provided. Grooves are formed in the front-rear direction at corresponding positions on the wall surfaces that form the stacking space so as to mesh with the projections. When the pushing member 34 is moved, the projections of the rear surface plate 34*a* are moved in the grooves of the wall surfaces, whereby a banknote is prevented from entering a gap between the pushing member 34 and the wall surfaces. Further, the surface shape of the side surface plate 34*c* is shaped so as to have steps corresponding to the projections of the rear surface plate 34*a*, and the outer side-wall member 130 has a shape corresponding to the surface shape, whereby a banknote is prevented from entering a gap between the side surface plate 34*c* and the outer side-wall member 130 when the pushing member 34 is moved.

In the first banknote stacking unit 30, a plurality of stacked-banknote detection sensors for detecting presence or absence of a banknote in the stacking space, are disposed. The stacked-banknote detection sensors each include two units for transmitting and receiving light that passes across the stacking space. For example, light transmitted from the light transmitter unit provided on one of outer sides of the banknote stacking unit passes through the stacking space and is received by the light receiver unit provided on the other of the outer sides of banknote stacking unit. When the light from the light transmitter unit is blocked by the banknotes stacked in the banknote stacking unit, the light cannot be received by the light receiver unit, whereby whether the banknote is present or absent is detected. Positions of the light transmitter unit and the light receiver unit are adjusted in order to assuredly detect a banknote in the banknote stacking unit, and a plurality of stacked-banknote detection sensors are disposed. The pushing member 34 includes sensor brushes 140*a*, 140*b* for cleaning the stacked-banknote detection sensors when the pushing member 34 is moved, which will be described below in detail.

As shown in FIG. 12(A), the side surface plate 34*c* of the pushing member 34 includes three through holes 37*a* to 37*c* for the stacked-banknote detection sensors, and the outer side-wall member 130 also includes two through holes 137*a*, 137*b* for the stacked-banknote detection sensors. The stacked-banknote detection sensor is disposed on the back side of the side surface plate 34*c*, that is, on the outer side of the banknote stacking unit so as to correspond to the through hole 37*c* of the side surface plate 34*c* positioned at the retracted position. Further, the stacked-banknote detection sensors are disposed on the back side of the outer side-wall member 130 so as to correspond to the through holes 137*a*, 137*b* of the outer side-wall member 130 that is fixed.

When the pushing member 34 is at the retracted position shown in FIG. 12(A), the stacked-banknote detection sensors are not disposed at the positions corresponding to the through holes 37*a*, 37*b* of the side surface plate 34*c*. However, these through holes 37*a*, 37*b* are formed so as to overlap the through holes 137*a*, 137*b* of the outer side-wall member 130 when the pushing member 34 is moved to the pushed position, as shown in FIG. 12(B). Thus, also when the pushing member 34 is moved to the pushed position, light of the stacked-banknote detection sensors positioned on the back side of the outer side-wall member 130 is not blocked by the side surface plate 34*c*, and the stacked-banknote detection sensors can be used.

The driving mechanism for sliding the pushing member 34 forward and backward includes a motor 120, a cam plate 121 that is rotated by the motor 120, and a link plate 122 driven by the cam plate 121. The rotation of the cam plate 121 is transformed to the forward-backward movement of the pushing member 34 by the link plate 122.

The pushing member 34 is supported such that movement of the pushing member 34 in the lateral direction (the X-axis direction) and the up-down direction (the Z-axis direction) is regulated, and the pushing member 34 is slidable only in the front-rear direction. One end of the link plate 122 is rotatably mounted to a shaft that projects on the back side of the bottom surface plate 34*b* of the pushing member 34. Further, the other end of the link plate 122 is rotatably mounted to a rotation shaft 122*b* fixed to the apparatus. The link plate 122 has an elongated through hole 122*a*. The cam plate 121 has one end connected to the rotation shaft of the motor 120, and a shaft, on the other end, of the cam plate 121 is inserted into the through hole 122*a*. When the cam plate 121 is rotated by the motor 120, the shaft of the cam plate 121 reciprocates in the through hole 122*a* of the link plate 122. The reciprocation causes the other end of the link plate 122 supported by the rotation shaft 122*b* to be moved forward and backward, and the pushing member 34 connected to the other end is moved forward and backward.

Further, a not-illustrated spring member that applies tensile force in the direction indicated by an arrow in FIG. 12, is mounted to the shaft 122*c* of the link plate 122. When the motor 120 stops, the link plate 122 is moved by the tensile force of the spring member, and the pushing member 34 is returned to the retracted position.

The front end of the outer side-wall member 130 is closer to the rear surface side than the cut portion 31 disposed on the left side surface of the first banknote stacking unit 30 is. The triangular surface is formed in the front end portion so as to be parallel to the XZ-plane (see FIG. 10). The opening left side surface 35 shown in FIG. 1 is formed at the portion 130*a* on the apparatus front surface side forward of the surface of the front end portion.

Figure 13:
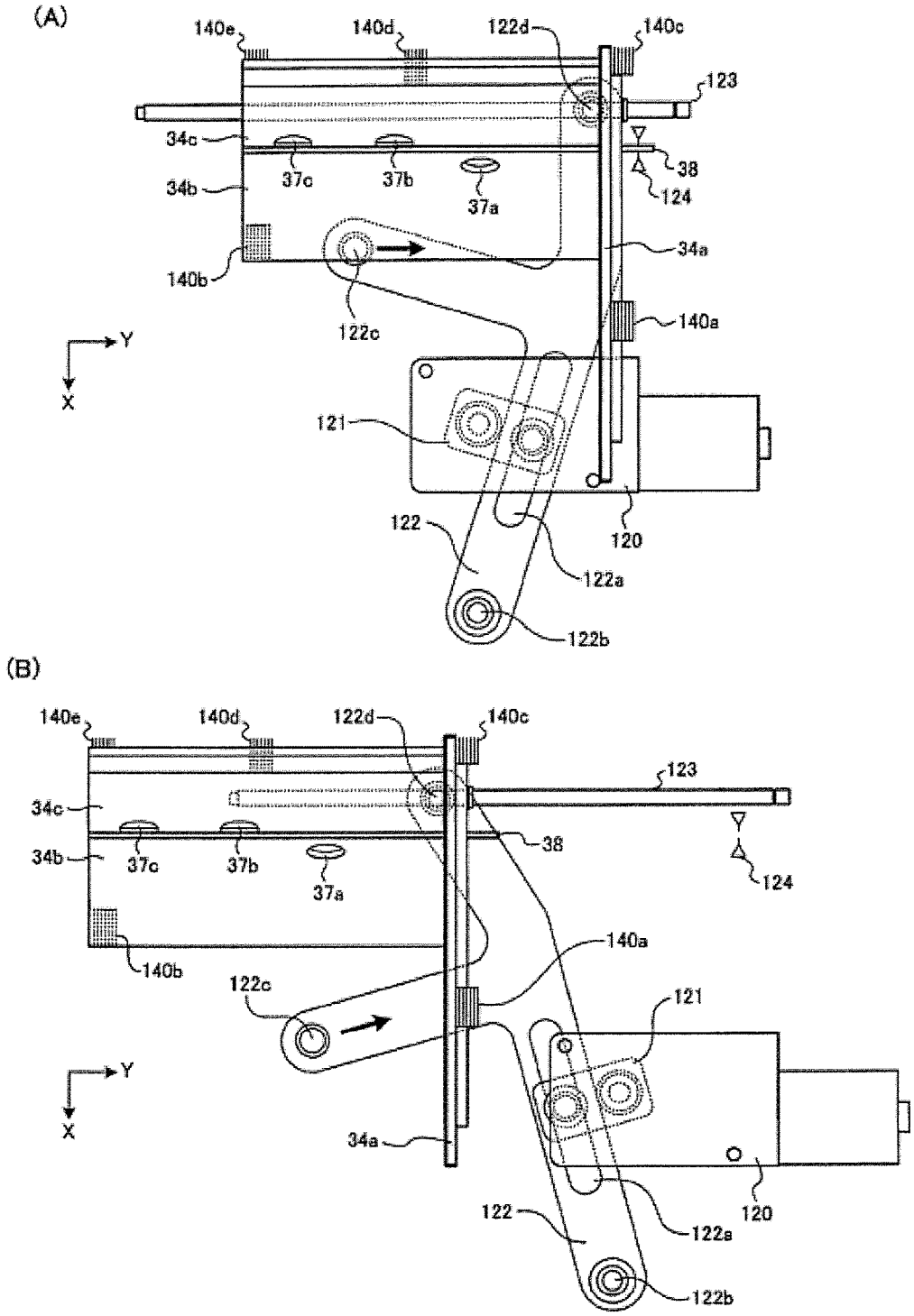
FIG. 13 illustrates a method for moving the pushing member by a pushing mechanism.

FIG. 13 is a schematic diagram illustrating a method for moving the pushing member 34 by the driving mechanism. FIG. 13 is a view as viewed from above the upper side, and (A) of FIG. 13 shows a retracted position corresponding to that in FIG. 12(A), and FIG. 13(B) shows a pushed position corresponding to that in FIG. 12(B). As shown in FIG. 13, the pushing member 34 includes three sensor brushes 140*c* to 140*e* in addition to the sensor brushes 140*a*, 140*b* shown in FIG. 12. The sensor brushes 140*a* to 140*e* will be described below in detail.

The bottom surface plate 34*b* of the pushing member 34 has ribs on the back side thereof, and the ribs have through holes. A bar-like slide guide 123 is fixed to the apparatus so as to penetrate through the through holes of the ribs of the pushing member 34. The slide guide 123 guides sliding of the pushing member 34 in the front-rear direction and regulates movement thereof in other directions.

Further, the bottom surface plate 34*b* of the pushing member 34 has a shaft 122*d* that projects on the back side thereof. To the shaft 122*d*, one end of the link plate 122 is rotatably mounted. The motor 120 fixed to the apparatus causes the cam plate 121 to rotate, whereby the link plate 122 swings about the rotation shaft 122*b* on the other end, and the pushing member 34 moves in the apparatus front-rear direction (the Y-axis direction) according to the swinging.

The banknote handling apparatus 1 includes a retracted position detection sensor 124 for detecting that the pushing member 34 is at the retracted position. Further, a light shielding plate 38 used for the retracted position detection sensor 124 is disposed on the back side of the rear surface plate 34*a* of the pushing member 34. As shown in FIG. 13(A), when the pushing member 34 is at the retracted position, light transmitted and received between the light transmitter unit and the light receiver unit of the retracted position detection sensor 124 is blocked by the light shielding plate 38. In a case where the motor 120 starts rotating in a state where the pushing member 34 is at the retracted position, and the pushing member 34 starts moving forward, light transmission can be enabled between the light transmitter unit and the light receiver unit of the retracted position detection sensor 124. When the motor 120 continues to rotate, the pushing member 34 that moves forward reaches the pushed position. Also after this, the motor 120 does not stop and continues to rotate, and the pushing member 34 then starts retracting from the pushed position toward the retracted position according to the rotation. When the light shielding plate 38 positioned on the rear surface side of the retracting pushing member 34, reaches the position of the retracted position detection sensor 124, light is blocked again, whereby the retracted position detection sensor 124 detects that the pushing member 34 has returned to the retracted position. Rotation of the motor 120 is stopped according to the detection result from the retracted position detection sensor 124.

Thus, in the banknote handling apparatus 1, the inexpensive motor 120 that does not allow detection of a rotation angle or the like can be used to reciprocate the pushing member 34 in the front-rear direction by a link mechanism while the rotation shaft of the motor 120 is rotated in the same direction. Further, the pushing member 34 includes the light shielding plate 38, and the retracted position detection sensor 124 detects that the pushing member 34 is at the retracted position, whereby the motor 120 can be stopped at an appropriate time. Further, the shaft 122*c* of the link plate 122 is drawn by a not-illustrated spring member in the direction indicated by an arrow in FIG. 13, whereby the pushing member 34 is assuredly returned to the retracted position after the motor 120 is stopped.

Figure 14:
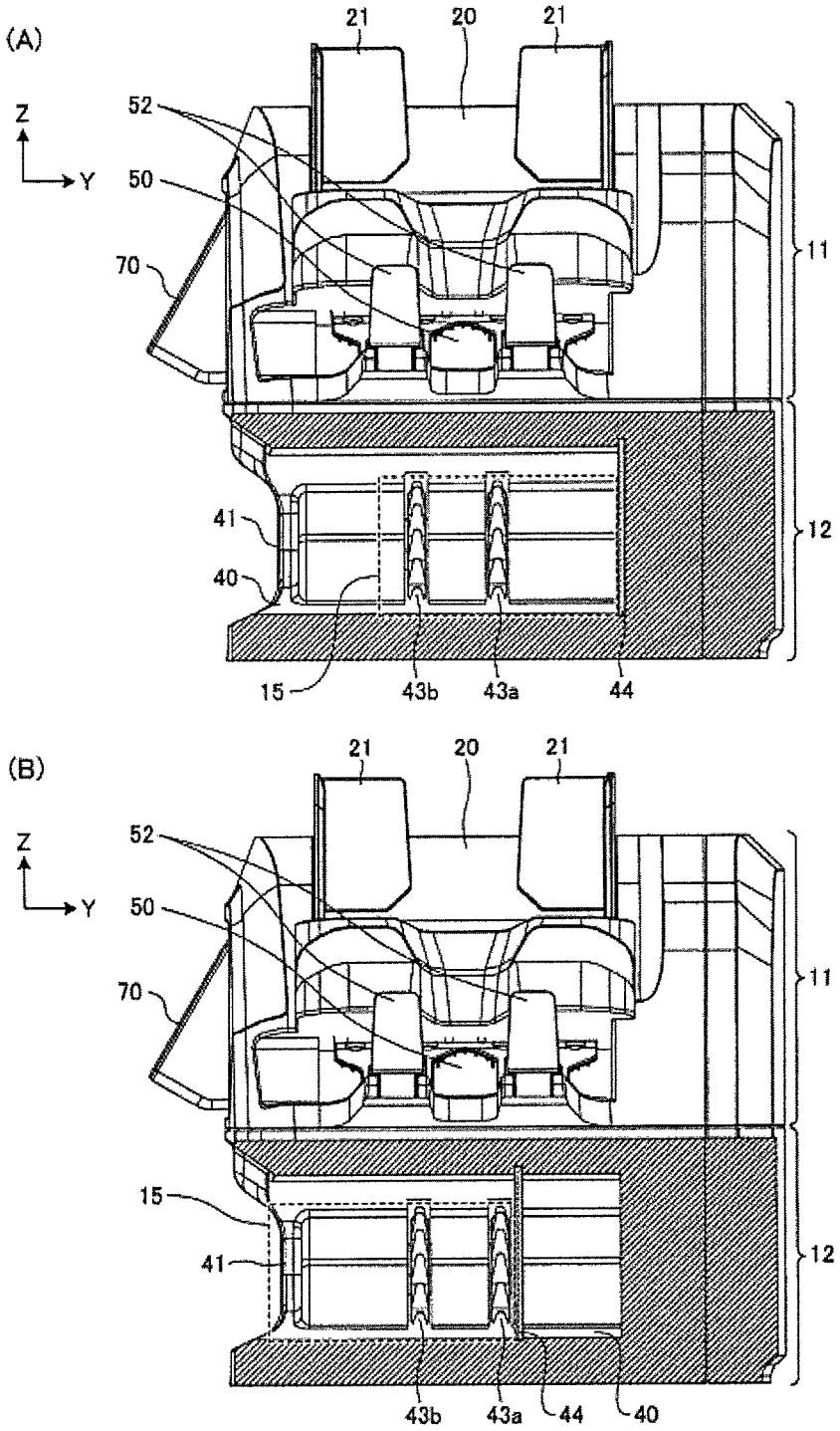
FIG. 14 is a schematic diagram illustrating a retracted position and a pushed position of the pushing member in the banknote stacking unit.

FIG. 14 is a schematic diagram illustrating the retracted position and the pushed position of each of the pushing members 34, 44 in the banknote stacking unit. FIG. 14 is a view of the banknote handling apparatus 1 as viewed from the right side, and an external appearance of the upper unit 11 is illustrated and the lower unit 12 is illustrated by a schematic cross-sectional view. FIG. 14(A) illustrates a state where pushing member 44 of the second banknote stacking unit 40 is at the retracted position, and FIG. 14(B) illustrates a state where the pushing member 44 is at the pushed position. With reference to FIG. 14, the pushing member 44 of the second banknote stacking unit 40 will be described as an example. However, the pushing member 34 of the first banknote stacking unit 30 similarly operates.

As shown in FIG. 14(A), the second banknote stacking unit 40 includes two stacking wheels 43*a*, 43*b* thereinside. The banknote 15 that is fed from the hopper 20 into the apparatus, transported in the apparatus, and discharged into the banknote stacking unit is transported to the apparatus right outer side by the stacking wheels 43*a*, 43*b*, and stacked so as to be tilted in a standing state as indicated by dashed lines in the drawings.

The banknotes placed in the hopper 20 are recognized by the recognition unit 100, and all the banknotes have been each stacked in the first banknote stacking unit 30, the second banknote stacking unit 40, or the reject unit 50. Thereafter, the pushing operation by the pushing member 44 is automatically started according to the control by the control unit. The pushing member 44 is moved to the pushed position on the side rearward of the stacking wheel 43*a* disposed on the rear surface side as shown in FIG. 14(B). Thus, the short edge, on the front side, of the stacked banknotes 15 protrudes forward of the cut portion 41 disposed on the side surface of the second banknote stacking unit 40, and the front end of the banknotes that are tilted in a standing state is held from the left and the right sides, and the banknotes can be easily taken out.

After the pushing member 44 has reached the pushed position, the pushing member 44 returns to the retracted position shown in FIG. 14(A), and automatically stops. Further, as shown in FIG. 14(A), in the second banknote stacking unit 40, the cut portion 41 is formed on the side surface, whereas the bottom surface continuously extends to the apparatus front surface. Therefore, when the banknotes are pushed by the pushing member 44, a part of the short edge, on the front side, of the banknotes 15 is exposed from the cut portion 41, whereas the entirety of the long edge, on the bottom surface side, of the banknotes 15 remains in contact with the bottom surface. Further, the cut portion 41 is shaped so as to expose only a part of the short edge of the banknotes 15 having been pushed, and the lower side portion of the exposed short edge of the banknotes 15 having been pushed, is supported by the opening right side surface 45 shown in FIG. 1, and the face of the paper sheet is supported by the side wall that forms the stacking space in a rear portion thereof. Thus, the banknotes 15 that are pushed by the pushing member 34, 44 do not fall forward through the opening, and, also after the pushing, the banknotes 15 can be maintained so as to be stably stacked.

[Sensor Brush]

Figure 15:
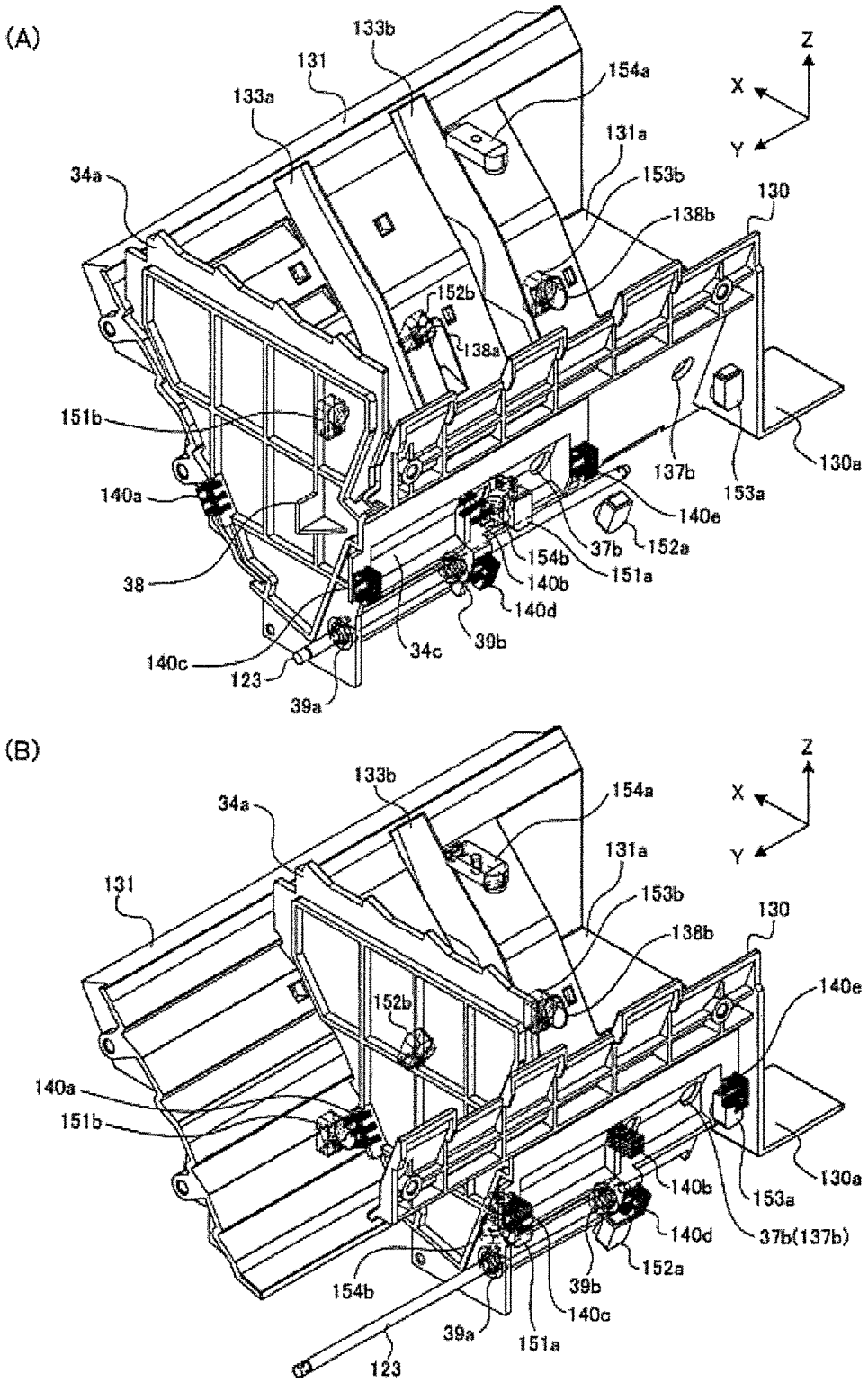
FIG. 15 is a perspective view illustrating stacked-banknote detection sensors for detecting presence or absence of banknotes stacked in the banknote stacking unit, and sensor brushes for cleaning the sensors.

FIG. 15 is a perspective view of the pushing member 34 of the first banknote stacking unit 30 as viewed from the rear surface side. FIG. 15(A) illustrates a state where the pushing member 34 is at the retracted position between: the outer side-wall member 130 that forms a side wall on the apparatus outer side (side in the X-axis negative direction) in the banknote stacking unit of the first banknote stacking unit 30; and an inner side-wall member 131 that forms a side wall on the apparatus inner side (side in the X-axis positive direction). FIG. 15(B) illustrates a state where the pushing member 34 is at the pushed position.

The slide guide 123 penetrates through two through holes 39*a*, 39*b* formed in the back side ribs of the pushing member 34, and the slide guide 123 guides sliding of the pushing member 34 in the front-rear direction. Two grooves 133*a*, 133*b* formed in the inner side-wall member 131 are grooves in which the two stacking wheels 33 are disposed. The two stacking wheels 33 rotate and transport, toward the outer side-wall member 130, banknotes that enter from the upper side portion of the inner side-wall member 131, which is not shown in FIG. 15(A).

The first banknote stacking unit 30 includes four stacked-banknote detection sensors 151 to 154 for detecting whether or not stacked banknotes are present, by light passing through the banknote stacking unit being blocked. The stacked-banknote detection sensor 151 includes: a unit 151*a* disposed on the back side of the side surface plate 34*c* of the pushing member 34; and a unit 151*b* disposed on the back side of the inner side-wall member 131. The stacked-banknote detection sensor 152 includes: a unit 152*a* disposed on the back side of the outer side-wall member 130; and a unit 152*b* disposed on the back side of the inner side-wall member 131. The stacked-banknote detection sensor 153 includes: a unit 153*a* disposed on the back side of the outer side-wall member 130; and a unit 153*b* disposed on the back side of the inner side-wall member 131. The stacked-banknote detection sensor 154 includes: a unit 154*a* disposed on the back side of the upper surface of the banknote stacking unit; and a unit 154*b* disposed on the back side of the bottom surface of the banknote stacking unit.

In the outer side-wall member 130, the inner side-wall member 131, the upper surface and the bottom surface which form the stacking space of the first banknote stacking unit 30, and the side surface plate 34*c* of the pushing member 34, the through holes are formed at positions corresponding to the stacked-banknote detection sensors 151 to 154. For example, as shown in FIG. 15(A), the through hole 137*b* is formed in the outer side-wall member 130 so as to correspond to the unit 153*a* of the stacked-banknote detection sensor 153, and the through hole 138*b* is formed in the inner side-wall member 131 so as to correspond to the unit 153*b*.

Further, in the pushing member 34, the sensor brushes 140*a* to 140*e* for cleaning light transmitting and receiving surfaces of a part of units of the stacked-banknote detection sensors 151 to 154, are provided. Specifically, as shown in FIG. 15(A), on the back side of the rear surface plate 34*a* of the pushing member 34, the sensor brush 140*a* is provided on the inner side-wall member 131 side. As shown in FIG. 15(B), when the pushing member 34 is moved to the pushed position so as to push banknotes, the unit 151*b* of the stacked-banknote detection sensor 151 is cleaned. Further, when the pushing member 34 returns from the pushed position to the retracted position, the sensor brush 140*a* cleans the unit 151*b* of the stacked-banknote detection sensor 151 again.

Figure 16:
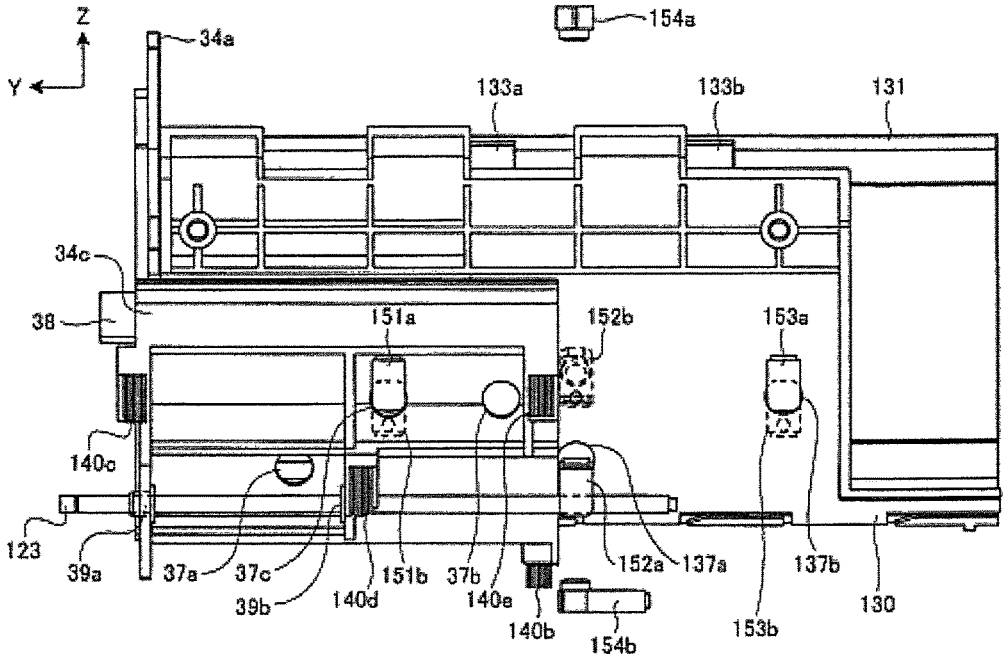
FIG. 16 illustrates a method for performing cleaning by the sensor brushes.
Figure 16:
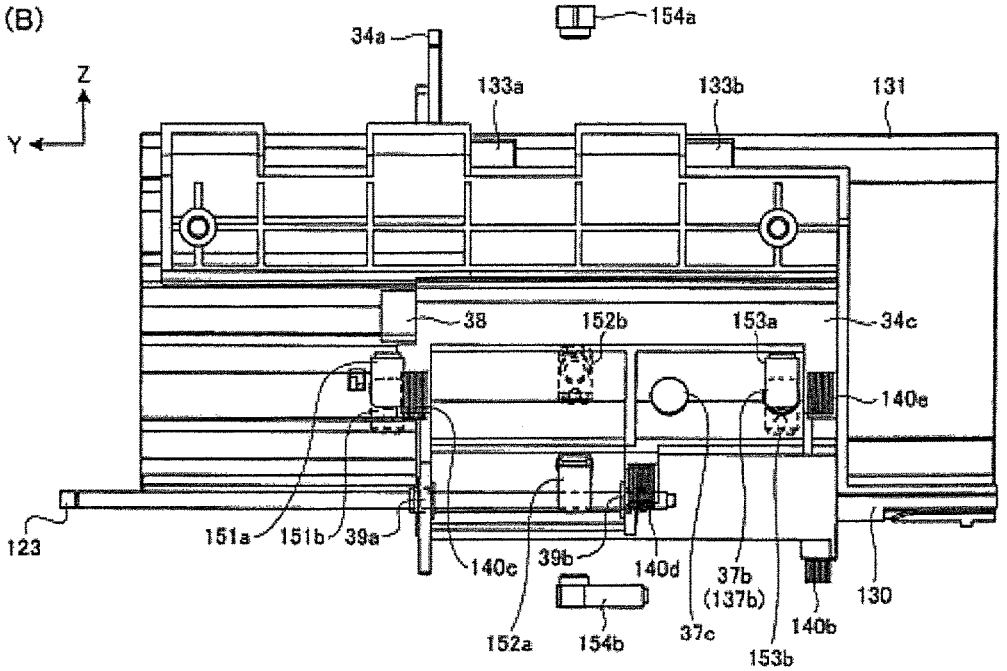

FIG. 16 illustrates sensor cleaning by the sensor brushes 140*b* to 140*e* provided in the pushing member 34. The sensor brush 140*b* is disposed on the back side of the bottom surface plate 34*b* of the pushing member 34. While the pushing member 34 reciprocates between the retracted position shown in FIG. 16(A) and the pushed position shown in FIG. 16(B), the sensor brush 140*b* cleans the unit 154*b* of the stacked-banknote detection sensor 154.

The sensor brushes 140*c* to 140*e* are provided on the back side of the side surface plate 34*c* of the pushing member 34. While the pushing member 34 reciprocates between the retracted position shown in FIG. 16(A) and the pushed position shown in FIG. 16(B), the sensor brush 140*c* cleans the unit 151*a* of the stacked-banknote detection sensor 151, the sensor brush 140*d* cleans the unit 152*a* of the stacked-banknote detection sensor 152, and the sensor brush 140*e* cleans the unit 153*a* of the stacked-banknote detection sensor 153. The sensor brushes 140*c* to 140*e* also clean the units 151*a* to 153*a* of the stacked-banknote detection sensors 151 to 153, respectively while the pushing member 34 reciprocates between the retracted position shown in FIG. 16(A) and the pushed position shown in FIG. 16(B).

For the unit 152*b* of the stacked-banknote detection sensor 152, the unit 153*b* of the stacked-banknote detection sensor 153, and the unit 154*a* of stacked-banknote detection sensor 154 which are shown in FIG. 15, the sensor brushes for cleaning these units are not provided. The unit 153*b* is positioned near the opening of the first banknote stacking unit 30, whereby a hand can be inserted through the opening to perform cleaning through the through hole 138*b* of the inner side-wall member 131. The unit 154*a* is disposed such that the light transmitting and receiving surfaces face downward, whereby the frequency with which the cleaning is to be performed may be reduced since dirt or dust is less likely to be adhered as compared to the other units. The unit 152*b* is disposed between the two stacking wheels 33, and it is difficult to perform cleaning as compared to the other units. Therefore, the through hole 138*a* that penetrates through the inner side-wall member 131 in the left-right direction (the X-axis direction) so as to correspond to the unit 152*b*, is shaped so as to penetrate in the up-down direction (the Z-axis direction), whereby dirt or dust therein is reduced.

In the inner side-wall member 131, the front end of the side wall portion that forms the stacking space is closer to the rear surface side than the recess 60 on the apparatus front surface side is. The almost triangular surface is formed in the front end portion so as to be parallel to the XZ-plane (see FIG. 10). The opening right side surface 32 shown in FIG. 1 is formed in the portion 131*a* on the apparatus front surface side forward of the surface in the front end portion.

Figure 17:
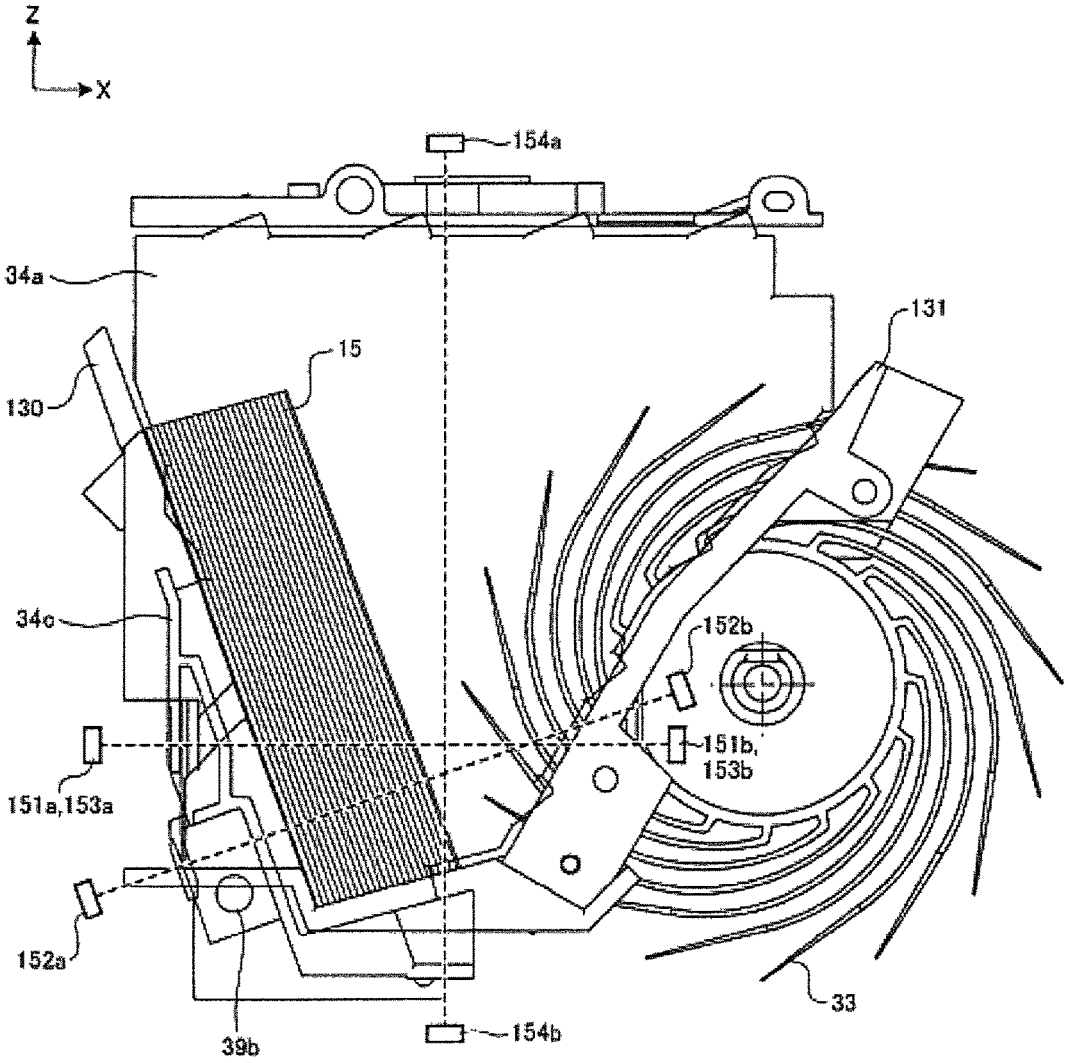
FIG. 17 illustrates positions at which the stacked-banknote detection sensors are positioned relative to the banknote stacking unit.

FIG. 17 is a schematic diagram illustrating angles at which the stacked-banknote detection sensors 151 to 154 shown in FIG. 15 and FIG. 16 are disposed. As shown in FIG. 17, in the first banknote stacking unit 30, the banknotes 15 are stacked so as to be tilted in a standing state such that the long edge portion of the banknotes 15 contacts with the bottom surface, and the banknote face is along the outer side-wall member 130.

In the stacked-banknote detection sensor 154, the units 154*a* and 154*b* are disposed at positions corresponding to the through holes in the upper surface and the bottom surface that form the stacking space, so as to oppose each other in the vertical direction. In the two stacked-banknote detection sensors 151, 153 that are disposed at the same height so as to be displaced in the apparatus front-rear direction, the units 151*a* and 151*b* oppose each other in the horizontal direction, and the units 153*a* and 153*b* oppose each other in the horizontal direction. Further, the units 152*a* and 152*b* of the stacked-banknote detection sensor 152 are disposed between the stacked-banknote detection sensors 151 and 153 in the apparatus front-rear direction and are provided so as to oppose each other in the direction perpendicular to the wall surface of the outer side-wall member 130.

[Positions at which Stacking Wheels are Mounted]

Figure 18:
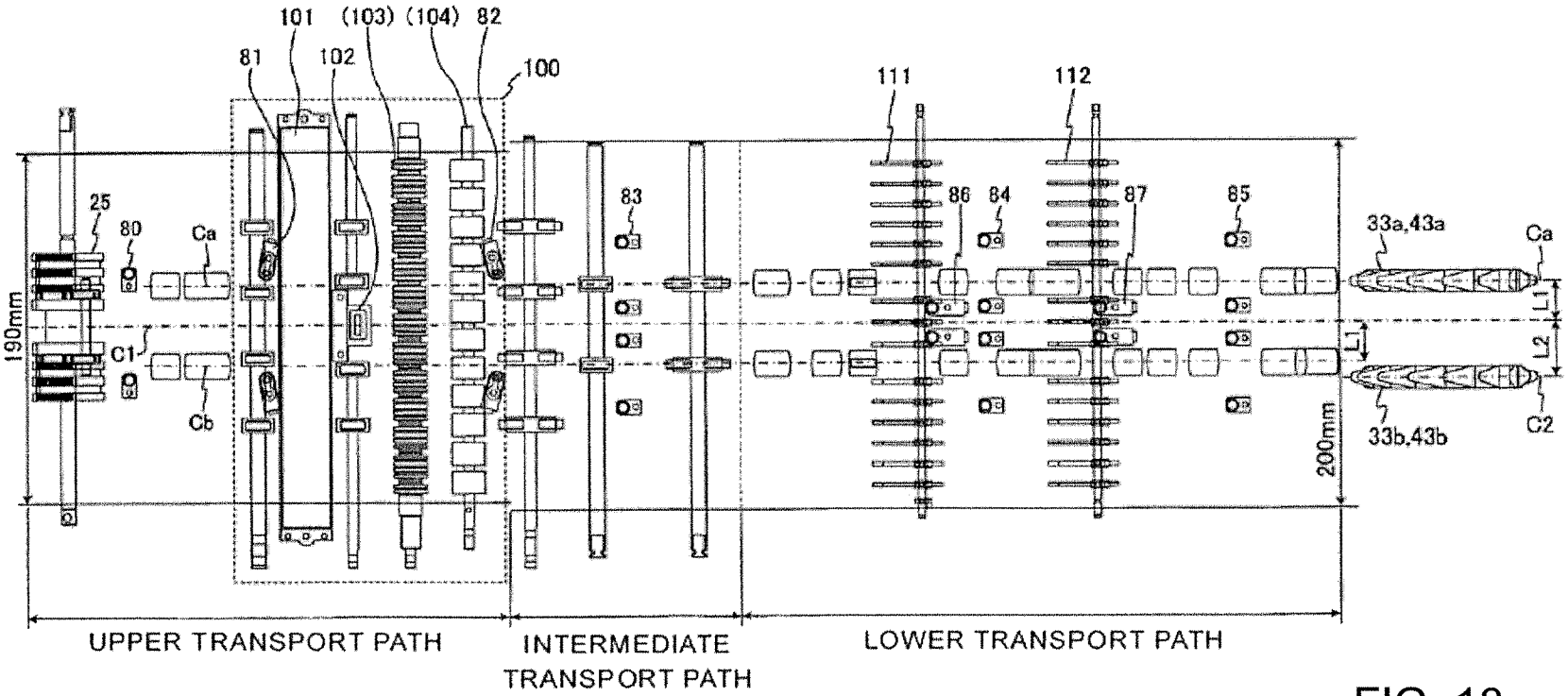
FIG. 18 is a development illustrating a structure of a banknote transport path in the banknote handling apparatus.

FIG. 18 is a schematic diagram illustrating a positional relationship between the stacking wheels 33, 43 and the rollers of the transport path in a developed plan view of the transport path of the banknote handling apparatus 1. As shown in FIG. 6, the transport path in the banknote handling apparatus 1 includes: the upper transport path in which banknotes fed from the hopper 20 into the apparatus are transported leftward; the intermediate transport path in which the banknotes that have passed through the recognition unit 100 are transported in a different transporting direction so as to be transported downward; and the lower transport path in which the banknotes are transported in a different transporting direction so as to be transported rightward into the first banknote stacking unit 30, the second banknote stacking unit 40, or the reject unit 50 on the basis of the recognition result by the recognition unit 100. FIG. 18 shows the upper transport path, the intermediate transport path, and the lower transport path in order, respectively, starting from the left side, and shows, at the right end, the stacking wheel 33 of the first banknote stacking unit 30 and the stacking wheel 43 of the second banknote stacking unit 40.

When, as shown in FIG. 8, the upper unit 11 is opened upward, the transport path portion included in the upper unit 11 has the width of 190 mm, while the transport path portion that remains in the lower unit 12 has the width of 200 mm, as shown in FIG. 18. When the upper unit 11 is opened upward, the upper transport path is included in the upper unit 11. The intermediate transport path in which a banknote is transported in the vertical direction is divided into the left side portion and the right side portion. When the upper unit 11 is opened, the right side portion is included in the upper unit 11 and the left side portion remains in the lower unit 12. Further, the lower transport path is also divided in the upper portion and the lower portion. When the upper unit 11 is opened, the upper portion is included in the upper unit 11, and the lower portion remains in the lower unit 12.

FIG. 18 illustrates the left side portion, of the intermediate transport path, which remains in the lower unit when the upper unit 11 is opened, in a range indicated as the intermediate transport path. Further, in a range indicated as the lower transport path, the lower portion, of the lower transport path, which remains in the lower unit when the upper unit 11 is opened, is illustrated. However, since, in the intermediate transport path, the rollers in the right side portion and the rollers in the left side portion are disposed so as to oppose each other, and, also in the lower transport path, the rollers in the upper portion and the rollers in the lower portion are disposed so as to oppose each other, the positions where all the rollers of each transport path are disposed, are as shown in FIG. 18.

As shown in FIG. 18, the rollers in the upper transport path are disposed so as to be symmetrical with respect to the center line C1, in the width direction, of the transport path having the width of 190 mm. Further, also in the intermediate transport path and the lower transport path, the rollers are disposed so as to be symmetrical with respect to the center line C1, in the width direction, of the transport path having the width of 200 mm. The center line C1 is a straight line common to the upper transport path, the intermediate transport path, and the lower transport path. Therefore, all the rollers, as shown in FIG. 18, for transporting banknotes are disposed such that the center line, in the axial direction, of each roller overlaps one of straight lines Ca and Cb that are symmetrical with respect to the center line C1.

The two stacking wheels 33*a*, 33*b* of the first banknote stacking unit 30 are disposed such that the center line, in the rotation axis direction, of the stacking wheel 33*a* on the rear surface side is on the straight line Ca that is the same as that of the rollers for transporting banknotes in the transport path, and the center line, in the rotation axis direction, of the stacking wheel 33*b* on the opening side is farther from the center line C1 of the transport path than the straight line Cb on which the rollers for transporting banknotes in the transport path are disposed, is from the center line C1, that is, the center line of the stacking wheel 33*b* is at a position close to the opening of the banknote stacking unit. Similarly, the two stacking wheels 43*a*, 43*b* of the second banknote stacking unit 40 are disposed such that the center line, in the rotation axis direction, of the stacking wheel 43*a* on the rear surface side is on the straight line Ca, and the center line, in the rotation axis direction, of the stacking wheel 43*b* on the opening side is closer to the opening than the straight line Cb is. Specifically, the stacking wheels 33*b*, 43*b* on the opening side in the banknote stacking unit are each disposed such that the center line in the rotation axis direction is on a straight line C2 that is distant from the center line C1 of the transport path by a distance L2 (L1<L2).

Figure 19:
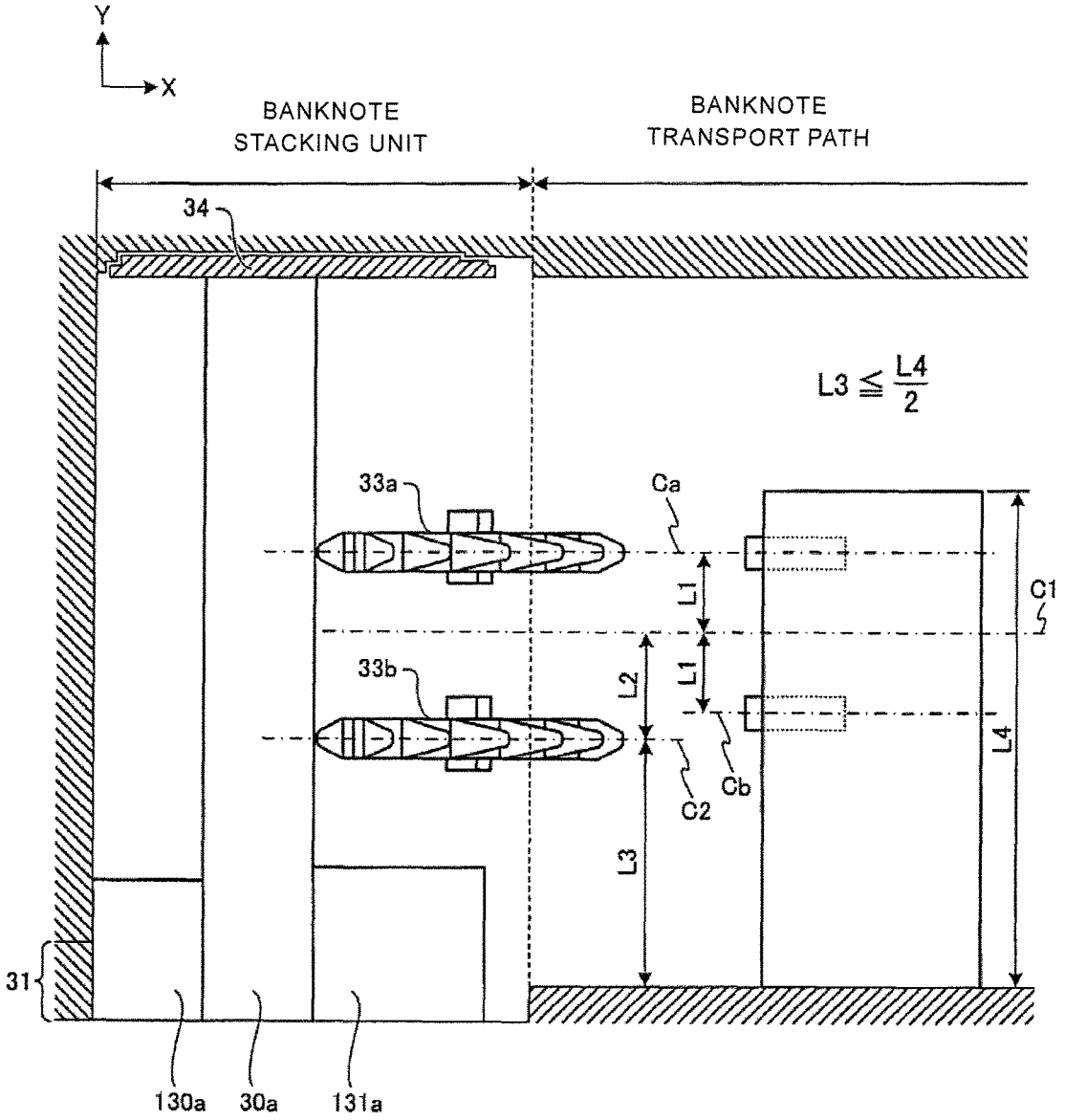
FIG. 19 is a schematic diagram illustrating a position where a stacking wheel is positioned in the banknote stacking unit.

FIG. 19 is a schematic diagram illustrating a position where the stacking wheel 33*b* on the opening side is positioned relative to the center line C1 of the transport path. FIG. 19 schematically illustrates the positional relationship as viewed from above the transport path and the first banknote stacking unit 30. The arrangement of the stacking wheel 43*b* on the opening side in the second banknote stacking unit 40 is the same as the arrangement obtained by the arrangement shown in FIG. 19 being laterally inverted. Therefore, description of the stacking wheel 43*b* of the second banknote stacking unit 40 is not given, and the stacking wheel 33*b* of the first banknote stacking unit 30 will be described.

The distance L2 from the center line C1 of the transport path to the center line C2, in the rotation axis direction, of the stacking wheel 33*a* on the opening side is set on the basis of the smallest banknote having the shortest long edge length. Specifically, in a case where L4 represents the long edge length of the smallest banknote, the distance L2 is set such that a distance L3 from the side wall on the opening side is shorter than half the distance L4 in a state where the short edge of the smallest banknote contacts with the side wall, on the opening side, of the transport path, as shown in FIG. 19. In other words, a position at which the stacking wheel 33*b*, on the opening side, of the banknote stacking unit is disposed, is set to be closer to the opening side than the center line, in the longitudinal direction, of the smallest banknote is, even when the smallest banknote is transported in a state where the banknote is close to a position closest to the opening side of the banknote stacking unit.

The banknote that is transported in the transport path and discharged into the banknote stacking unit is received by the stacking wheels 33*a*, 33*b*. At this time, if the banknote is received on the side rearward of the center line, in the longitudinal direction, of the banknote by the stacking wheel 33*b*, the banknote is tilted toward the opening side, and may be ejected through the opening of the banknote stacking unit to the outside of the apparatus. Therefore, the stacking wheel 33*b* is disposed so as to receive most of the banknotes to be handled, in a portion closer to the opening than the center in the longitudinal direction is, such that the banknotes received by the stacking wheels 33*a*, 33*b* are not tilted toward the opening side.

The two stacking wheels 33*a*, 33*b* may be mounted so as to be distant from the center line C1 such that the two stacking wheels 33*a*, 33*b* are symmetrical with respect to the center line C1 of the transport path in order to assuredly receive the banknotes by the stacking wheels 33*a*, 33*b*. However, if the stacking wheel 33*a* on the rear surface side is mounted so as to be distant from the center line C1, a distance over which the pushing member 34 is moved toward the front surface side is limited. Therefore, in the banknote handling apparatus 1, the stacking wheel 33*b* on the opening side is mounted so as to be distant from the center line C1 while the stacking wheel 33*a* on the rear surface side is mounted so as to be close to the center line C1. Thus, in the banknote handling apparatus 1, the two stacking wheels 33*a*, 33*b* are disposed so as to be asymmetrical with respect to the center line C1 of the transport path, whereby a distance for pushing by the pushing member 34 is assured while a banknote is prevented from being ejected from the first banknote stacking unit 30.

Further, as shown in FIG. 19, the opening left side surface 35 shown in FIG. 1 is formed at the portion 130*a* positioned forward of the front end of the outer side-wall member 130 of the first banknote stacking unit 30, and the opening right side surface 32 shown in FIG. 1 is formed at the portion 131*a* positioned forward of the front end of the inner side-wall member 131.

[Contents Displayed on Operation Display Unit]

Figure 20:
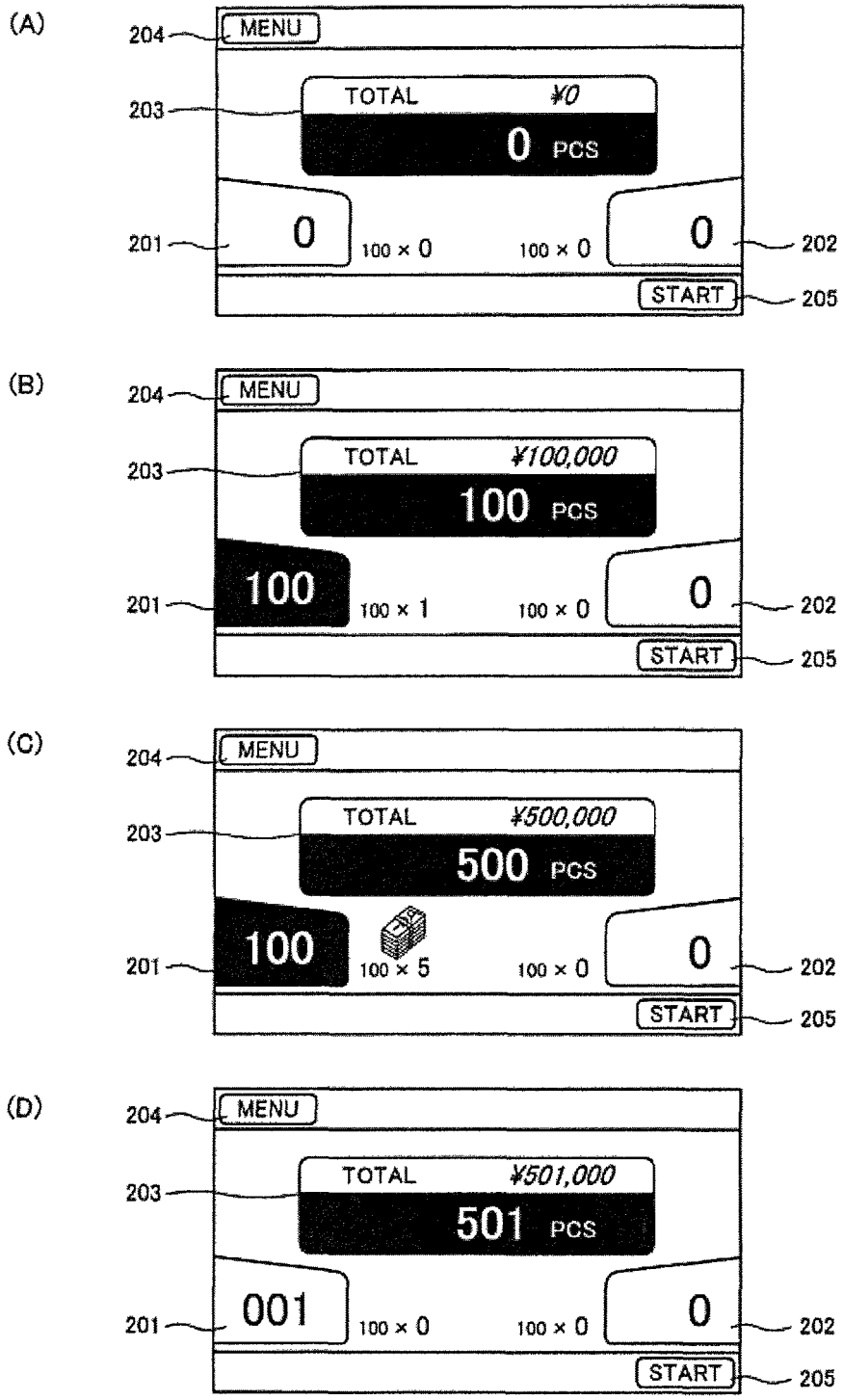
FIG. 20 illustrates an example of a screen displayed on the operation display unit during handling of banknotes.
Figure 21:
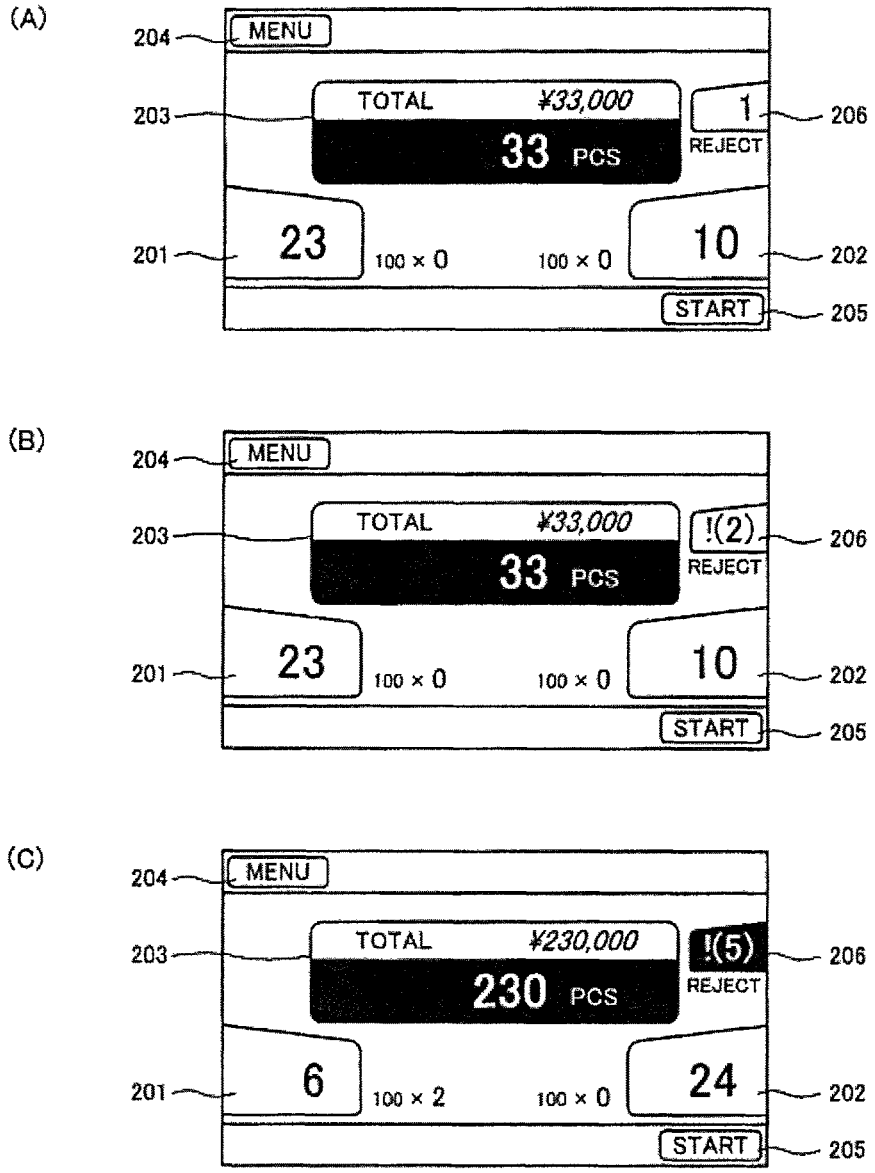
FIG. 21 illustrates an example of a screen displayed on the operation display unit when a rejected note occurs during handling of banknotes.
Figure 22:
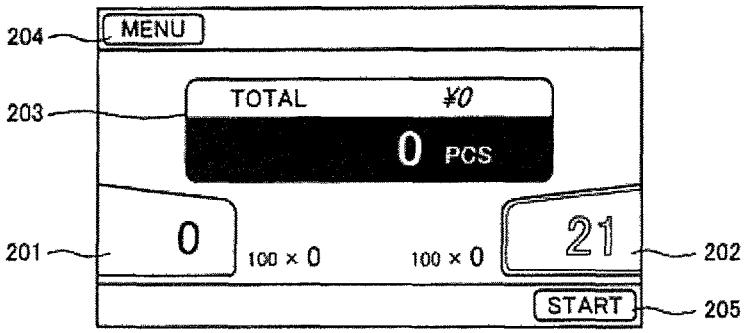
FIG. 22 illustrates an example of a screen displayed on the operation display unit when restoration is performed in a case where an error occurs during handling of banknotes.

The banknote handling apparatus 1 has a characteristic in that the large operation display unit 70 is used to display information so as to allow information concerning handling of banknotes to be easily recognized. In FIG. 20 to FIG. 22, the characters are indicated in white or black. However, in the operation display unit 70, in practice, the information is sorted by using colors and a color display of the information is performed.

FIG. 20 illustrates examples of a screen displayed on the operation display unit 70 during handling of banknotes. Firstly, the basic structure of the screen and displayed contents will be described with reference to FIG. 20(A). The operation display unit 70 which is implemented as a touch panel type liquid crystal display device is used also as an operation unit through which various kinds of information is inputted. Therefore, various types of buttons 204, 205 are displayed in a band-shaped region on the upper portion of the screen and a band-shaped region on the lower portion of the screen, as shown in FIG. 20(A).

In an information display region other than the upper and the lower band-shaped regions for displaying the buttons 204, 205 for operation, a first display region 201 is disposed in the lower left portion, and a second display region 202 is disposed in the lower right portion. The first display region 201 is a region in which information for banknotes stacked in the first banknote stacking unit 30 is displayed. The second display region 202 is a region in which information for banknotes stacked in the second banknote stacking unit 40 is displayed. A total display region 203 in which information for the total of banknotes stacked in the first banknote stacking unit 30 and the second banknote stacking unit 40 is displayed is disposed between the first display region 201 and the second display region 202 above the first display region 201 and the second display region 202.

For example, the number of banknotes stacked in the first banknote stacking unit 30 is displayed in the first display region 201 and the number of banknotes stacked in the second banknote stacking unit 40 is displayed in the second display region 202. In the total display region 203, the total of the number of banknotes stacked in the first banknote stacking unit 30 and the number of banknotes stacked in the second banknote stacking unit 40 is displayed on the lower side, and the total monetary amount of the banknotes stacked in the first banknote stacking unit 30 and the banknotes stacked in the second banknote stacking unit 40 is displayed on the upper side.

Batch information that includes the batch number of banknotes in a batch process performed in the first banknote stacking unit 30 and the number of times the batch has been obtained in the batch process is displayed to the right of the first display region 201. Similarly, batch information that includes the batch number of banknotes in a batch process performed in the second banknote stacking unit 40 and the number of times the batch has been obtained in the batch process is also displayed to the left of the second display region 202. Specifically, in "100×0" of the batch information shown in FIG. 20(A), "100" represents the batch number of banknotes, and "0" represents the number of times the batch has been obtained, which will be described below in detail.

In FIG. 20(A), a boundary between a portion inside and a portion outside each of the first display region 201 and the second display region 202, and a boundary between a portion inside and a portion outside a region, of the upper portion of the total display region 203, in which the total monetary amount is displayed, are indicated by black lines. However, on an actual screen, these boundaries are represented by difference in color. Specifically, for example, in the first display region 201 and the second display region 202, blue characters are displayed in a white background. Further, on the upper side of the total display region 203, blue characters are displayed in a gray background, and, on the lower side thereof, white characters are displayed in a blue background. Further, a region outside the first display region 201, the second display region 202, and the total display region 203 is displayed in light gray. As a result, a boundary represented by difference in color appears between the portion inside and the portion outside the first display region 201. Similarly, a boundary represented by difference in color appears between the portion inside and the portion outside each of the second display region 202 and the total display region 203.

Further, as shown in FIG. 20(A), the characters in the first display region 201 and the second display region 202 are displayed on the screen as the largest characters, and the information for the banknotes stacked in the first banknote stacking unit 30 and the information for the banknotes stacked in the second banknote stacking unit 40 can be easily recognized.

An exemplary case is one in which a bundle of one-thousand-yen notes are placed in the hopper 20, and a batch process is performed in which, each time 100 fit one-thousand-yen notes are stacked in the first banknote stacking unit 30, the banknotes are taken out from the apparatus; at the same time a batch process is performed in which each time unfit one-thousand-yen notes are stacked in the second banknote stacking unit 40, the unfit notes are taken out from the apparatus, will be described below. Firstly, the operation display unit 70 is operated to set the number of banknotes in a batch (batch number) and the number of times batches for notification of completion of batch (the number of completed batches to be notified). The number of times of batches for notification of completion of batch is set in order to make a notification that the number of times of the batch process has reached a predetermined number of times.

Setting of the kind of banknotes to be handled in the batch process, the number of banknotes in a batch, the number of times of batches for notification of completion of batch, and the like can be stored as a pattern in the storage unit. When the same process is performed a following time, the pattern having been set may be merely selected. The kind of banknotes, the batch number of the banknotes, and the number of times of batches for notification of completion of batch, may be set so as to be the same between the first banknote stacking unit 30 and the second banknote stacking unit 40, or may be set so as to be different therebetween. For example, the first banknote stacking unit 30 may be set such that notification is made each time the batch for 50 ten-thousand-yen notes has been obtained five times, and the second banknote stacking unit 40 may be set such that the notification is made each time the batch for 100 one-thousand-yen notes has been obtained ten times.

The operation display unit 70 is operated and the first banknote stacking unit 30 is set such that the kind of banknotes to be stacked is a fit one thousand yen note, the number of banknotes in a batch is 100, and the number of completed batches to be notified is five. The second banknote stacking unit 40 is set such that the kind of banknotes to be stacked is a one thousand yen unfit note, the batch number of the banknotes is 100, and the number of times of batches for notification of completion of batch is five. When the setting operation has been completed, the number of banknotes and the monetary amount of the banknotes displayed in the first display region 201, the second display region 202, and the total display region 203, are reset as 0 (zero) on the screen of the operation display unit 70, and the stand-by state is entered, as shown in FIG. 20(A). Further, the batch information is displayed to the right of the first display region 201 as "100×0", which indicates that the number of banknotes in a batch is set as "100" in the first banknote stacking unit 30, and the number of times the batch has been obtained is currently "0" in the first banknote stacking unit 30. Similarly, the batch information is displayed to the left of the second display region 202 as "100×0", which indicates that the number of banknotes in a batch is set as "100" in the second banknote stacking unit 40, and the number of times the batch has been obtained is currently "0" in the second banknote stacking unit 40.

In a case where multiple one-thousand-yen notes are placed in the hopper 20, to start the batch process, and the number of fit one-thousand-yen notes stacked in the first banknote stacking unit 30 reaches 100 which is the batch number, transporting of banknotes is stopped in the banknote handling apparatus 1. At this time, the screen as shown in FIG. 20(B) is displayed on the operation display unit 70. In the total display region 203, the total monetary amount of banknotes stacked in the first banknote stacking unit 30 and banknotes stacked in the second banknote stacking unit 40, and the total number of the banknotes stacked in the first banknote stacking unit 30 and the banknotes stacked in the second banknote stacking unit 40, are displayed.

Further, in the first display region 201 on the screen, the background in the region is displayed in blue, and characters of "100" that indicate the number of banknotes stacked in the first banknote stacking unit 30 are displayed in white. That is, when the number of stacked banknotes reaches the batch number of banknotes, the display manner in which the number of banknotes is displayed, is changed. Further, the batch information displayed to the right of the first display region 201 is updated when the batch has been obtained in the batch process, and "100×1" is displayed. As a time when the batch information is to be updated by determining that the batch has been obtained in the batch process, one of a time when the batch number of banknotes have been stacked, or a time when taking-out of the batch number of stacked banknotes is detected, can be set.

In the first banknote stacking unit 30 and the second banknote stacking unit 40 of the banknote handling apparatus 1, light emitting elements such as LEDs which emit light according to display of the first display region 201 and the second display region 202 are provided. In a state where taking-out of 100 banknotes stacked in the first banknote stacking unit 30 in the batch process is awaited, the light emitting element in the first banknote stacking unit 30 blinks in order to prompt an operator to take out the banknotes and make notification that a banknote stacking unit from which banknotes are to be taken out is the first banknote stacking unit 30.

At this time, the background of the first display region 201 of the operation display unit 70 is displayed in blue, and the light emitting element in the first banknote stacking unit 30 is caused to blink similarly in blue. The operator can know that the number of banknotes stacked in the first banknote stacking unit 30 has reached the batch number of banknotes according to the display on the operation display unit 70, and the blinking of the light emitting element in the first banknote stacking unit 30. When the operator has taken out 100 banknotes stacked in the first banknote stacking unit 30, the stacked-banknote detection sensors 151 to 154 detect that the banknotes in the first banknote stacking unit 30 have been taken out, and banknote handling is automatically restarted, in banknote handling apparatus 1.

Thus, each time the number of banknotes stacked in the first banknote stacking unit 30 or the second banknote stacking unit 40 reaches 100, the number of times the batch has been obtained, which is included in the corresponding batch information, is incrementally increased by one on the screen of the operation display unit 70.

For example, when the number of times the batch has been obtained in the first banknote stacking unit 30, reaches five that is set as the number of times completed batches are notified as completed, the screen as shown in FIG. 20(C) is displayed. The batch information for the first banknote stacking unit 30 is updated so as to represent "100×5", and an icon that indicates that the number of times of batches for notification of completion of batch has been reached is displayed on the upper side of the display of the batch information. Further, although the light emitting element in the first banknote stacking unit 30 blinks, in a case where the number of times of batches for notification of completion of batch has been reached, the blinking is performed in a manner different from a manner for a time when a normal batch has been obtained. Specifically, for example, the number of times blinking is performed for one second is made different, or the color of blinking light emitted from the light emitting element is made different, between a time when a normal batch has been obtained, and a time when the number of times of batches for notification of completion of batch has been reached.

The number of banknotes stacked in the first banknote stacking unit 30 is displayed in the first display region 201 on the screen. Meanwhile, the total monetary amount and the total number of all the banknotes stacked in the first banknote stacking unit 30 and the second banknote stacking unit 40 after start of the batch process, are displayed in the total display region 203. In the example shown in FIG. 20(C), no banknotes are stacked in the second banknote stacking unit 40, whereby the total monetary amount and the total number of banknotes for five batches obtained in the first banknote stacking unit 30 are displayed.

When the number of times batches have been completed reaches the number of times batches are notified as completed, the number of times the batch has been obtained, in the batch information displayed to the right of the first display region 201, is reset as "0", and "100×0" is displayed as shown in FIG. 20(D). The operation of counting the number of times the batch has been obtained, and making, each time the number of times the batch has been obtained reaches five, the notification thereof, is repeatedly performed. In the total display region 203, information including the information for banknotes having been handled before the reset is displayed also after the number of times the batch has been obtained is reset.

In a case where a time when the banknotes are taken out is set as a time when the batch information is to be updated, at a time when the banknotes are taken out after the number of stacked banknotes has reached 100, the number of times the batch has been obtained is incrementally increased. When the number of times the batch has been obtained has reached the number of times of batches for notification of completion of batch, the number of times the batch has been obtained is incrementally increased at a time when the banknote have been taken out, and "100×5" is displayed. When the banknotes are taken out, the taking-out of the banknotes is detected, and handling of the banknotes is automatically started. However, display of "100×5" is maintained on the screen for a predetermined time period (for example, five seconds), and the number of times the batch has been obtained is then reset, and "100×0" is displayed.

Thus, in the banknote handling apparatus 1, since notification that the number of times the batch has been obtained has reached a predetermined number of times, is made. Also when, for example, 100 banknotes are bundled into one bundle, and five bundles are packed, the operator may merely continue to perform an operation of taking out 100 banknotes stacked in the banknote stacking unit. Unless the number of times the batch has been obtained is counted, the notification that five bundles have been obtained is made, whereby the packing may be merely performed according to the notification being received. Thus, an operator is allowed to easily proceed with the task.

Next, a screen displayed on the operation display unit 70 when a rejected note is in the banknote handling apparatus 1 will be described. As shown in FIG. 20, the screen displayed on the operation display unit 70 when handling of banknotes is started, does not include a region in which information for the reject unit 50 is displayed. In a case where a rejected note is among the notes being handled, a partial region in which information for the rejected note is displayed, is set on the screen.

FIG. 21 illustrates an example of a screen displayed on the operation display unit 70 when rejection of a note occurs. This figure shows where, for example, a banknote recognized after 23 fit one-thousand-yen notes are stacked in the first banknote stacking unit 30, 10 unfit one-thousand-yen notes are stacked in the second banknote stacking unit 40, and the total number of banknotes has reached 33, and a rejected note is displayed on the screen as shown in FIG. 21(A).

On the screen, the first display region 201 in which information for the first banknote stacking unit 30 is displayed, the second display region 202 in which information for the second banknote stacking unit 40 is displayed, and a reject display region 206 in which information for the reject unit 50 is displayed, are displayed so as to satisfy the positional relationship corresponding to positions at which the first banknote stacking unit 30, the second banknote stacking unit 40, and the reject unit 50 are arranged in the banknote handling apparatus 1 as viewed from the front thereof. Specifically, as shown in FIG. 1 and the like, in the banknote handling apparatus 1, the first banknote stacking unit 30 is disposed on the left side of the lower portion on the front surface, the second banknote stacking unit 40 is disposed on the right side of the lower portion on the front surface, and the reject unit 50 is disposed above the second banknote stacking unit 40. Therefore, in the region, on the operation display unit 70, in which information is displayed, the first display region 201 is disposed in the lower left portion thereof, the second display region 202 is disposed in the lower right portion thereof, and the reject display region 206 is disposed above the second display region 202. In FIG. 21, a boundary between a portion inside and a portion outside the reject display region 206 is indicated as a black line. However, similarly to the first display region 201 and the second display region 202, on an actual screen, the boundary is represented by difference in color from a portion therearound.

The reject display region 206 is displayed so as to be smaller than the first display region 201 and the second display region 202. Further, for the first display region 201 and the second display region 202, it is not indicated that the information displayed in the regions is information for banknotes stacked in the banknote stacking units 30, 40. However, for the reject display region 206, characters "REJECT" are displayed below the region in order to indicate that the information in the region is information for the rejected notes.

In the rejected notes, banknotes that are rejected due to different reject reasons are included. For example, a banknote which cannot be recognized, a counterfeit note that is recognized as being not a genuine note, a banknote that is recognized as being likely to be a counterfeit note, or a banknote that is determined to be not normally diverted or stacked into the banknote stacking unit since the banknote is transported in a skewed state, as a result of one banknote fed by the hopper 20 into the transport path being recognized by the recognition unit 100, is transported as a rejected note into the reject unit 50. Further, also in a case where, for example, overlapping in which a plurality of banknotes are transported in an overlapping state, or chaining in which banknotes are sequentially transported at shorter intervals than predetermined intervals in a transporting direction is detected by the recognition unit 100 or the banknote detection sensors 80 to 84, these banknotes are transported as rejected notes into the reject unit 50. In addition thereto, also in a case where the size or the thickness of a banknote is outside a predetermined range, the banknote is transported as a rejected note into the reject unit 50.

In the banknote handling apparatus 1, the size or the thickness of a banknote transported in the transport path is detected by the recognition unit 100 or the banknote detection sensors 80 to 84, whereby it can be also detected that some of a plurality of paper pieces into which one banknote has been separated, is transported, in addition to overlapping in which some or the entirety of a plurality of banknotes are transported in an overlapping state being detected. It can be determined whether or not one banknote is being transported. Thus, in a case where the number of rejected notes can be determined, the total number of rejected notes stacked in the reject unit 50 is displayed in the reject display region 206.

Meanwhile, in a case where the number of transported banknotes cannot be determined due to the overlapping, chaining, abnormality in thickness, abnormality in size, or the like, the number of rejected banknotes cannot be determined, and, the contents displayed in the reject display region 206 are changed. Specifically, the number of times rejection has occurred, is displayed instead of the number of rejected notes. For example, in a case where overlapping is detected, the number of times rejection has occurred is counted as one, but the number of banknotes that are transported in the overlapping state cannot be determined, and the number of banknotes cannot be determined. Therefore, the number of times rejection has occurred is displayed instead of the number of rejected notes in the banknote handling apparatus 1.

Further, in the banknote handling apparatus 1, the number of rejected notes and the number of times rejection has occurred, are displayed in different display manners, respectively, such that whether information displayed in the reject display region 206 represents the number of rejected notes or the number of times the rejection has occurred, can be known.

FIG. 21(B) illustrates an example of a screen on which the number of times rejection has occurred is displayed. Thus, when the number of times rejection has occurred is displayed, an exclamation mark (exclamation point) is displayed in the reject display region 206, and the number of times rejection has occurred is displayed in parentheses. By changing the display manner in the reject display region 206, the number of rejected notes is displayed as shown in FIG. 21(A), and the number of times rejection has occurred is displayed as shown in FIG. 21(B), whereby an operator can easily know whether the information displayed in the reject display region 206 is the number of rejected notes or the number of times rejection has occurred.

In a case where both rejection in which the number of banknote can be determined and rejection in which the number of banknotes cannot be determined occur, the total of the determined number of rejected notes, and the number of times rejection has occurred in a state where the number of banknotes cannot be determined, is displayed as the number of times rejection has occurred.

Specifically, for example, in a case where, after 23 banknotes are stacked in the first banknote stacking unit 30, and 10 banknotes are stacked in the second banknote stacking unit 40, rejection has occurred where the number of banknotes can be determined, "1" is displayed as the number of rejected notes in the reject display region 206 as shown in FIG. 21(A). In a case where rejection subsequently occurs, and the rejection is rejection, such as overlapping, in which the number of banknotes cannot be determined, an exclamation mark is displayed in the reject display region 206, and "2" obtained by adding "1" which represents the subsequently detected number of times rejection has been occurred, to "1" which has been previously determined as the number of rejected notes, is displayed in parentheses, as shown in FIG. 21(B).

Thus, in a case where the number of rejected notes can be determined, the number of rejected notes is displayed, whereby the total number of banknotes which have been handled can be confirmed according to the total number of banknotes displayed in the total display region 203 and the number of rejected notes displayed in the reject display region 206, after completion of the handling. Meanwhile, in a case where the number of rejected notes cannot be determined, the number of times rejection has occurred is displayed, and the total number of banknotes which have been handled cannot be accurately calculated. However, information which represents the estimated total number of banknotes can be obtained.

Also for the reject unit 50, when an operator is prompted to take out the rejected notes, display of the reject display region 206 is changed on the screen of the operation display unit 70. Specifically, as shown in FIG. 21(C), similarly to a case where the number of banknotes stacked in the first banknote stacking unit 30 reaches the batch number of banknotes, or the number of banknotes stacked in the second banknote stacking unit 40 reaches the batch number of banknotes, the background in the reject display region 206 is displayed in blue and characters are displayed in white.

Further, also in the stacking space of the reject unit 50, a light emitting element such as a LED that emits light according to display in the reject display region 206 is disposed. In a stand-by state in which taking-out of the rejected notes from the reject unit 50 is awaited, the light emitting element in the reject unit 50 is caused to blink. At this time, the background in the reject display region 206 of the operation display unit 70 is displayed in blue, and the light emitting element in the reject unit 50 is caused to blink similarly in blue. An operator can know that the rejected notes need to be taken out from the reject unit 50, according to the display on the operation display unit 70 and blinking of the light emitting element in the reject unit 50.

In the operation display unit 70, notification, for prompting taking-out of banknotes, which is performed by changing the display manner in which the information for the first banknote stacking unit 30, the second banknote stacking unit 40, and the reject unit 50 is displayed, and notification, for prompting taking-out of banknotes, which is performed by blinking of the light emitting elements in the first banknote stacking unit 30, the second banknote stacking unit 40, and the reject unit 50, are performed also when handling of banknotes has been completed, in addition to when the number of stacked banknotes have reached a predetermined number of banknotes such as the batch number of banknotes or the upper limit number of stacked banknotes (the full number or the nearly full number of banknotes).

In the banknote handling apparatus 1, in a case where an error occurs during handling of banknotes, restoration may be performed. In the restoration, a state of banknotes stacked in the first banknote stacking unit 30 and the second banknote stacking unit 40 is restored to a state of the banknotes at a time when the error has occurred, after restoring from the error.

Specifically, in a case where the apparatus stops due to occurrence of an error, the transport path in the apparatus is exposed as shown in FIG. 7 and FIG. 8, and all the banknotes remaining in the transport path are removed. When a state in which handling of banknotes can be restarted in the banknote handling apparatus 1 is entered, the banknote taken out from the transport path in the apparatus, and the banknotes which have been stacked in the first banknote stacking unit 30 and the second banknote stacking unit 40 at the occurrence of the error, are placed in the hopper 20, to start the restoration. In the banknote handling apparatus 1, information for banknotes which have been stacked in each of the first banknote stacking unit 30 and the second banknote stacking unit 40 at the occurrence of the error, is stored. By using the information, the banknotes placed in the hopper 20 are sorted and stacked into the first banknote stacking unit 30 and the second banknote stacking unit 40, whereby the stacking state at a time when the error has occurred is restored.

FIG. 22 illustrates an example of a screen displayed on the operation display unit 70 when the restoration is performed. In a case where, for example, 21 banknotes are stacked in the second banknote stacking unit 40 at the occurrence of an error, and an operation for starting the restoration is performed in the operation display unit 70, "21" is displayed, as the number of banknotes stacked in the second banknote stacking unit 40, in the second display region 202 on the screen, as shown in FIG. 22. However, the display is performed in a display manner different from that for normal banknote handling.

Specifically, for example, a line of a boundary between the portion inside and the portion outside the second display region 202 is highlighted by a red line, and characters in the region are displayed in red. Thus, the line of the boundary is displayed in a color which is not used for display in the normal banknote handling, or the characters are displayed in a different color, whereby the operator can easily know that this is not a normal banknote handling.

The restoration is started in a state where the screen display is as shown in FIG. 22, and banknotes are sequentially stacked in the second banknote stacking unit 40. According thereto, the number of banknotes displayed in the second display region 202 is decremented by one, and when the number of banknotes stacked in the second banknote stacking unit 40 reaches 21 which has been displayed at the occurrence of the error, the number of banknotes is displayed as "0". When the restoration has been completed, the banknote handling that has been stopped due to the error is subsequently restarted, and the display in the second display region 202 is restored to a normal display. After restarting of the banknote handling, when the subsequent banknote corresponding to the 22-nd banknote has been stacked in the second banknote stacking unit 40, the display of the number of banknotes in the second display region 202 is changed from "0" to "22".

Thus, in the banknote handling apparatus 1, the information for the banknote handling being performed is displayed on the operation display unit 70 in an easily recognizable manner, whereby an operator can easily proceed with the banknote handling while checking the information on the operation display unit 70. For example, in a case where not only the number of banknotes stacked in the banknote stacking units 30, 40, but also the batch number of banknotes, the number of times the batch has been obtained, and the like are displayed, and the number of times the batch has been obtained has reached a predetermined number of times, the notification thereof is made, thereby easily proceeding with the batch process. Further, not only the information for the recognized and counted banknotes but also information for rejected notes can be displayed, whereby information for the total number of banknotes which have been handled can be recognized when the banknote handling has been completed.

Further, in the operation display unit 70, the information for a plurality of the banknote stacking units is displayed on the corresponding positions on the screen according to the positional relationship, among the banknote stacking units, as viewed from an operator who operates the operation display unit 70. Therefore, the operator can easily recognize the banknote stacking unit corresponding to the information on the screen.

Further, each banknote stacking unit includes the light emitting element. For example, at a time when the number of banknotes stacked in the banknote stacking unit reaches a predetermined number of banknotes, and the banknotes need to be taken out, the light emitting element in the banknote stacking unit from which the banknotes need to be taken out, blinks. Therefore, an operator can easily know that the banknotes need to be taken out, and easily know a position of the banknote stacking unit from which the banknotes need to be taken out. Further, the light emitting element in the banknote stacking unit from which the banknotes need to be taken out is caused to emit light in the same color as the background color in the display region, on the screen of the operation display unit 70, in which information for the banknote stacking unit from which banknotes need to be taken out, is displayed. Therefore, correspondence between the information on the screen and the banknote stacking unit can be easily recognized.

[Setting of Priorities for Banknote Stacking Units]

In the banknote handling apparatus 1, priorities for the first banknote stacking unit 30 and the second banknote stacking unit 40 can be set. For example, in a case where a banknote recognized by the recognition unit 100 can be stacked in either of the first banknote stacking unit 30 and the second banknote stacking unit 40, the destination to which the banknote is to be transported is determined on the basis of a predetermined priority setting.

Figures 23, 24:
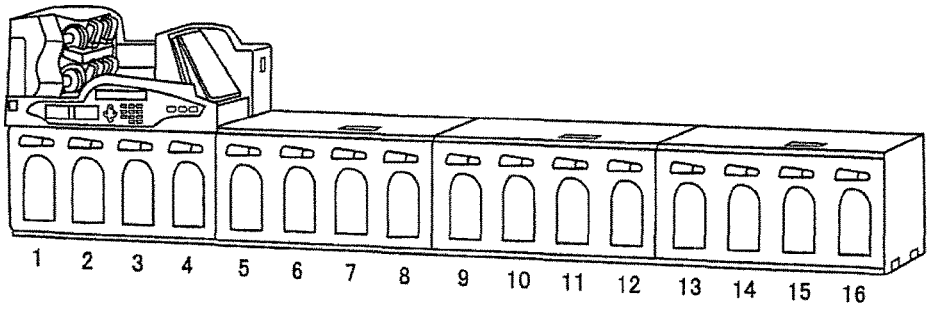
FIG. 23 illustrates priority setting for a plurality of banknote stacking units disposed in the banknote handling apparatus.
FIG. 24 is an external view illustrating an example of a banknote handling apparatus that includes multiple banknote stacking units.

FIG. 23 illustrates the priority setting for a plurality of banknote stacking units 30, 40 disposed in the banknote handling apparatus 1. Thus, priorities for the first banknote stacking unit 30 and the second banknote stacking unit 40 are set and stored as patterns, whereby, in banknote handling, the pattern is selected and priorities can be set. Information for denominations, fitness/unfitness, old/new version, authenticity, and the like as well as the priorities can be registered as patterns, which is not shown in FIG. 23.

For example, in a case where the banknote handling apparatus 1 is installed in a teller window of a bank such that the apparatus right side surface on which the hopper 20 and the reject unit 50 are provided, faces a customer outside the teller window, a pattern 2 shown in FIG. 23 is selected. As a result, the second banknote stacking unit 40 positioned close to the customer is preferentially used as a destination to which banknotes are transported, whereby the customer can easily recognize a state in which the banknotes are stacked. Further, for example, in a case where an operator of the banknote handling apparatus 1 is left-handed, a pattern 1 shown in FIG. 23 is selected, and switching is performed such that the first banknote stacking unit 30 is preferentially used, to perform banknote handling. Thus, the operator is allowed to take out the banknotes stacked in the first banknote stacking unit 30 with a left hand that is the operator's dominant hand.

In a case where the banknote handling apparatus 1 includes multiple banknote stacking units, an excellent effect by the priority setting for the banknote stacking units can be obtained. An exemplary case where, in the banknote handling apparatus that includes 16 banknote stacking units, a kind of banknotes to be stacked is assigned to each banknote stacking unit according to the priority setting, will be described below.

FIG. 24 illustrates an example of the banknote handling apparatus that includes 16 banknote stacking units. 16 banknote stacking units each of which has an opening through which banknotes are taken out, are disposed on the apparatus front side, and the hopper, the reject unit, the operation display unit, and the like are disposed on the four banknote stacking units which are the first to the fourth banknote stacking units when counted from the left end.

For example, one-person operation pattern for banknote handling performed by one operator is set in the priority setting. The one-person operation pattern is set such that the closer the position of the banknote stacking unit is to the left side, the higher the priority is. As a result, the banknote stacking unit, disposed on the apparatus left side, on which the hopper and the operation display unit are provided, is preferentially used, whereby the operator need not move to a position of the banknote stacking unit at the right end in a case where the operator takes out banknotes from the banknote stacking unit while placing banknotes in the hopper or operating the operation display unit, whereby the operator is allowed to easily proceed with the task.

In the priority setting, the priorities can be set on the basis of not only the positional relationship among the banknote stacking units, but also the information for the banknote handling which has been previously performed. For example, in a case where, in the priority setting, the priorities for the banknote stacking units are set as "left", and the banknote denomination assigned to the banknote stacking unit to be preferentially used is set as "multiple", the denomination of banknotes to be stacked in each banknote stacking unit is automatically assigned such that the closer the banknote stacking unit is to left side, the greater the number of banknotes to be stacked is. The relationship between the banknote denomination and the number of banknotes to be stacked is determined on the basis of the information for the denomination and the number of banknotes having been previously handled.

Figure 25:
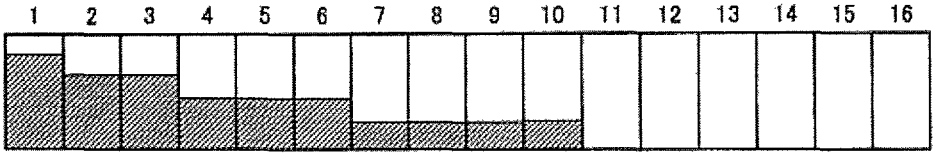
FIG. 25 is a schematic diagram illustrating a method for setting kinds of banknotes to be stacked in banknote stacking units, respectively.
Figure 25:
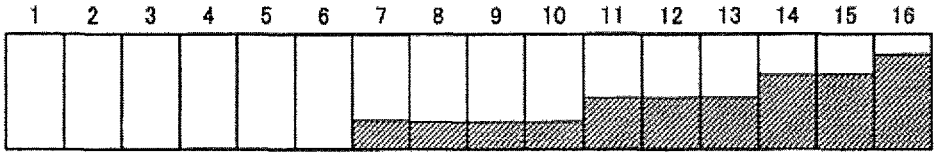
Figure 25:
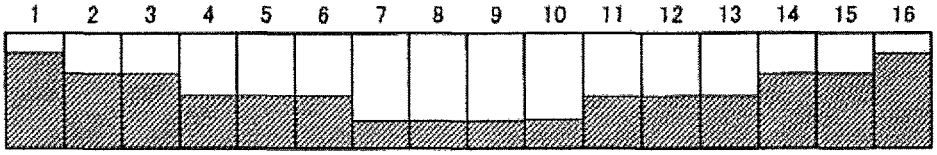
Figure 25:
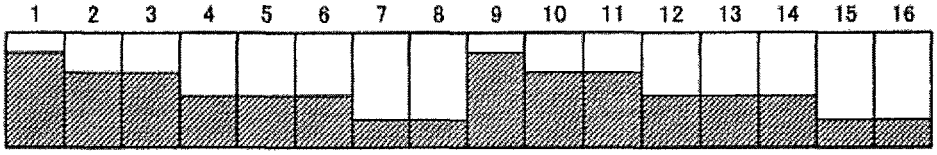

For example, in the priority setting for the one-person operation pattern, the banknotes are stacked such that, for a denomination of the greater number of handled banknotes, the banknote stacking unit to which the denomination is assigned is closer to the left side. Thus, on the basis of data accumulated in previous banknote handling, a denomination of the greatest number of handled banknotes is assigned to the banknote stacking unit disposed at the left end. Further, a denomination of the greater number of handled banknotes is assigned to the banknote stacking unit in order starting from the left side such that, for example, a denomination of the second greatest number of handled banknotes is assigned to the second banknote stacking unit from the left end. As a result, when the banknote handling is performed, the closer the banknote stacking unit is to the left side, the greater the number of banknotes to be stacked is, as shown in FIG. 25(A). FIG. 25 is a schematic diagram illustrating the number of banknotes to be stacked in each of 16 banknote stacking units. In FIG. 25(A), the closer the banknote stacking unit is to the left side, the greater the number of banknotes to be stacked is.

For example, in a case where one operator packs banknotes taken out from the banknote stacking unit, in a container, for transporting, such as a cassette or a bag for carrying banknotes, the operator places the container for transporting, near the left end of the apparatus, and performs the task. The operator takes out banknotes from the banknote stacking unit and packs the banknotes in the container for transporting while placing banknotes in the hopper or operating the operation display unit. At this time, as shown in FIG. 25(A),the closer the banknote stacking unit is to the left side, the greater the number of stacked banknotes is, whereby the number of times the operator moves to the banknote stacking unit positioned at the right end in order to take out the banknotes, can be minimized. Further, the greater the distance from the container for transporting, the less the number of stacked banknotes is, whereby a large amount of banknotes need not be taken out and carried over a long distance to the position of the container for transporting. Thus, burden of the task by the operator can be reduced.

In a case where, for example, two persons perform a task such that one of the persons merely places banknotes in the hopper and the other of the persons merely performs taking-out of banknotes from each banknote stacking unit and packing of the banknotes in the container for transporting, priority setting for a two-person operation pattern is made such that, for a denomination of the greater number of handled banknotes, the banknote stacking unit to which the denomination is assigned is closer to the right side, to stack the banknotes.

As a result, a denomination of the greater number of handled banknotes is assigned to the banknote stacking unit in order starting from the right side, and the stacking state is as shown in FIG. 25(B) in the banknote handling. One of the persons continuously places banknotes in the hopper on the left side of the apparatus, and the other of the persons places the container for transporting near the right end of the apparatus, and takes out banknotes from each banknote stacking unit and packs the banknotes in the container for transporting, thereby efficiently proceeding with the task.

Further, in a case where, for example, two persons perform a task such that one of the persons performs both placing of banknotes in the hopper and taking-out of the banknotes from each banknote stacking unit, and the other of the persons merely performs taking-out of banknotes from each banknote stacking unit and packing of the banknotes in the container for transporting, the priority setting for a two-person operation pattern is made such that the closer the banknote stacking unit is to the left and the right outer sides, the greater the number of banknotes to be stacked is.

As a result, a denomination of the greater number of handled banknotes is assigned to the banknote stacking unit in order starting from the left outer side and the right outer side, and the stacking state is as shown in FIG. 25(C) in the banknote handling. The container for transporting is placed at almost the center in the arrangement direction in which the banknote stacking units are arranged, and one person takes out banknotes stacked in each banknote stacking unit and packs the banknotes in the container for transporting while continuously placing banknotes in the hopper. The other person takes out banknotes from each banknote stacking unit and packs the banknotes in the container for transporting on the side rightward of the container, for transporting, placed at almost the center. The two persons do not pass each other in the task when they move, and one person performs the task on only the side leftward of the center in the arrangement direction in which the banknote stacking units are arranged, and the other person performs the task on only the side rightward thereof, thereby efficiently proceeding with the task. Further, the two persons handle approximately the same number of banknotes, and burden of the task for only one person is not increased.

Further, in a case where one person performs both placing of banknotes in the hopper and taking-out of banknotes from each banknote stacking unit, and the other person only performs taking-out of banknotes from each banknote stacking unit and packing of the banknotes in the container for transporting, the banknote stacking units may be divided into a group of 8 banknote stacking units on the left side, and a group of 8 banknote stacking units on the right side, and the priority setting for a two-person operation pattern may be made such that the closer the banknote stacking unit is to the left side in each group, the greater the number of stacked banknotes is.

As a result, a denomination of the greater number of handled banknotes is assigned to the banknote stacking unit in order starting from the left side in each of the group on the left side and the group on the right side, and the stacking state is as shown in FIG. 25(D) in the banknote handling. The container for transporting is placed at almost the center in the arrangement direction in which the banknote stacking units are arranged, and one person takes out banknotes stacked in each banknote stacking unit and packs the banknotes in the container for transporting while continuously placing banknotes in the hopper. The other person takes out banknotes from each banknote stacking unit and packs the banknotes in the container for transporting, on the side rightward of the container, for transporting, placed at almost the center. Among the eight banknote stacking units on the right side, in the banknote stacking unit close to the position at which the container for transporting is placed, the number of stacked banknotes is increased. Therefore, the task of taking-out of banknotes and packing of the banknotes in the container for transporting is facilitated as compared to a case shown in FIG. 25(C).

Thus, in the banknote handling apparatus 1, according to the priority setting based on the positions of the banknote stacking units and the priority setting based on the number of banknotes to be handled for each kind, the kind of banknotes is appropriately assigned to each banknote stacking unit, and an operator is allowed to easily proceed with the task for the banknote handling In a case where the multiple banknote stacking units are disposed, the kind of banknotes to be stacked can be automatically assigned to each banknote stacking unit on the basis of the predetermined priority setting, whereby an operator need not perform an operation for setting in consideration of a kind of banknotes to be stacked in each banknote stacking unit, and is allowed to efficiently perform the task by merely performing the banknote handling according to the setting having been automatically performed.

In the present embodiment, as an example of a case where the information for rejected notes is displayed on the operation display unit 70, an exemplary case where the number of times a rejection of a note has occurred, instead of the number of rejected notes, is displayed as the number of times rejection has occurred, after determination of the number of rejected notes has become impossible, is described. However, the present embodiment is not limited thereto. In the banknote handling apparatus 1, the total number of rejected notes for which the number of notes can be determined, and the number of times rejection has occurred in a state where the number of rejected notes cannot be determined, are separately managed, and the reason why each banknote has been rejected as a rejected note is managed on the basis of a type of reason such as a state where recognition cannot be performed, a counterfeit note, overlapping, chaining, or the like. By utilizing this, after rejection has occurred in a state where the number of notes cannot be determined, the total number of rejected notes for which the number of notes can be determined, and the number of rejections representing the number of times rejection has occurred in a state where the number of notes cannot be determined, may be separately displayed. Further, when the number of times rejection has occurred is displayed, the number of times rejection has occurred may be displayed for each reject reason, and, further, the total number of times of the rejections may be displayed. A case where the number of rejected notes cannot be determined is, for example, a case where the recognition unit 100 or the transported-banknote detection sensors 80 to 87 detect overlapping, chaining, abnormality in thickness, abnormality in size, or the like.

In a case where the total number of rejected notes for which the number of notes can be determined, and the number of times rejection has occurred in a state where the number of notes cannot be determined, are displayed on the screen so as to be distinguishable from each other, an operator of the banknote handling apparatus 1 is able to easily know whether the displayed numerical value represents the number of rejected notes or the number of times rejection has occurred in a state where the number of notes cannot be determined. The method for displaying the information in a distinguishable manner may be a method in which, as shown in FIG. 21, the number of rejected notes for which the number of notes can be determined, is displayed by a numerical value only, while information representing the number of times rejection has occurred is displayed together with a predetermined mark in the case of the number of times rejection has occurred being displayed, or a method in which the number of rejected notes and the number of times rejection has occurred are displayed in different colors, respectively. Further, for example, characters indicating whether the numerical value represents the number of rejected notes or the number of times rejection has occurred may be displayed. Specifically, although, in FIG. 21(B), an exemplary case is illustrated where "1" as the number of rejected notes for which the number of notes can be determined and "1" as the number of times rejection has occurred in a state where the number of notes cannot be determined, are added to display "!(2)" as the number of times rejection has occurred, "the determined number is 1, the undetermined number is 1, and 2 in total" may be displayed.

As described above, in the present embodiment, information about a rejected note is displayed on the operation display unit 70 at a time when the rejection of a note occurs. Therefore, occurrence of the rejected note can be easily recognized according to a change in the information displayed on the operation display unit 70. Further, while the number of rejected notes can be determined, the number of rejected notes is displayed. Therefore, the total number of banknotes having been handled can be easily recognized according to the number of banknotes stacked in the banknote stacking unit and the number of rejected notes.

Further, in a case where determination of the number of rejected notes has become impossible, a manner in which the information for the rejected notes is displayed on the operation display unit 70 is changed, whereby it can be easily recognized that determination of the number of rejected notes has become impossible. Further, also in a case where rejection has occurred in a state where the number of notes cannot be determined, the number of times rejection has occurred is displayed, whereby information which represents the estimated total number of banknotes having been handled can be obtained, or a state of handling of banknotes can be recognized.

INDUSTRIAL APPLICABILITY

As described above, the paper sheet handling apparatus according to the present invention is a technique useful for displaying information for a rejected paper sheet in an easily recognizable manner.

DESCRIPTION OF THE REFERENCE CHARACTERS

1 banknote handling apparatus
11 upper unit
12 lower unit
13 upper lid
14 rear unit
20 hopper
30, 40 banknote stacking unit
33, 43 stacking wheel
34, 44 pushing member
50 reject unit
61 auxiliary power supply switch
62 memory card slot
63 USB port
64 LAN port
65 dedicated port
66 main power supply switch
67 power supply inlet
70 operation display unit
71 dust tray
72 dust receiver plate
80 to 87 transported-banknote detection sensor
90 to 95 transport belt
100 recognition unit
111, 112 diverter
140*a* to 140*e* sensor brush
151 to 154 stacked-banknote detection sensor

What is claimed is:

1. A sheet handling apparatus comprising:
a transport unit configured to transport sheets;
a recognition unit configured to recognize the sheets transported by the transport unit;
a reject unit configured to stack sheets that have been each determined to be a rejected sheet based on a recognition result by the recognition unit;
a display unit; and
a control unit configured to obtain a first numerical value and a second numerical value based on the recognition result by the recognition unit, the first numerical value representing the number of first rejected sheets, the second numerical value representing the number of times a second rejected sheet has been handled, each of the first rejected sheets being a rejected sheet whose number of sheets is determinable, the second reject sheet being a rejected sheet whose number of sheets is indeterminable, wherein
in a case where the control unit has obtained the first numerical value and the second numerical value, the control unit controls the display unit such that the display unit displays information based on the first numerical value and the second numerical value.

2. The sheet handling apparatus according to claim 1, wherein the control unit controls the display unit such that the display unit displays, as the information, a numerical value obtained by totaling the first numerical value and the second numerical value.

3. The sheet handling apparatus according to claim 1, wherein the control unit controls the display unit such that the display unit displays, as the information, each of the first numerical value and the second numerical value.

4. The sheet handling apparatus according to claim 1, wherein the control unit controls the display unit such that the display unit changes a display mode between a case where the control unit has obtained the second numerical value and a case where the control unit has not obtained the second numerical value.

5. The sheet handling apparatus according to claim 1, wherein, in a case where the control unit controls the display unit such that the display unit displays the second numerical value, the control unit controls the display unit such that the display unit displays a mark indicating that the second rejected sheet has been handled.

6. The sheet handling apparatus according to claim 1, wherein, in a case where the control unit has obtained the second numerical value, the control unit controls the display unit such that the display unit displays the second numerical value in association with a cause of rejection.

7. The sheet handling apparatus according to claim 1, wherein the control unit controls the display unit such that the display unit displays, as the information, each of the first numerical value and the second numerical value in different colors from each other.

8. The sheet handling apparatus according to claim 1, wherein, in a case where at least one of: an overlapping state; a chaining state; an abnormal thickness state; and an abnormal size state, has been detected based on the recognition result by the recognition unit, the control unit determines that the second rejected sheet has been handled.

9. A sheet handling apparatus comprising:
a transport unit configured to transport sheets;
a recognition unit configured to recognize the sheets transported by the transport unit;
a display unit; and
a control unit configured to cause, based on a recognition result by the recognition unit, the display unit to display information based on the number of sheets that have been each determined as one rejected sheet and on the number of times specific handling has been performed,
wherein the specific handling is handling in which it has been unable to determine whether at least one of the sheets to be handled is one sheet or not in the specific handling.

10. The sheet handling apparatus according to claim 9, wherein the control unit causes the display unit to display, as the information, a numerical value obtained by totaling the number of sheets and the number of times.

11. The sheet handling apparatus according to claim 9, wherein the control unit causes the display unit to display, as the information, each of the number of sheets and the number of times.

12. A sheet handling apparatus comprising:
a recognition unit configured to recognize, as a rejected sheet, a sheet other than a sheet satisfying a predetermined condition;
a control unit configured to count, during a recognition operation of the recognition unit, the number of rejected sheets each being countable, and the number of times the recognition operation has been performed for a rejected sheet other than the rejected sheet being countable; and a display unit configured to display information based on the number of the rejected sheets each being countable and the number of times.

13. The sheet handling apparatus according to claim 12, wherein the display unit displays, as the information, a numerical value obtained by totaling the number of the rejected sheets each being countable and the number of times.

14. The sheet handling apparatus according to claim 12, wherein the display unit displays, as the information, each of the number of the rejected sheets each being countable and the number of times.

* * * * *